US008699721B2

(12) United States Patent
Burnett

(10) Patent No.: US 8,699,721 B2
(45) Date of Patent: Apr. 15, 2014

(54) CALIBRATING A DUAL OMNIDIRECTIONAL MICROPHONE ARRAY (DOMA)

(75) Inventor: Gregory C. Burnett, Dodge Center, MN (US)

(73) Assignee: AliphCom, San Francisco, CA (US)

( * ) Notice: Subject to any disclaimer, the term of this patent is extended or adjusted under 35 U.S.C. 154(b) by 771 days.

(21) Appl. No.: 12/826,643

(22) Filed: Jun. 29, 2010

(65) Prior Publication Data

US 2011/0051950 A1 Mar. 3, 2011

Related U.S. Application Data

(63) Continuation-in-part of application No. 12/139,333, filed on Jun. 13, 2008.

(60) Provisional application No. 61/221,419, filed on Jun. 29, 2009.

(51) Int. Cl.
*H04R 3/00* (2006.01)

(52) U.S. Cl.
USPC ..... 381/92; 381/71.1; 381/111; 381/122; 381/94.1; 704/233

(58) Field of Classification Search
USPC ..... 381/26, 313, 60, 317, 96, 95, 58, 59, 381/92, 111, 122, 56, 71.1, 94.1, 94.7; 704/233, E21.004
See application file for complete search history.

(56) References Cited

U.S. PATENT DOCUMENTS

| | | | | |
|---|---|---|---|---|
| 6,408,079 | B1 * | 6/2002 | Katayama et al. | 381/98 |
| 2004/0264706 | A1 * | 12/2004 | Ray et al. | 381/71.11 |
| 2005/0047611 | A1 * | 3/2005 | Mao | 381/94.7 |
| 2005/0157890 | A1 * | 7/2005 | Nakajima et al. | 381/92 |
| 2006/0147054 | A1 * | 7/2006 | Buck et al. | 381/92 |
| 2006/0215841 | A1 * | 9/2006 | Vieilledent et al. | 381/17 |

* cited by examiner

*Primary Examiner* — Vivian Chin
*Assistant Examiner* — Friedrich W Fahnert
(74) *Attorney, Agent, or Firm* — Kokka & Backus, PC

(57) ABSTRACT

Systems and methods are described by which microphones comprising a mechanical filter can be accurately calibrated to each other in both amplitude and phase.

62 Claims, 48 Drawing Sheets

| Headset | $f_{max}$ (Hz) | $\Phi_{max}$ (deg) | Estimated $f_1$ | Estimated $f_2$ |
|---|---|---|---|---|
| 90B9 | 152 | 11.9 | 187 | 123 |
| 6AB5 | 200 | -3.5 | 188 | 213 |
| 6C83 | 266 | -12.7 | 213 | 333 |

FIG.16

| | 90B9 | 6AB5 | 6C83 |
|---|---|---|---|
| 100 Hz | 3.3 | 6.4 | 9.4 |
| 200 Hz | 1.1 | 2.7 | 4.7 |
| 300 Hz | 0.4 | 1.3 | 2.6 |

FIG.17

| | | $O_1$ (dB down) | | $O_2$ (dB down) | | max angle | $O_1O_2$ (dB down) | |
|---|---|---|---|---|---|---|---|---|
| **f1** | **f2** | **125** | **375** | **125** | **375** | **(deg)** | **125** | **375** |
| 100 | 100 | -2.0 | -0.3 | -2.0 | -0.3 | 0 | -4.0 | -0.6 |
| 100 | 125 | -2.0 | -0.3 | -2.8 | -0.4 | -6.4 | -4.8 | -0.7 |
| 100 | 150 | -2.0 | -0.3 | -3.6 | -0.6 | -11.5 | -5.6 | -0.9 |
| 150 | 150 | -3.6 | -0.6 | -3.6 | -0.6 | 0 | -7.2 | -1.2 |
| 100 | 200 | -2.0 | -0.3 | -5.1 | -1.0 | -19.5 | -7.1 | -1.2 |
| 125 | 250 | -2.8 | -0.4 | -6.4 | -1.4 | -19.5 | -9.2 | -1.8 |
| 200 | 250 | -5.1 | -1.0 | -6.4 | -1.4 | -6.4 | -11.5 | -2.3 |
| 250 | 350 | -6.4 | -1.4 | -8.5 | -2.3 | -9.6 | -14.9 | -3.7 |
| 100 | 350 | -2.0 | -0.3 | -8.5 | -2.3 | -33.8 | -10.6 | -2.6 |
| 350 | 350 | -8.5 | -2.3 | -8.5 | -2.3 | 0 | -17.1 | -4.5 |

FIG.18

| | | | $O_1O_2$ (dB down) | | Boost needed (dB) | |
|---|---|---|---|---|---|---|
| f1 | f2 | Δf | 125 | 375 | 125 | 375 |
| 100 | 100 | 0 | -4.0 | -0.6 | -1.1 | -0.4 |
| 100 | 125 | 25 | -4.8 | -0.7 | -0.3 | -0.3 |
| 100 | 150 | 50 | -5.6 | -0.9 | 0.5 | -0.1 |
| 150 | 150 | 0 | -7.2 | -1.2 | 2.1 | 0.2 |
| 100 | 200 | 100 | -7.1 | -1.2 | 2.0 | 0.2 |
| 125 | 250 | 125 | -9.2 | -1.8 | 4.1 | 0.8 |
| 200 | 250 | 50 | -11.5 | -2.3 | 6.4 | 1.3 |
| 250 | 350 | 100 | -14.9 | -3.7 | 9.8 | 2.7 |
| 100 | 350 | 250 | -10.6 | -2.6 | 5.5 | 1.6 |
| 350 | 350 | 0 | -17.1 | -4.5 | 12.0 | 3.5 |

FIG.19

| Head-set | Max phase | DENOISING (dB) | | | DEVOICING (dB) | | | SNR INCREASE (dB) | | |
|---|---|---|---|---|---|---|---|---|---|---|
| | | Low | Mid | High | Low | Mid | High | Low | Mid | High |
| 931B-v5 | +2 | STD | STD | STD | STD | STD | STD | STD | STD | STD |
| 931B-v4 | +2 | 1 | -1 | -1 | 1 to 2 | 0.5 | 0 | 0 to -1 | -0.5 | -1 |
| 2679-v4 | +5 | 0 to -4 | 0 to -2 | 0 to -1 | 1 to 2 | 1 | 1 | -2 to -6 | -1 to -3 | -1 to -2 |
| D9CE-v4 | +12 | -3 to -11 | -1 to -2 | 0 | 0 | 1 | 1 | -3 to -11 | -2 to -3 | -1 |
| 22FB-v4 | +16 | -10 to -12 | -1 to -3 | -1 to -2 | -3 to -6 | 0 | 0 | -4 to -6 | -1 to -3 | -1 to -2 |
| C7BA-v4 | -14 | 7 to 9 | 1 | 0 | 4 | 0 | 0 | 3 to 5 | 1 | 0 |
| C014-v4 | -17 | 9 to 11 | 1 | -1 | 4 to 6 | 2 | 2 | 3 to 5 | -1 | -3 |
| D9CE-v5 | +2.5 | 0 to -1 | -1 | 0 | 1 to 2 | 0 | 0 | -2 to -3 | -1 | 0 |
| 2679-v5 | -1.5 | 0 to -1 | -1 to -2 | 1 to 2 | 1 to 2 | 0 | 0 | -2 to -3 | -1 to -2 | -1 to -2 |
| C014-v5 | -1 | 1 | 1 to 2 | 1 | 0 to 2 | 1 to 2 | 0 | 0 to -1 | 0 | 1 |
| C7BA-v5 | -2 | 0 | -1 to -2 | -1 to -2 | 0 | -1 | -1 | 0 | 0 to -1 | 0 to -1 |
| 22FB-v5 | 2.5 | 0 to -1 | -1 to -2 | -1 | 1.5 | 0 | 0 | -1.5 to -2.5 | -1 to -2 | -1 |

FIG.22

| BDA | Initial max | Final max |
|---|---|---|
| 26184F | 6.3 | 1.6 |
| 25D75B | 5.3 | 2.0 |
| 25F100 | 4.8 | 1.4 |
| 25FD63 | 4.5 | 1.5 |
| 25A640 | 4.3 | 5.0 |
| 25A93B | 4.2 | 1.9 |
| 25ECE0 | 3.5 | 4.5 |
| 258341 | 3.1 | 4.1 |
| 2600FD | 3.8 | 4.1 |
| 25CD77 | 2.0 | 3.7 |
| 25FDA1 | 3.6 | 3.7 |
| 259474 | 2.3 | 3.5 |
| 25984B | 2.3 | 3.2 |
| 25F0DA | 2.6 | 3.2 |
| 258575 | 0.4 | 2.8 |
| 2610EB | 10.0 | 2.8 |
| 25CD6D | 1.4 | 2.5 |
| 26012A | 2.0 | 2.5 |
| 259CF2 | 9.2 | 2.5 |
| 2596FF | 1.4 | 2.4 |
| 25A865 | 1.4 | 2.4 |
| 25A659 | 16.8 | 2.4 |
| 2553EC | 13.1 | 2.3 |
| 2595FE | 0.7 | 2.3 |

FIG.28

Linear response of V2 to a speech source at 0.10 meters

Linear response of V2 to a noise source at 1 meters

Linear response of V1 to a speech source at 0.10 meters

Linear response of V1 to a noise source at 1 meters

CALIBRATING A DUAL OMNIDIRECTIONAL MICROPHONE ARRAY (DOMA)

RELATED APPLICATIONS

This application claims the benefit of U.S. Patent Application No. 61/221,419, filed Jun. 29, 2009.

This application is a continuation in part application of U.S. patent application Ser. No. 12/139,333, filed Jun. 13, 2008.

TECHNICAL FIELD

The disclosure herein relates generally to noise suppression systems. In particular, this disclosure relates to calibration of noise suppression systems, devices, and methods for use in acoustic applications.

BACKGROUND

Conventional adaptive noise suppression algorithms have been around for some time. These conventional algorithms have used two or more microphones to sample both an (unwanted) acoustic noise field and the (desired) speech of a user. The noise relationship between the microphones is then determined using an adaptive filter (such as Least-Mean-Squares as described in Haykin & Widrow, ISBN #0471215708, Wiley, 2002, but any adaptive or stationary system identification algorithm may be used) and that relationship used to filter the noise from the desired signal.

Most conventional noise suppression systems currently in use for speech communication systems are based on a single-microphone spectral subtraction technique first develop in the 1970's and described, for example, by S. F. Boll in "Suppression of Acoustic Noise in Speech using Spectral Subtraction," IEEE Trans. on ASSP, pp. 113-120, 1979. These techniques have been refined over the years, but the basic principles of operation have remained the same. See, for example, U.S. Pat. No. 5,687,243 of McLaughlin, et al., and U.S. Pat. No. 4,811,404 of Vilmur, et al. There have also been several attempts at multi-microphone noise suppression systems, such as those outlined in U.S. Pat. No. 5,406,622 of Silverberg et al. and U.S. Pat. No. 5,463,694 of Bradley et al. Multi-microphone systems have not been very successful for a variety of reasons, the most compelling being poor noise cancellation performance and/or significant speech distortion. Primarily, conventional multi-microphone systems attempt to increase the SNR of the user's speech by "steering" the nulls of the system to the strongest noise sources. This approach is limited in the number of noise sources removed by the number of available nulls.

The Jawbone earpiece (referred to as the "Jawbone), introduced in December 2006 by AliphCom of San Francisco, Calif., was the first known commercial product to use a pair of physical directional microphones (instead of omnidirectional microphones) to reduce environmental acoustic noise. The technology supporting the Jawbone is currently described under one or more of U.S. Pat. No. 7,246,058 by Burnett and/or U.S. patent application Ser. Nos. 10/400,282, 10/667,207, and/or 10/769,302. Generally, multi-microphone techniques make use of an acoustic-based Voice Activity Detector (VAD) to determine the background noise characteristics, where "voice" is generally understood to include human voiced speech, unvoiced speech, or a combination of voiced and unvoiced speech. The Jawbone improved on this by using a microphone-based sensor to construct a VAD signal using directly detected speech vibrations in the user's cheek. This allowed the Jawbone to aggressively remove noise when the user was not producing speech. A Jawbone implementation, for example, also uses a pair of omnidirectional microphones to construct two virtual microphones that are used to remove noise from speech. This construction requires that the omnidirectional microphones be calibrated, that is, that they both respond as similarly as possible when exposed to the same acoustic field. In addition, in order to function better in windy environments, the omnidirectional microphones incorporate a mechanical highpass filter, with a 3-dB frequency that varies between about 100 and about 400 Hz.

INCORPORATION BY REFERENCE

Each patent, patent application, and/or publication mentioned in this specification is herein incorporated by reference in its entirety to the same extent as if each individual patent, patent application, and/or publication was specifically and individually indicated to be incorporated by reference.

BRIEF DESCRIPTION OF THE DRAWINGS

FIG. 16 is a table that shows the locations and size of the maximum phase difference, under an embodiment. Estimated values are calculated as described herein given the peak magnitude and location of the calibration filter.

FIG. 17 is a table that shows the boost needed to regain original $O_1$ sensitivity for the three responses shown in FIGS. 6-8, under an embodiment. The amount of boost needed is highly dependent on the original 3-dB frequencies.

FIG. 18 is a table that shows magnitude responses of several simple RC filters and their combination at 125 and 375 Hz, under an embodiment.

FIG. 19 is a table that shows a simplified version of the table of FIG. 18 with Δf and needed boost for each frequency band, under an embodiment.

FIG. 22 is a table that shows approximate denoising, devoicing, and SNR increase in dB using headset 931B-v5 as the standard, under an embodiment. Pathfinder-only denoising and devoicing changes were used to compile the table. SNR differences of up to 11 dB were compensated to within 0 to −3 dB of the standard headset. Denoising differences between calibration versions were up to 21 dB before and 2 dB after. Devoicing differences were up to 12 dB before and 2 dB after.

FIG. 28 is a table that shows initial and final maximum phases for initial maximum near the upper limit, under an embodiment. For headsets with initial maximum phases above 5 degrees, there was always a reduction in maximum phase. Between 3-5 degrees, there was some reduction in phase and some small increases. Below 3 degrees there was little change or a small increase. Thus 3 degrees is a good upper limit in determining whether or not to compensate for phase differences.

DETAILED DESCRIPTION

Figure 1:
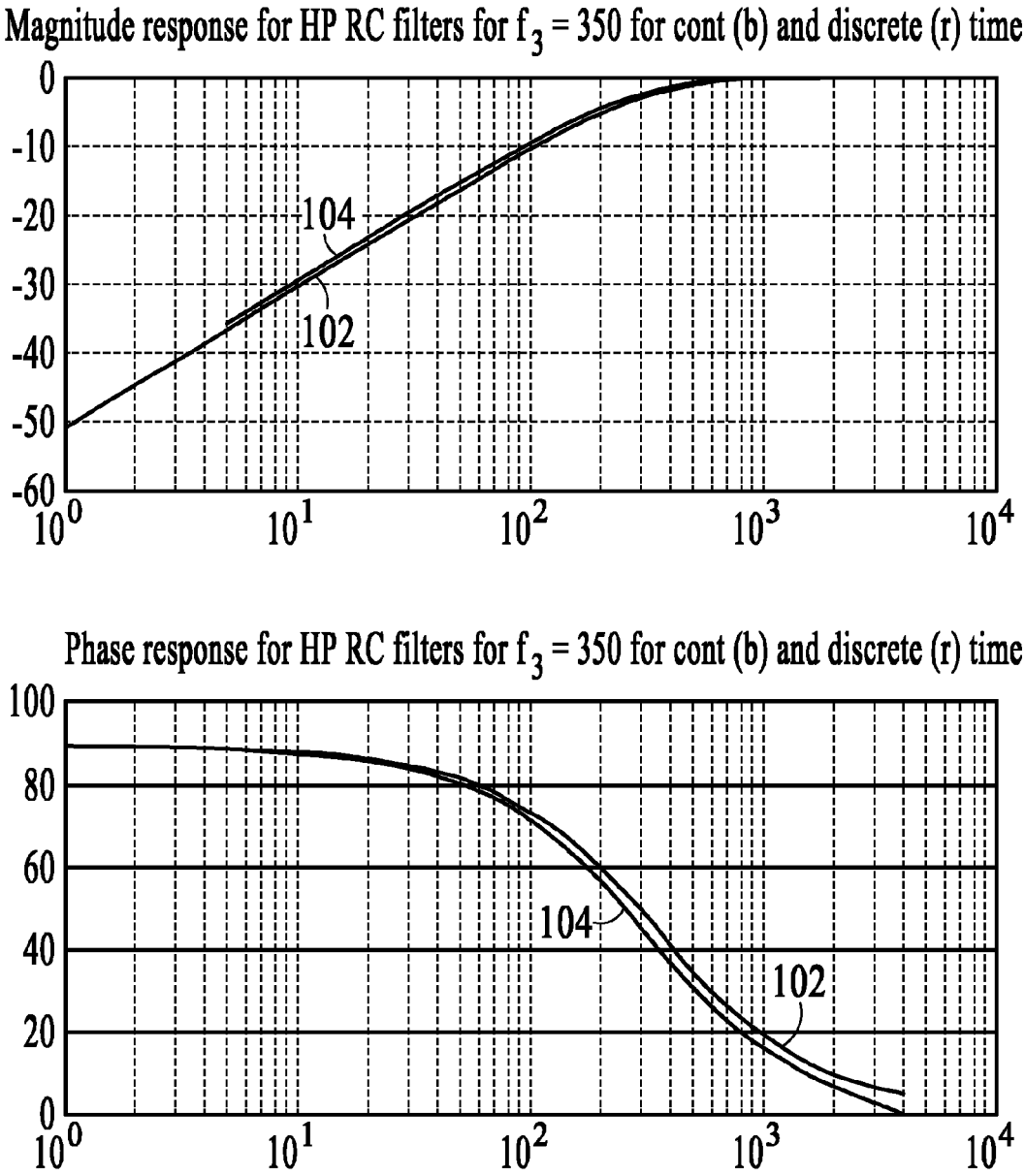
FIG. 1 shows a continuous-time RC filter response and discrete-time model for a worst-case 3-dB frequency of 350 Hz, under an embodiment.

This application describes systems and methods through which microphones comprising a mechanical filter can be accurately calibrated to each other in both amplitude and phase. Unless otherwise specified, the following terms have the corresponding meanings in addition to any meaning or understanding they may convey to one skilled in the art.

The term "bleedthrough" means the undesired presence of noise during speech.

The term "denoising" means removing unwanted noise from the signal of interest, and also refers to the amount of reduction of noise energy in a signal in decibels (dB).

The term "devoicing" means removing and/or distorting the desired speech from the signal of interest.

The term DOMA refers to the Aliph Dual Omnidirectional Microphone Array, used in an embodiment of the invention. The technique described herein is not limited to use with DOMA; any array technique that will benefit from more accurate microphone calibrations can be used.

The term "omnidirectional microphone" means a physical microphone that is equally responsive to acoustic waves originating from any direction.

The term "O1" or "$O_1$" refers to the first omnidirectional microphone of the array, normally closer to the user than the second omnidirectional microphone. It may also, according to context, refer to the time-sampled output of the first omnidirectional microphone or the frequency response of the first omnidirectional microphone.

The term "O2" or "$O_2$" refers to the second omnidirectional microphone of the array, normally farther from the user than the first omnidirectional microphone. It may also, according to context, refer to the time-sampled output of the second omnidirectional microphone or the frequency response of the second omnidirectional microphone.

The term "$O_{1hat}$" or "$\hat{O}_1(z)$" refers to the RC filter model of the response of $O_1$.

The term "$O_{2hat}$" or "$\hat{O}_2(z)$" refers to the RC filter model of the response of $O_2$.

The term "noise" means unwanted environmental acoustic noise.

The term "null" means a zero or minima in the spatial response of a physical or virtual directional microphone.

The term "speech" means desired speech of the user. The term "Skin Surface Microphone (SSM)" is a microphone used in an earpiece (e.g., the Jawbone earpiece available from Aliph of San Francisco, Calif.) to detect speech vibrations on the user's skin.

The term "$V_1$" means the virtual directional "speech" microphone of DOMA.

The term "$V_2$" means the virtual directional "noise" microphone of DOMA, which has a null for the user's speech.

The term "Voice Activity Detection (VAD) signal" means a signal indicating when user speech is detected.

The term "virtual microphones (VM)" or "virtual directional microphones" means a microphone constructed using two or more omnidirectional microphones and associated signal processing.

Compensating for Non-Uniform 3-dB Frequencies in Highpass (HP) Microphone Mechanical Filters Calibration methods for two omnidirectional microphones with mechanical highpass filters are described below. More than two microphones may be calibrated using this technique by selecting one omnidirectional microphone to use as a standard and calibrating all other microphones to the chosen standard microphone. Any application that requires accurately calibrated omnidirectional microphones with mechanical highpass filters can benefit from this technique. The embodiment below uses the DOMA microphone array, but the technique is not so limited. Compared to conventional arrays and algorithms, which seek to reduce noise by nulling out noise sources, the array of an embodiment is used to form two distinct virtual directional microphones which are configured to have very similar noise responses and very dissimilar speech responses. The only null formed by the DOMA is one used to remove the speech of the user from $V_2$. When calibrated properly, the omnidirectional microphones can be combined to form two or more virtual microphones which may then be paired with an adaptive filter algorithm and/or VAD algorithm to significantly reduce the noise without distorting the speech, significantly improving the SNR of the desired speech over conventional noise suppression systems. The embodiments described herein are stable in operation, flexible with respect to virtual microphone pattern choice, and have proven to be robust with respect to speech source-to-array distance and orientation as well as temperature and calibration techniques, as shown herein.

In the following description, numerous specific details are introduced to provide a thorough understanding of, and enabling description for, embodiments of the calibration methods. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

The noise suppression system (DOMA) of an embodiment uses two combinations of the output of two omnidirectional microphones to form two virtual microphones. In order to construct these virtual microphones, the omnidirectional microphones have to be accurately calibrated in both amplitude and phase so that they respond in both amplitude and phase as similarly as possible to the same acoustic input. Many omnidirectional microphones use mechanical highpass (HP) filters (usually implemented using one or more holes in the diaphragm of the microphone) to reduce wind noise response. These mechanical filters commonly have responses similar to electronic RC filters, but small differences in the hole size and shape can lead to 3-dB frequencies that range from below 100 Hz more than 400 Hz. This difference can cause the relative phase response between the microphones at low frequencies to vary from −15 to +15 degrees or more. This is especially damaging at low frequencies because the DOMA gamma filter phase response is commonly less than 20-30 degrees below 500 Hz. As a result, denoising using DOMA below 500 Hz can vary by more than 20 dB. A new, DSP-based calibration compensation method is presented herein where the white noise response of $O_1$ and $O_2$ is used to build a model of the system and then each microphone is filtered with the other's model. The resulting response is then normalized to a "standard response"—in this case, a highpass RC filter with a 3-dB frequency of 200 Hz.

RC Filter Model

An RC filter has the real-time response $$V_{out}(t) = RC\left(\frac{dV_{in}}{dt} - \frac{dV_{out}}{dt}\right)$$

The simplest approximation to a derivative in discrete time is $$\frac{dV_{in}}{dt} \approx \frac{x[n] - x[n-1]}{\Delta t}$$

where Δt is the time between samples. This is only accurate at low frequencies where the slope between sample points is linear. Using this approximation results in $$y[n] \approx RC\left(\frac{x[n] - x[n-1]}{\Delta t} - \frac{y[n] - y[n-1]}{\Delta t}\right)$$

or in z-space $$Y(z) \approx \frac{RC}{\Delta t}(X(z)(1 - z^{-1}) - Y(z)(1 - z^{-1})) \quad \text{[Eq. 1]}$$

$$Y(z)\left(1 + \frac{RC}{\Delta t} - \frac{RC}{\Delta t}z^{-1}\right) \approx \frac{RC}{\Delta t}(X(z)(1 - z^{-1}))$$

$$\hat{O}_N(z) = \frac{Y(z)}{X(z)} \approx \frac{1 - z^{-1}}{A_N - z^{-1}}$$

where $$A_N = 1 + \frac{\Delta t}{(RC)_N} = 1 + \frac{2\pi f_N}{f_S}$$

since $$\Delta t = \frac{1}{f_S}$$

and $$2\pi f_N = \frac{1}{(RC)_N}$$

and $f_N$ is the 3-dB frequency for the Nth microphone and $f_s$ is the sampling frequency. This is now adjusted so that the magnitude matches better at low frequencies:

$$\hat{O}_N(z) = \frac{Y(z)}{X(z)} \approx \frac{\sqrt{A_N}\,(1 - z^{-1})}{A_N - z^{-1}} = \frac{\frac{1}{\sqrt{A_N}}(1 - z^{-1})}{1 - \frac{1}{A_N}z^{-1}} \quad \text{[Eq. 2]}$$

This matches to within +−0.2 dB and −1 degree for a 3-dB frequency of 100 Hz, and is within +−1.0 dB and −3 degrees at 350 Hz. The amplitude and phase response for a continuous time RC filter 102 with the expected-worst-case 3-dB frequency of 350 Hz in FIG. 1; compare this to the discrete-time responses 104. The differences are insignificant at the frequencies of interest (100-500 Hz).

Determining the 3-dB Frequency of the Microphone Given Alpha

Given the viable model of an RC filter above, now we determine the 3-dB frequency of the microphones in order to build the model of each microphone's response. This is usually done with a sine sweep, but rapid production demands may not allow enough time for a sine sweep to be used during the calibration procedure. Oftentimes there is a need to determine the 3-dB frequency of each microphone using a short (i.e. less than 10 seconds) procedure. One way that has proven fast, accurate, and reliable is to use short white noise bursts.

It can be difficult to accurately determine the 3-dB frequency of the microphone with white noise because the power spectrum is only flat on average, and normally a long (15+ seconds) burst is needed to ensure acceptable spectral flatness. Alternatively, if the white noise spectrum is known, the 3-dB frequency can be deduced by subtracting the recorded spectrum from the stored one. However, that assumes that the speaker and air transfer functions are unity, which is doubtful for low frequencies. It is possible to measure the speaker and air transfer functions for each box using a reference microphone, but if there is variance between calibration boxes then this could not be used as a general algorithm.

Figure 14:
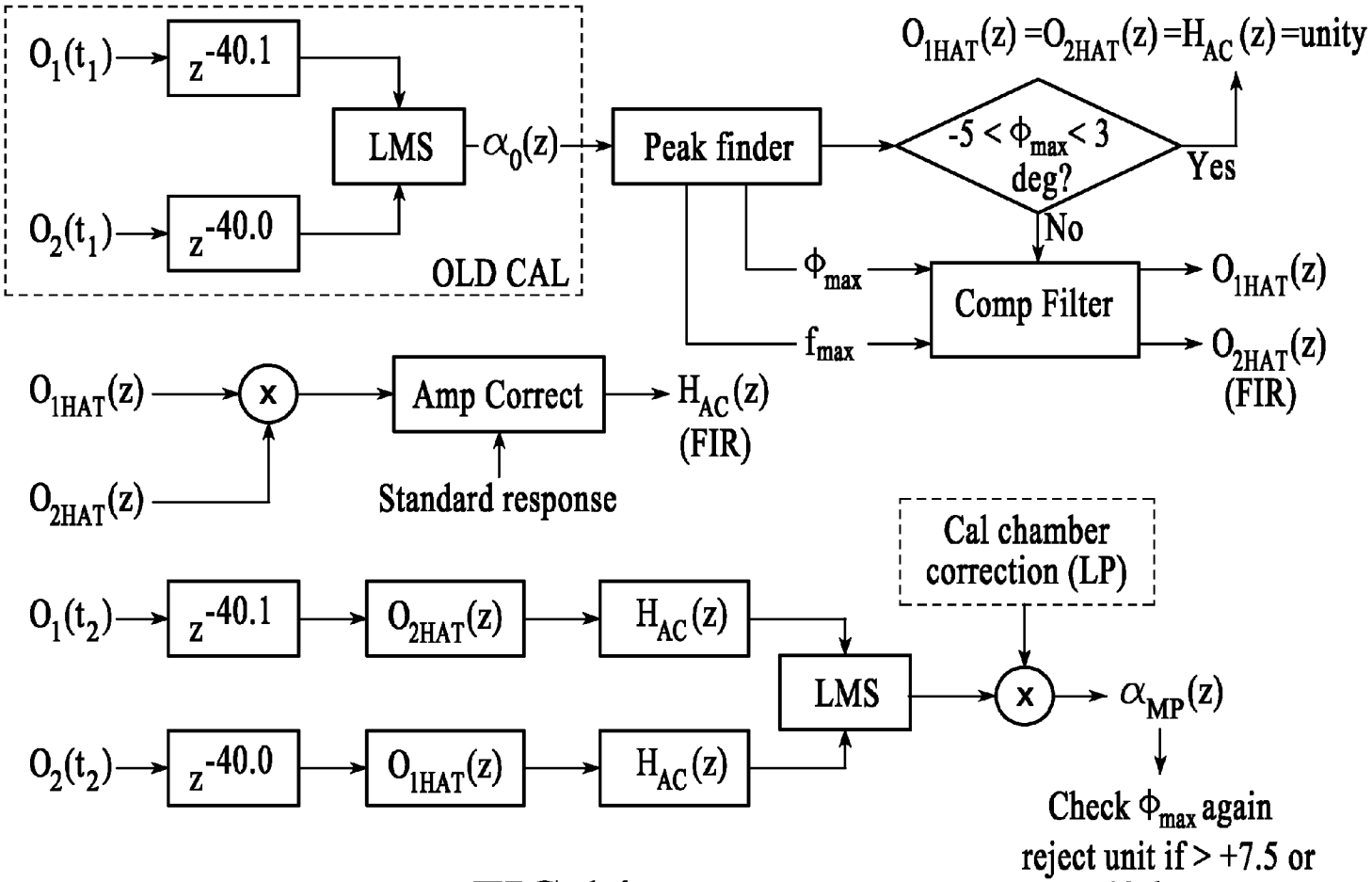
FIG. 14 is a flow diagram of the calibration algorithm, under an embodiment. The top flow is executed on the first three-second excitation and produces the model for each microphone HP filter. The middle flow calculates the LP filter needed to correct the amplitude response of the combination of $O_{1HAT}$ and $O_{2HAT}$. The final flow calculates the alpha filter.

A different option is to use the relative phase of the initial calibration filter $\alpha_0(z)$ to approximate the 3-dB frequencies of the microphones. The initial calibration filter of an embodiment is determined using the unfiltered $O_1$ and $O_2$ responses and an adaptive filter, as shown in FIG. 14, but is not so limited. The initial calibration filter relates one microphone (in this case, $O_2$, but it can be any number of microphones) back to the reference microphone (in this case, $O_1$). In essence, if the output of $O_2$ is filtered using the initial calibration filter, the response should be the same as $O_1$ if the calibration process and filter are accurate. The assumption is made that the peak in the calibration filter phase response below 500 Hz is due to the different 3-dB frequencies and roll-offs of the mechanical HP filters in the microphones. If this is true, and if the mechanical filter can be modeled with an RC filter model (or, for other mechanical filters, another mathematical model), then the peak value and location can be found mathematically and used to predict the locations of the individual microphone 3-dB frequencies. This has the advantage of not requiring a change to the calibration process but is not as accurate as other methods. A reduction in phase mismatch to less than +−5 degrees, though, will be accurate enough for most applications.

For our embodiment, where the mechanical filter can be modeled using an RC filter, we begin with the theoretical phase response of an RC filter:

$$\phi_N(f) = \arctan\left(\frac{f_N}{f}\right)$$

where N is the microphone of interest, $f_N$ is the 3-dB frequency for that microphone, and f is the frequency in Hz. To determine the phase response needed to transform $O_2$ into $O_1$, the difference in phase response between $O_1$ and $O_2$ is calculated:

$$\text{angle}(\alpha(f)) = \phi(f) = \phi_1(f) - \phi_2(f) = \arctan\left(\frac{f_1}{f}\right) - \arctan\left(\frac{f_2}{f}\right)$$

or, since $$-\arctan(x) = \arctan(-x) \qquad \text{[Eq. 3]}$$

$$\phi(f) = \arctan\left(\frac{f_1}{f}\right) + \arctan\left(-\frac{f_2}{f}\right)$$

The arctan addition theorem is then used:

$$\arctan(\alpha) + \arctan(b) = \arctan\left(\frac{a+b}{1-ab}\right) \ (ab < 1)$$

to get $$\phi(f) = \arctan\left(\frac{\frac{f_1}{f} - \frac{f_2}{f}}{1 + \frac{f_1 f_2}{f_2}}\right) \ (f_1 < f, \quad f_2 < f) \qquad \text{[Eq. 4]}$$

$$\phi(f) = \arctan\left(\frac{f(f_1 - f_2)}{f^2 + f_1 f_2}\right) \ (f_1 < f, \quad f_2 < f)$$

but only if $f_1 < f$ and $f_2 < f$. This is no great restriction, though, because the following relationships can be used $$\arctan\left(\frac{1}{x}\right) = \frac{\pi}{2} - \arctan(x) \ (x > 0)$$

$$\arctan\left(\frac{1}{x}\right) = -\frac{\pi}{2} - \arctan(x) \ (x < 0)$$

to rewrite Equation 3 as $$\phi(f) = \frac{\pi}{2} - \arctan\left(\frac{f}{f_1}\right) - \frac{\pi}{2} - \arctan\left(-\frac{f}{f_2}\right)$$

$$\phi(f) = \arctan\left(\frac{f}{f_2}\right) + \arctan\left(-\frac{f}{f_1}\right) \text{ or}$$

$$\phi(f) = \arctan\left(\frac{\frac{f}{f_2} - \frac{f}{f_1}}{1 + \frac{f^2}{f_1 f_2}}\right) \ (f_1 > f, \quad f_2 > f)$$

$$\phi(f) = \arctan\left(\frac{f(f_1 - f_2)}{f_1 f_2 + f^2}\right) \ (f_1 > f, \quad f_2 > f)$$

which is the same result as Equation 4, so all frequencies are covered.

To find the peak of the difference in phase, take the derivative of $\phi(f)$, set it to zero, and solve for f. Using $$\frac{d(\arctan(u))}{dx} = \frac{1}{1+u^2}\frac{du}{dx}$$

results in $$\frac{d(\text{angle}(\alpha(f)))}{df} = \frac{1}{1 + \left(\frac{f(f_1 - f_2)}{f_1 f_2 + f^2}\right)^2} \frac{d\left(\frac{f(f_1 - f_2)}{f_1 f_2 + f^2}\right)}{df}$$

Since $$d\left(\frac{u}{v}\right) = \frac{vdu - udv}{v^2}$$

then $$\frac{d(\text{angle}(\alpha(f)))}{df} = \frac{(f_1 f_2 + f^2)^2}{(f_1 f_2 + f^2)^2 + f^2(f_1 - f_2)^2} \frac{(f_1 f_2 + f^2)(f_1 - f_2) - f(f_1 - f_2)2f}{(f_1 f_2 + f^2)^2}$$

$$\frac{d(\text{angle}(\alpha(f)))}{df} = \frac{(f_1 - f_2)[f_1 f_2 - f^2]}{(f_1 f_2 + f^2)^2 + f^2(f_1 - f_2)^2} = 0$$

This will only equal zero if $f_1=f_2$ (trivial case) or if $$f_{max}^2=f_1f_2$$

so $$f_{max}=\sqrt{f_1f_2} \quad \text{[Eq. 5]}$$

Plugging this into Equation 4, it is seen that $$\phi_{max} = \arctan\left(\frac{f_{max}(f_1 - f_2)}{f_1 f_2 + f_{max}^2}\right) \quad \text{[Eq. 6]}$$

So now, given $f_{max}$ and $\phi_{max}$, $f_1$ and $f_2$ can be derived from Equations 5 and 6:

$$f_1 = \frac{f_{max}^2}{f_2} \text{ and} \quad \text{[Eq. 7]}$$

$$\tan(\phi_{max}) = \frac{f_{max}\left(\frac{f_{max}^2}{f_2} - f_2\right)}{\frac{f_{max}^2}{f_2} f_2 + f_{max}^2} = \frac{(f_{max}^2 - f_2^2)}{2f_{max}f_2}$$

$$f_2^2 + 2f_{max}f_2\tan(\phi_{max}) - f_{max}^2 = 0$$

Using the quadratic equation with $$a=1$$

$$b=2f_{max}\tan(\phi_{max})$$

$$c=-f_{max}^2$$

results in $$f_2 = \frac{-2f_{max}\tan(\phi_{max}) \pm \sqrt{4f_{max}^2\tan^2(\phi_{max}) + 4f_{max}^2}}{2}$$

$$f_2 = -f_{max}\tan(\phi_{max}) \pm \sqrt{f_{max}^2(1 + \tan^2(\phi_{max}))}$$

$$f_2 = f_{max}[-\tan(\phi_{max}) \pm \sqrt{(1 + \tan^2(\phi_{max}))}\,]$$

Since $\phi_{max}$ is close to zero, $f_2$ will always be positive, and the quantity under the radical will always be greater than unity, only use the + half:

$$f_2=f_{max}[-\tan(\phi_{max})+\sqrt{(1+\tan^2(\phi_{max}))}] \quad \text{[Eq. 8]}$$

Equations 7 and 8 allow the calculation of $f_1$ and $f_2$ given $f_{max}$ and $\phi_{max}$. Experimental testing has shown that these estimates are usually quite accurate, commonly within +−5 Hz. Then $f_1$ and $f_2$ can be used to calculate $A_1$ and $A_2$ in Equation 1 and thus the filter models in Equation 2.

Headsets Used for Testing

Figure 2:
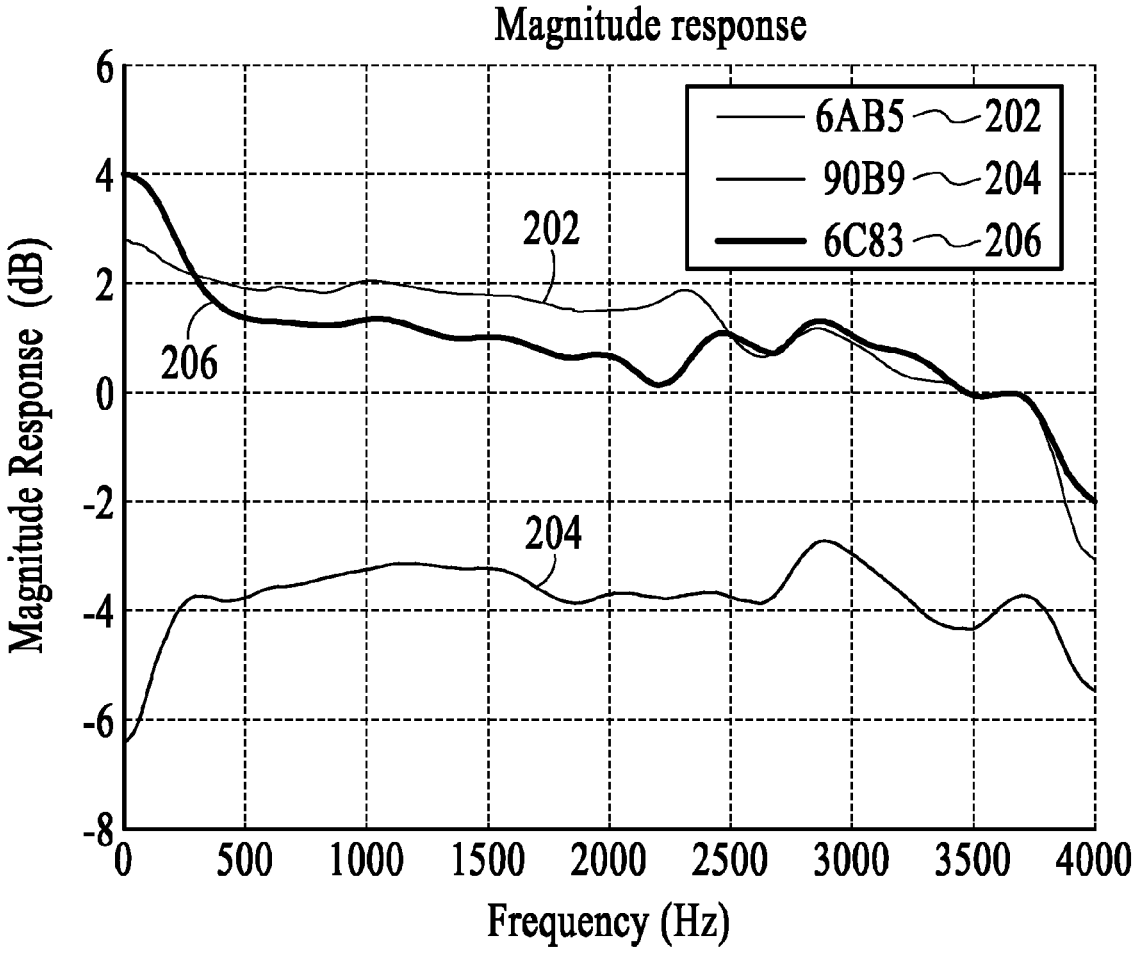
FIG. 2 shows a magnitude response of the calibration filter alpha for three headsets used to test this technique, under an embodiment.
Figure 3:
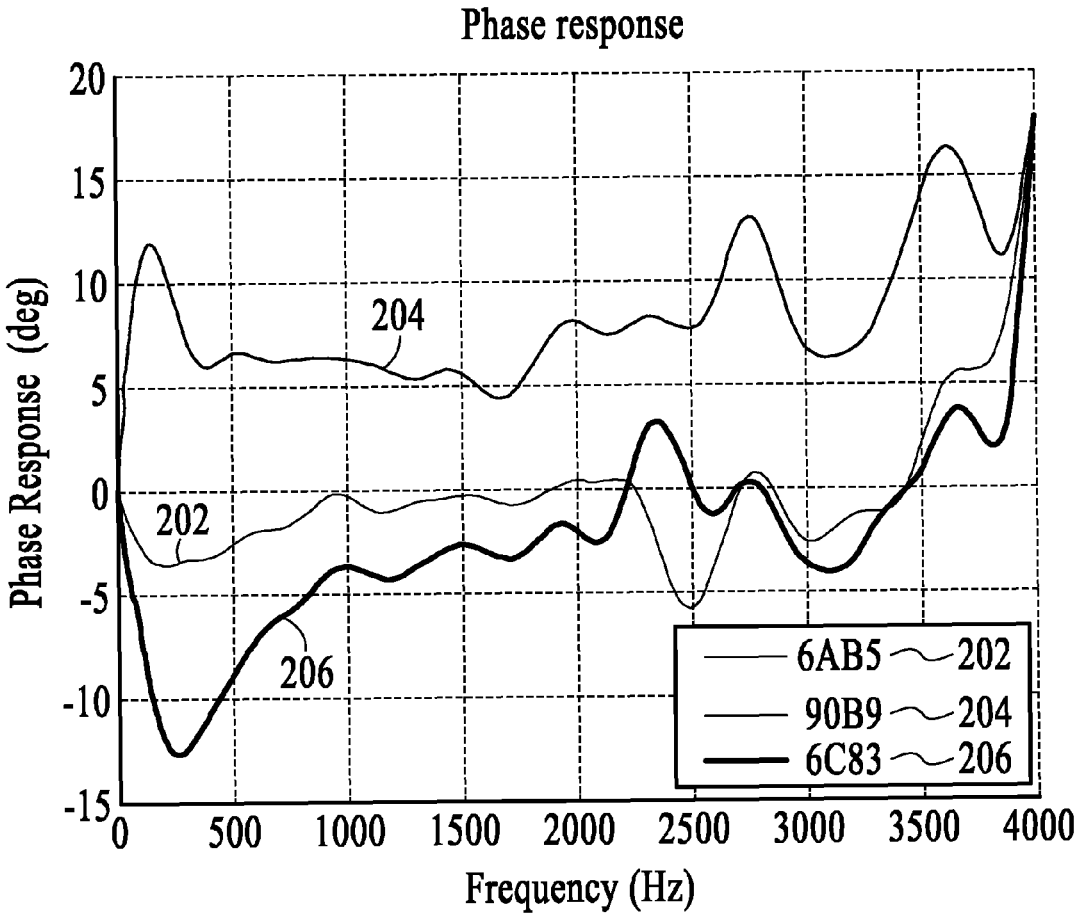
FIG. 3 shows a phase response of the calibration filter alpha for three headsets used to test this technique, under an embodiment. The peak locations and magnitudes are shown in FIG. 16.

Three Aliph Jawbone headsets each including dual microphone arrays were used with different phase responses in the initial test of this procedure: 90B9 (+12 degrees), 6AB5 (near zero phase difference), and 6C83 (−12.5 degrees). Their magnitude and phase responses for their calibration filters are shown in FIGS. 2 and 3. The correlation between magnitude change and phase change near DC was the first clue that this was HP filter related.

Estimating the 3-dB Frequencies for the Three Headsets

To test the procedure above, look at the phase responses for headsets 6AB5, 90B9, and 6C83 in FIG. 2. The precise location and magnitude of the peaks and the resulting estimated 3-dB frequencies are listed in FIG. 16, which shows locations and size of the maximum phase difference. Estimated values are calculated as above given the peak magnitude and location of the calibration filter. Using this information, the model magnitude and phase responses are shown along with the measured ones in FIGS. 4 and 5. The magnitude responses have been offset by a constant gain to make comparisons easier.

Figure 4:
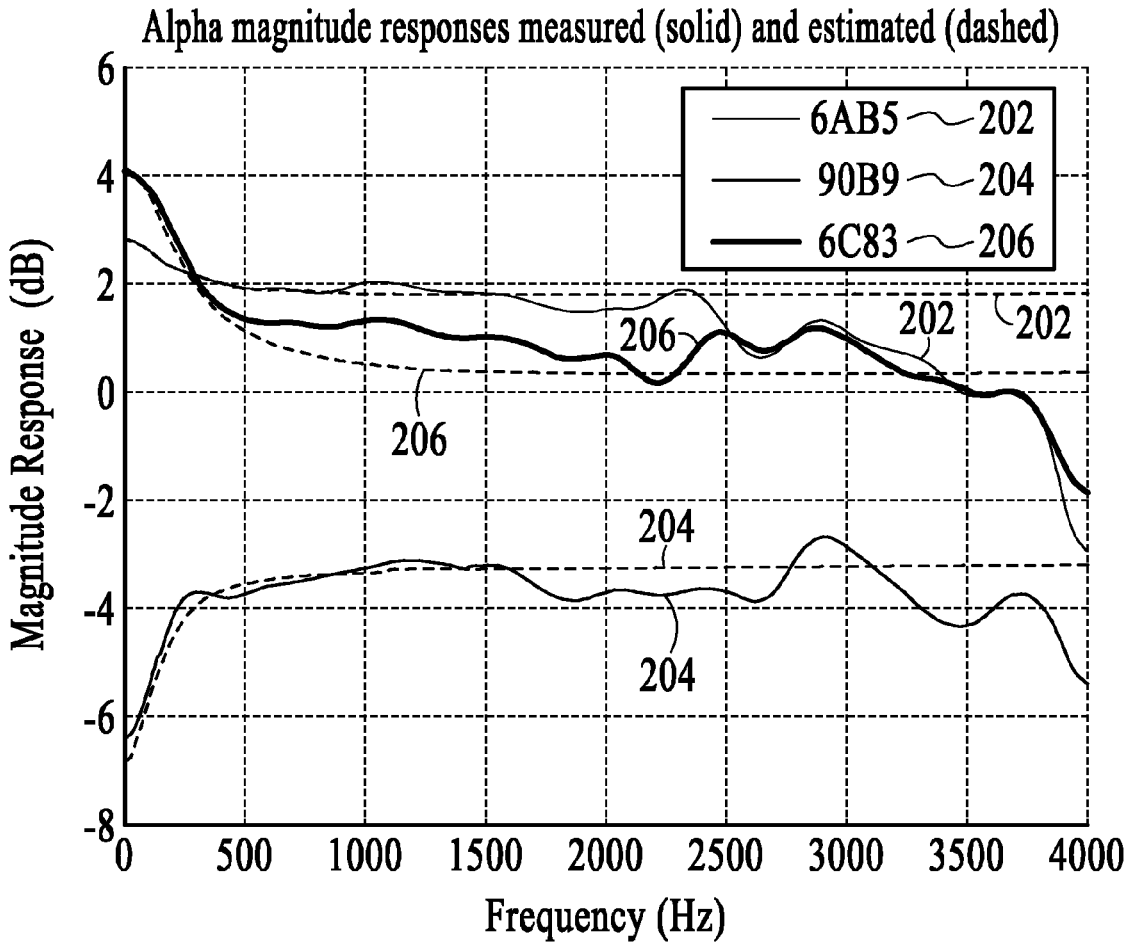
FIG. 4 shows the magnitude response of the calibration filters from FIG. 2 (solid) with the RC filter difference model results (dashed), under an embodiment. The RC filter responses have been offset with constant gains (+1.75, +0.25, and −3.25 dB for 6AB5, 6C93, and 90B9 respectively) and match very well with the observed responses.

FIG. 4 shows the magnitude response of the calibration filters from FIG. 2 (solid) with the RC filter difference model results (dashed). The RC filter responses have been offset with constant gains (+1.75, +0.25, and −3.25 dB for headsets 6AB5, 6C93, and 90B9 respectively) and match very well with the observed responses. In FIG. 4, the RC model fits the observed magnitude differences very well (within +−0.2 dB) with constant offsets. Headset 6C83 had an offset of only 0.25 dB, indicating that with the exception of the 3-dB point, the microphones match very well in magnitude response. Unfortunately, their 3-dB frequencies are sufficiently different that they differ in magnitude by 4 dB at DC and −12.5 degrees at 250 Hz. For this headset, virtually all the mismatch is due to the difference in 3-dB frequency.

Figure 5:
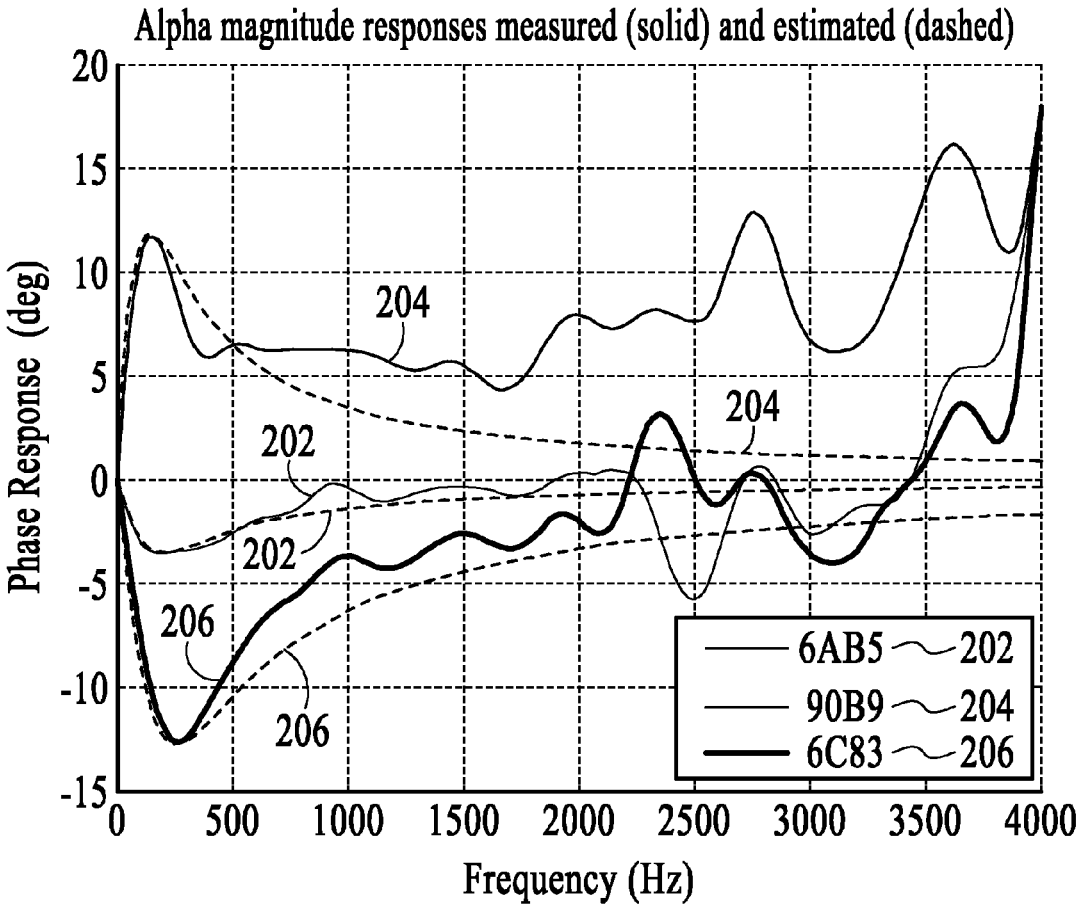
FIG. 5 shows the phase response of the calibration filters from FIG. 3 (solid) with the RC filter difference model results (dashed), under an embodiment. The RC filter phase responses are very similar, within a few degrees below 1000 Hz. Note how headset 6C83, which had very little magnitude response difference above 1 kHz, has a very large phase difference. Headsets 6AB5 and 90B9 has phase responses that trend toward zero degrees, as expected, but 90B9 does not, for unknown reasons.

FIG. 5 shows the phase response of the calibration filters from FIG. 3 (solid) with the RC filter difference model results (dashed). The RC filter phase responses are very similar, within a few degrees below 1000 Hz. Note how headset 6C83, which had very little magnitude response difference above 1 kHz, has a very large phase difference. Headsets 6AB5 and 90B9 has phase responses that trend toward zero degrees, as expected, but 90B9 does not, for unknown reasons. Still, since phase differences below 1000 Hz are paramount, this compensation method should significantly decrease the phase difference between the microphones. In FIG. 5, the modeled phase outputs are very good matches at the peak (which just means the model is consistent) and within +−2 degrees below 500 Hz. This should be sufficient to bring the relative phase to within +−5 degrees.

Calibration Method of an Embodiment

This calibration method of an embodiment, referred to herein as the version 5 or v5 calibration method comprises:

1. Calculating the calibration filter $\alpha_0(z)$ using $0_1(z)$ and $0_2(z)$.
2. Determining $f_{max}$ and $\phi_{max}$ of $\alpha_0(z)$ below 500 Hz.
3. Using $f_{max}$ and $\phi_{max}$ to estimate $f_1$ and $f_2$ using Equations 6 and 7.
4. Using $f_1$ and $f_2$ to calculate A1 and A2 using Equation 1.
5. Using A1 and A2 to calculate RC models $\hat{0}_1(z)$ and $\hat{0}_2(z)$ using Equation 2.
6. Calculating the final alpha filter $\alpha_{MP}(z)$ using $0_1(z)\hat{0}_2(z)$ and $0_2(z)\hat{0}_1(z)$.

The minimum-phase filter $\alpha_{MP}(z)$ may be transformed to a linear phase filter $\alpha_{LP}(z)$ if desired. The final application-ready calibrated outputs at this stage are thus $$\tilde{0}_1(z)=O_1(z)\hat{0}_2(z)$$

$$\tilde{0}_2(z)=O_2(z)\hat{0}_1(z)\alpha_{MP}(z)$$

Since both $O_1$ and $O_2$ are filtered it makes sense to include a standard gain target $|S(z)|$, where it is assumed that the target is only a magnitude target and not a phase target.

Figure 6:
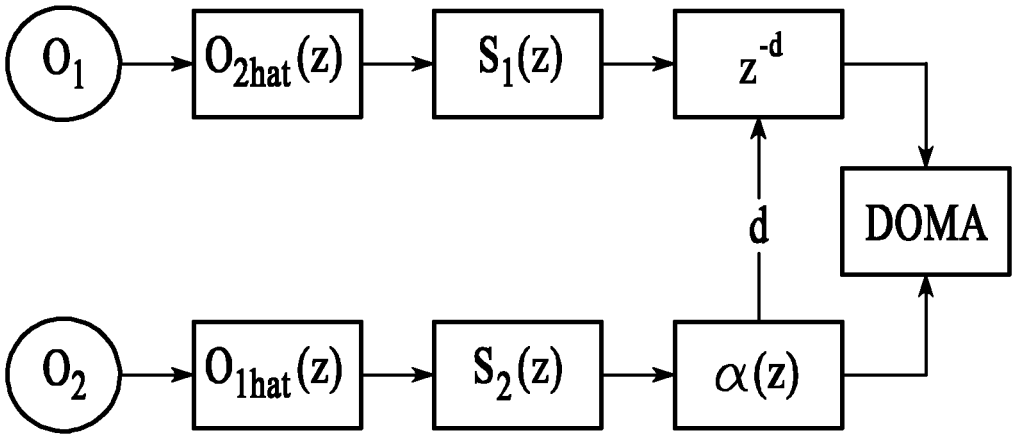
FIG. 6 shows the calibration flow using a standard gain target for each branch, under an embodiment. The delay "d" is the linear phase delay in samples of the alpha filter. The alpha filter can be either linear phase or minimum phase.

FIG. 6 is a flow diagram for calibration using a standard gain target for each branch, under an embodiment. The delay "d" is the linear phase delay in samples of the alpha filter. The alpha filter can be either linear phase or minimum phase. The final filtering flow (pre-DOMA) is shown in FIG. 6, where $$S_N(z) = \frac{|S(z)|}{|\tilde{O}_N(z)|}$$

Since this is essentially a gain calculation, this is relatively simple to implement. Note that the delay "d" in FIG. 6 is the linear phase portion of the alpha filter, and that alpha may be either linear phase or minimum phase, depending on the application When used on a hardware device such as a Bluetooth headset, this will require storage of $\hat{0}_1(z)$ and $\hat{0}_2(z)$ somewhere in nonvolatile memory, as they will be required (along with $\alpha(z)$) to properly calibrate the microphones. For robustness, it is also recommended to store the $S_N(z)$ as well.

The accuracy of this technique relies upon an accurate detection of the location and size of the peak below 500 Hz as well as an accurate model of the HP mechanical filter. The RC model presented here accurately predicts the behavior of the three headsets above below 500 Hz and is probably sufficient. Other mechanical filters may require different models, but the derivation of the formulae needed to calculate the compensating filters is analogous to that shown above. For simplicity and accuracy it is recommended that the mechanical filter be constructed in such a way so that its response can be modeled using the RC model above.

Figure 7:
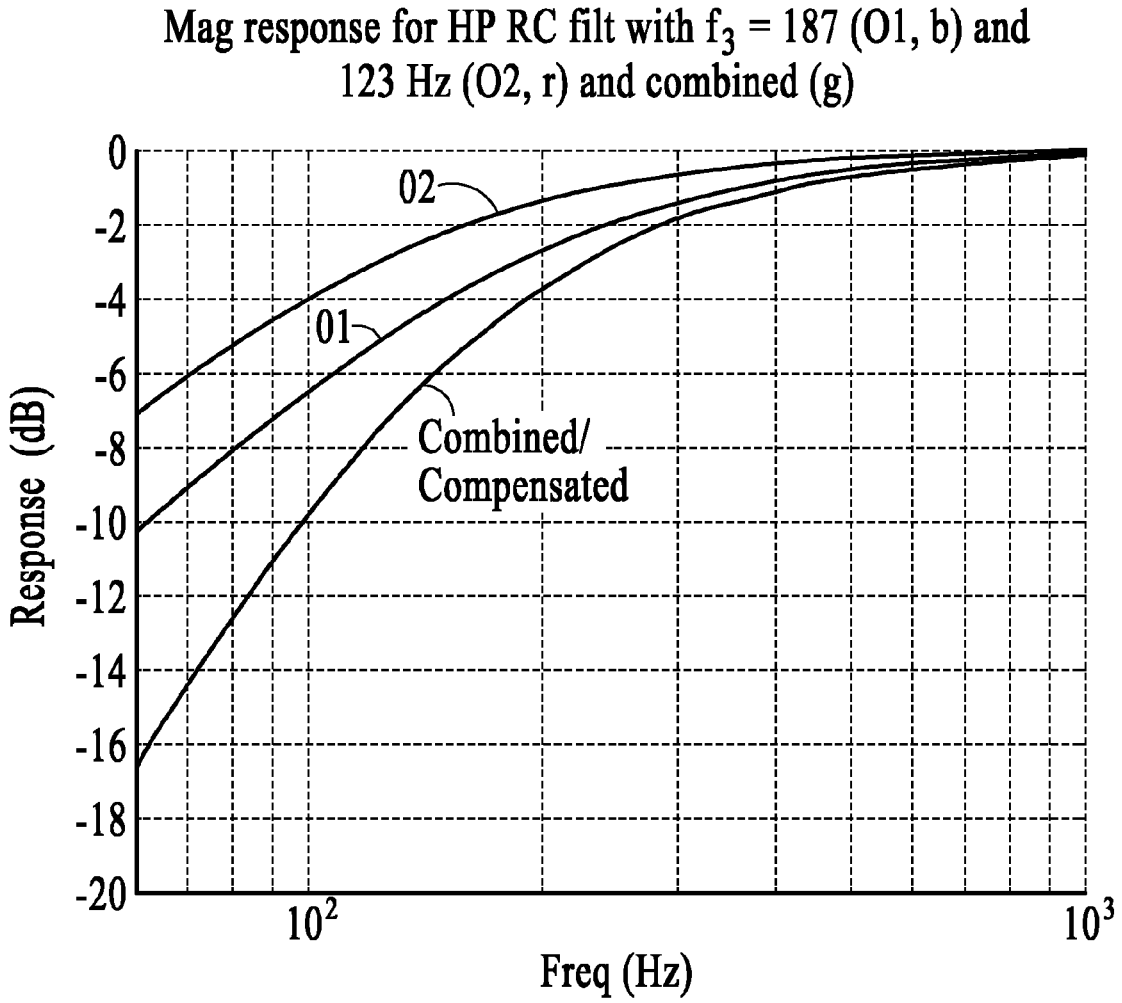
FIG. 7 shows original $O_1$, $O_2$, and compensated modeled responses for headset 90B9, under an embodiment. The loss is 3.3 dB at 100, Hz, 1.1 dB at 200 Hz, and 0.4 dB at 300 Hz.
Figure 8:
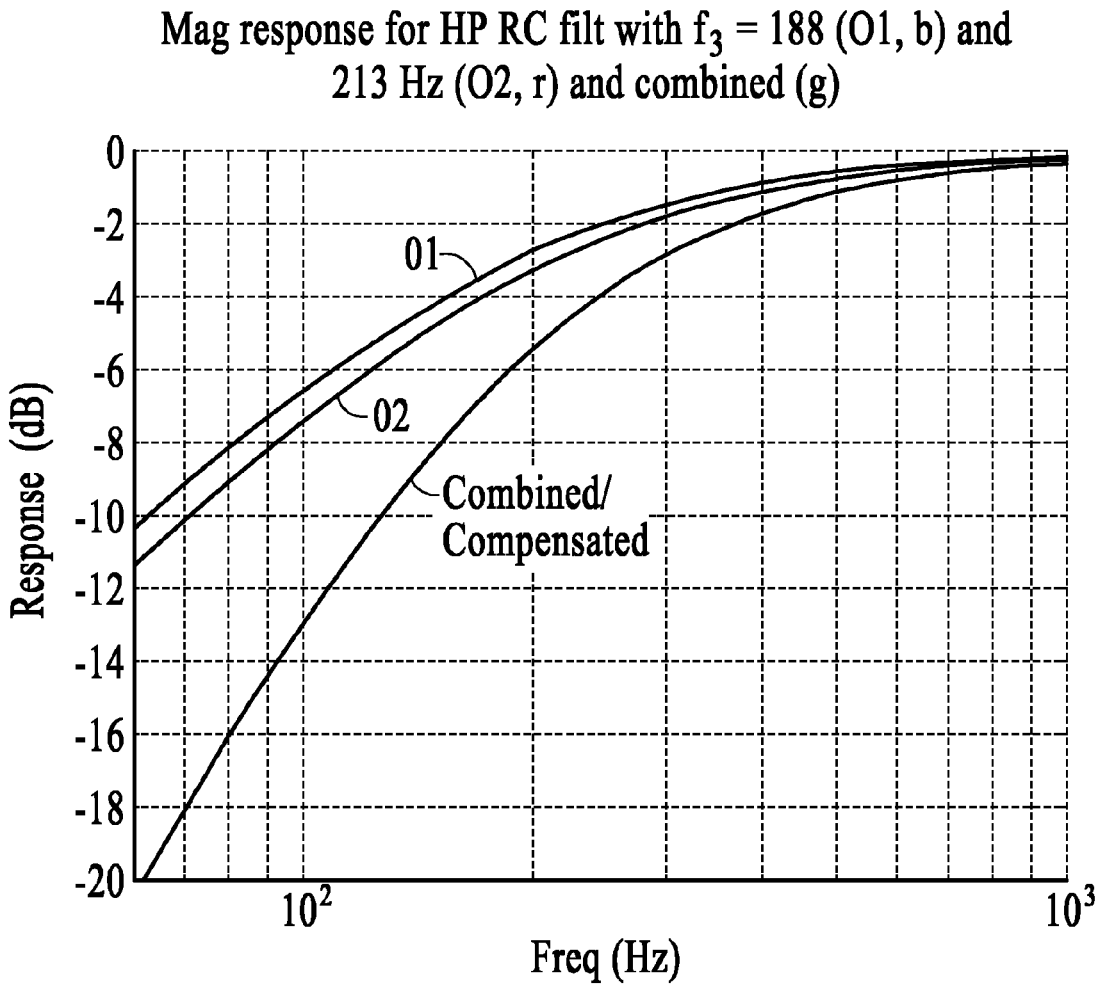
FIG. 8 shows original $O_1$, $O_2$, and compensated modeled responses for headset 6AB5, under an embodiment. The loss is 6.4 dB at 100 Hz, 2.7 dB at 200 Hz, and 1.3 dB at 300 Hz.
Figure 9:
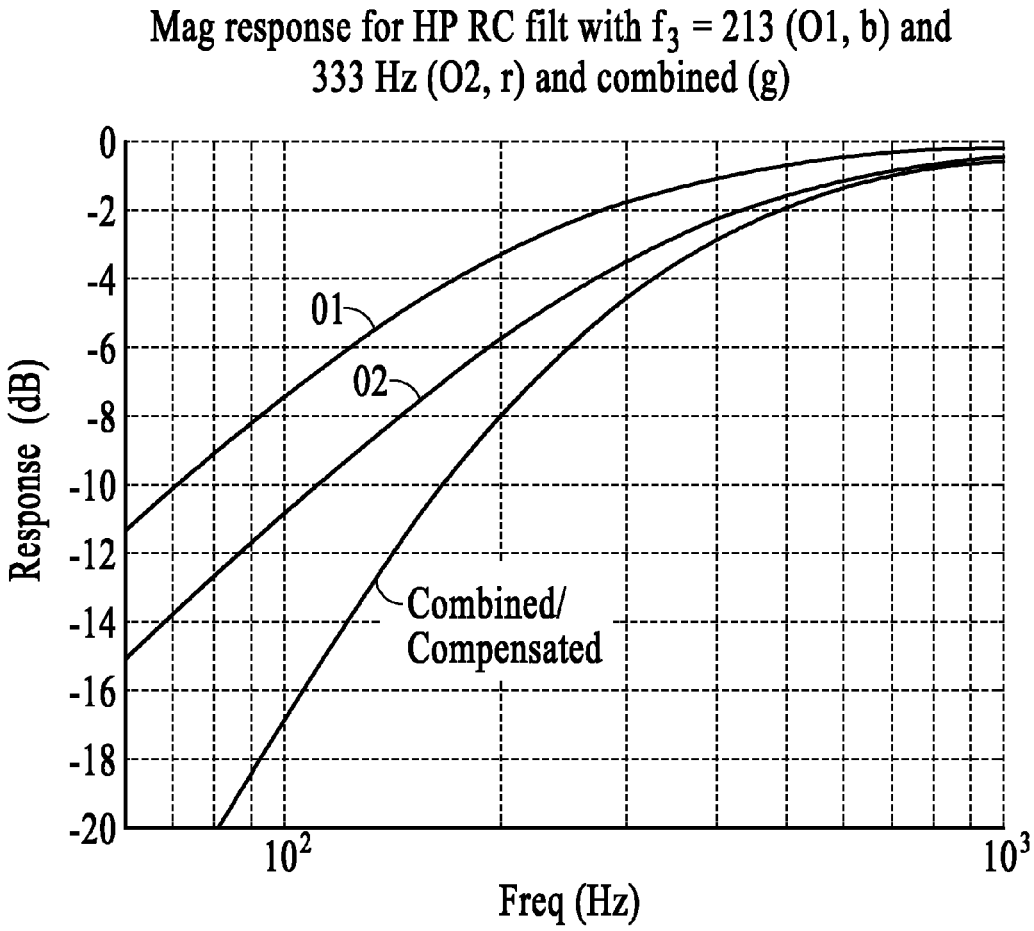
FIG. 9 shows original $O_1$, $O_2$, and compensated modeled responses for headset 6C83, under an embodiment. The loss is 9.4 dB at 100 Hz, 4.7 dB at 200 Hz, and 2.6 dB at 300 Hz.

The reduction in phase difference between the two microphones is not without cost—adding a second software (DSP) HP filter in-line with the mechanical HP filter effectively doubles the strength of the filter. The higher the 3-dB frequency of either microphone, the stronger the resulting suppression of lower frequencies. The effect of compensation on the magnitude response of the system is shown in FIGS. 7, 8, and 9 for headsets 90B9, 6AB5, and 6C83, respectively. The boost required to regain the sensitivity of $O_1$ at 100, 200, and 300 Hz is shown in FIG. 17, which shows boost needed to regain original $O_1$ sensitivity for the three responses shown in FIGS. 7-9. The amount of boost needed is highly dependent on the original 3-dB frequencies.

FIG. 7 shows original $O_1$, $O_2$, and compensated modeled responses for headset 90B9, under an embodiment. The loss is 3.3 dB at 100 Hz, 1.1 dB at 200 Hz, and 0.4 dB at 300 Hz.

FIG. 8 shows original $O_1$, $O_2$, and compensated modeled responses for headset 6AB5, under an embodiment. The loss is 6.4 dB at 100 Hz, 2.7 dB at 200 Hz, and 1.3 dB at 300 Hz.

FIG. 9 shows original $O_1$, $O_2$, and compensated modeled responses for headset 6C83, under an embodiment. The loss is 9.4 dB at 100 Hz, 4.7 dB at 200 Hz, and 2.6 dB at 300 Hz.

Figure 10:
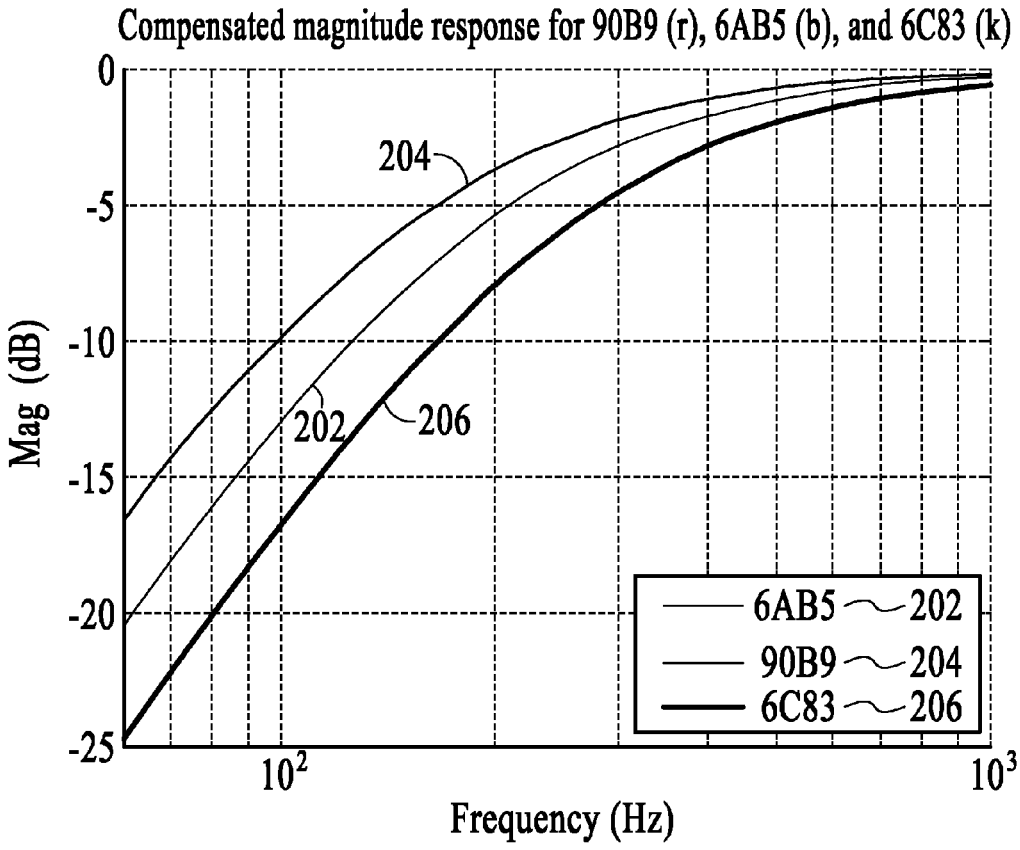
FIG. 10 shows compensated $O_1$ and $O_2$ responses for three different headsets, under an embodiment. There is a 7.0 dB difference between headset 90B9 and 6C83 at 100 Hz.

FIG. 10 shows the compensated $O_1$ and $O_2$ responses for the three different headsets. There is a significant 7.0 dB difference between headset 90B9 (204) and 6C83 (206) at 100 Hz. This variation will depend on the initial $O_1$ and $O_2$ responses as well as the 3-dB frequencies. If calibration is performed not to the $O_1$ response but to a nominal value, this variation can be reduced, but some variation will always be present. In DOMA, though, some amplitude response variation below 500 Hz is preferable to large phase variations below 500 Hz, so even without normalizing the gains for the decreased response below 500 Hz the phase compensation is still worthwhile.

Phase Compensation Test

Figure 11:
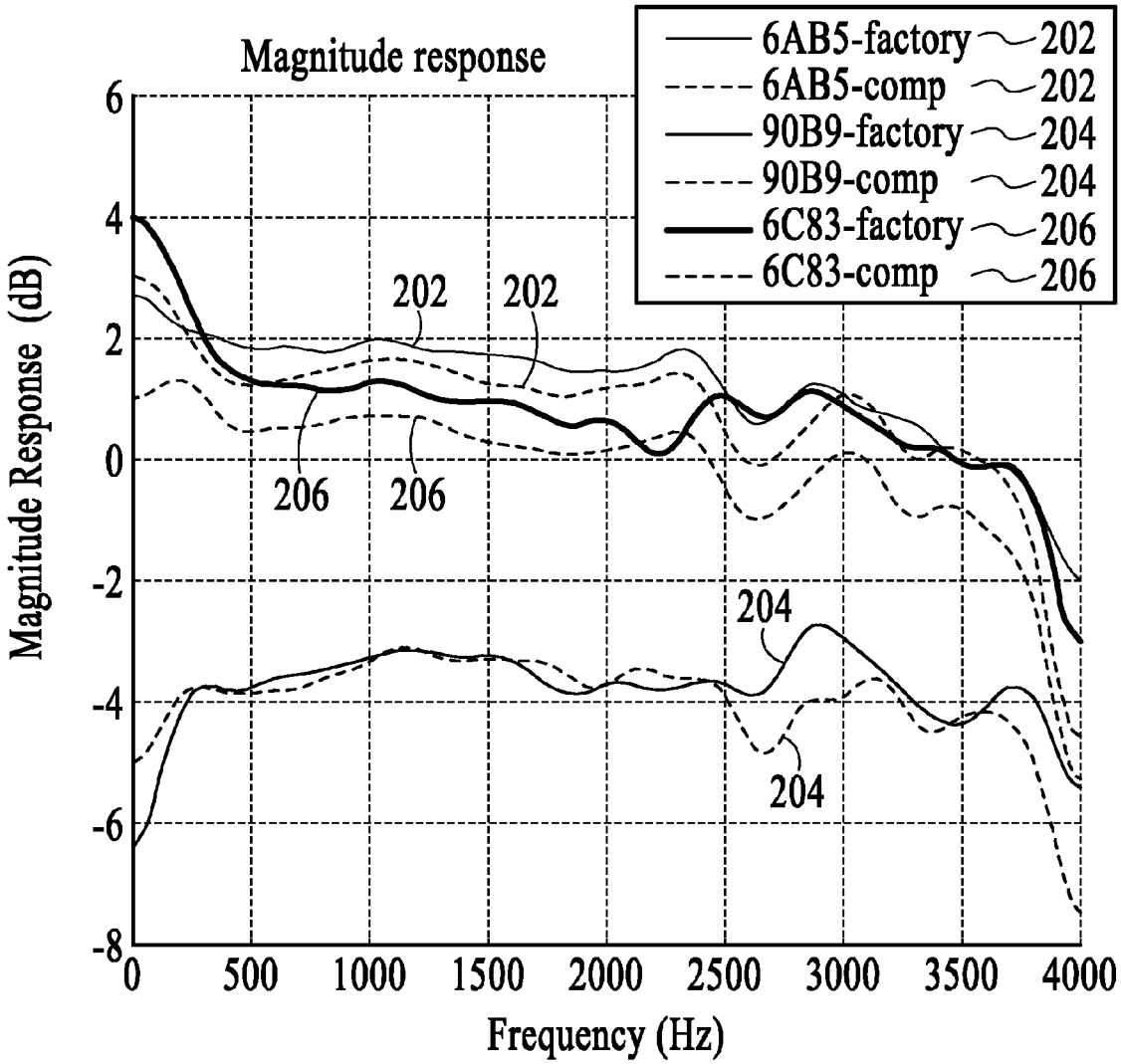
FIG. 11 shows the magnitude response of the calibration filter for the three headsets with factory calibrations before (solid) and after (dashed) compensation, under an embodiment. There is little change except near DC, where the responses are reduced, as intended.

For an initial test, the models for $\hat{0}_1(z)$ and $\hat{0}_2(z)$ were hard-coded in the three headsets above (6AB5, 90B9, and 6C83). The calibration tests were first run on the un-modified headsets using $O_1(z)$ and $O_2(z)$, then re-run using $0_1(z)\hat{0}_2(z)$ and $0_2(z)\hat{0}_1(z)$. The magnitude results are shown in FIG. 11 and the phase in FIG. 12. The magnitude response of the calibration filter shows little change except near DC, where the responses are reduced, as intended.

FIG. 11 shows the magnitude response of the calibration filter for the three headsets with factory calibrations before (solid) and after (dashed) compensation. There is little change except near DC, where the responses are reduced, as intended.

Figure 12:
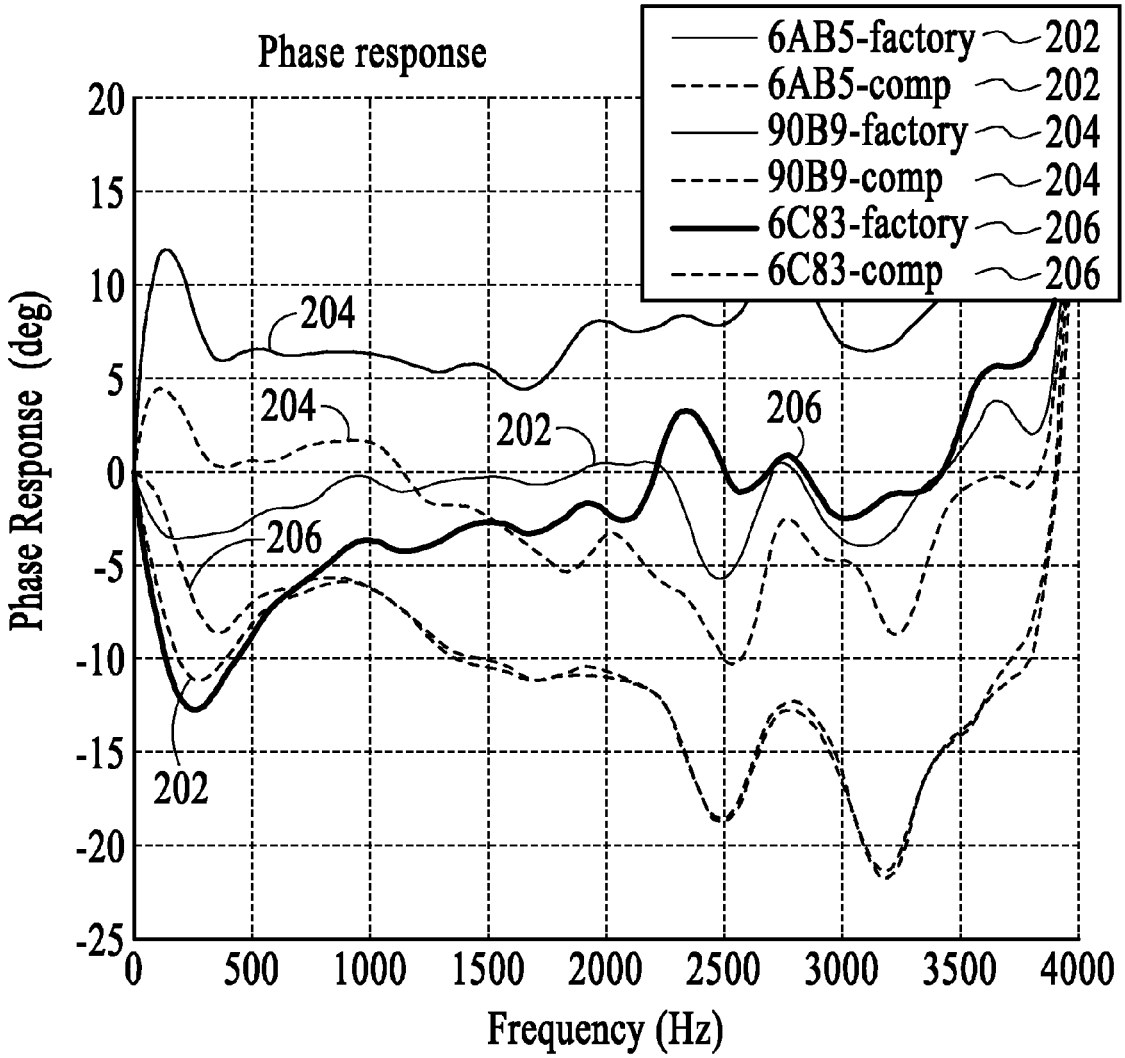
FIG. 12 shows a calibration phase response for the three headsets using factory calibrations (solid) and compensated Aliph calibrations (dashed), under an embodiment. Only the phase below 500 Hz is of interest for this test; there seems to be the addition of phase proportional to frequency for all compensated waveforms. The maximum of headset 90B9, the poorest performer, has been significantly reduced from 12+ degrees to less than five. Headset 6AB5, which had very little phase below 500 Hz, has been increased and thus argues that phase responses below 5 degrees should not be adjusted. The maximum in headset 6C83 has dropped from −12.5 degrees to −8.

FIG. 12 shows calibration phase response for the three headsets using factory calibrations (solid) and compensated Aliph calibrations (dashed). Only the phase below 500 Hz is of interest for this test; there seems to be the addition of phase proportional to frequency for all compensated waveforms. The maximum of headset 90B9, the poorest performer, has been significantly reduced from 12+ degrees to less than five. Headset 6AB5, which had very little phase below 500 Hz, has been increased and thus argues that phase responses below 5 degrees should not be adjusted. The maximum in headset 6C83 has dropped from −12.5 degrees to −8—not as much as for headset 90B9, but still an improvement. To make sure the calibration or microphone drift was not to blame, the calibrations were run again on the headsets at Aliph.

Figure 13:
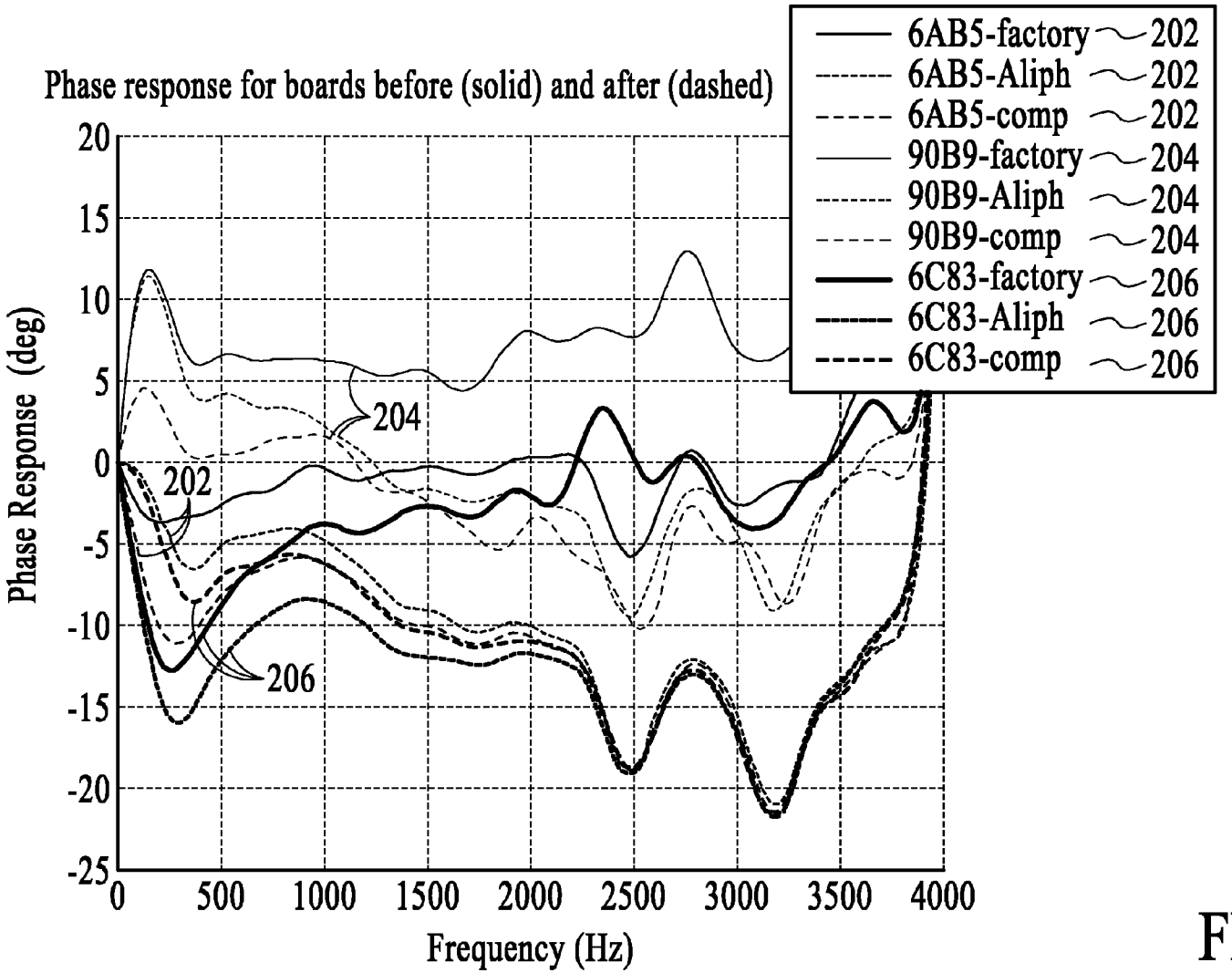
FIG. 13 shows a calibration phase response for the three headsets using factory calibrations (solid), Aliph calibrations (dotted), and compensated Aliph calibrations (dashed), under an embodiment. Below 1 kHz, there is significant disagreement in the factory and Aliph calibrations for headset 6AB5 and 6C83—this likely accounts for the increase in phase for 6AB5 and the smaller decrease in phase for 6C83. It is not clear why the calibrations at the factory and Aliph vary for these two microphones—it could be microphone drift or calibration error at the factory or Aliph or both. The calibrations for headset 90B9 agreed well, and the resulting phase difference dropped dramatically—underscoring the need for accurate and repeatable calibrations.

The results are shown in FIG. 13, where calibration phase response for the three headsets using factory calibrations (solid), Aliph calibrations (dotted), and compensated Aliph calibrations (dashed) are shown. Below 500 Hz, there is significant disagreement in the factory and Aliph calibrations for headset 6AB5 and 6C83—these account for the increase in phase for headset 6AB5 and the smaller decrease in phase for headset 6C83. It is not clear why the calibrations at the factory and Aliph vary for these two microphones—it could be microphone drift or calibration error at the factory or Aliph or both. The calibrations for headset 90B9 agreed well, and the resulting phase difference dropped dramatically—underscoring both the power of this technique and the need for accurate and repeatable calibrations.

Speech Response Loss and Compensation

Since a second HP filter is added to the microphone processing, the effect of the filters is increased from first-order to second-order. The 3-dB frequency is also increased, so the response of the lowest two subbands (0-250 Hz and 250-500 Hz) are likely to be reduced compared to what they are expected to be. FIG. 18 shows the responses calculated using the RC model above at 125 and 375 Hz for $O_1$, $O_2$, and the combination of $O_1$ and $O_2$. Clearly, if one or both of the 3-dB frequencies is high, the resulting $O_1O_2$ response is low. FIG. 19 shows just the response of the combination of $O_1$ and $O_2$ and the boost needed to regain the response of a single-pole filter with a 3-dB frequency of 200 Hz. The boost can vary between −1.1 and 12.0 dB depending on where the 3-dB frequencies of the filters in $O_1$ and $O_2$ are, and the needed boost is independent of the difference in frequencies.

To determine how best to implement a low frequency boost to make up for the increase in HP order and 3-dB frequency, consider the flow chart for the calibration method in FIG. 14. The excitation is two identical white noise bursts of three seconds separated by a short (e.g., less than 1 sec) silent period. The top flow is the first steps that are taken with the first white noise burst—the first alpha filter $\alpha_0(z)$ is then calculated using and adaptive LMS-based algorithm, but it is not so limited. It is then sent to the "Peak Finder" algorithm which finds the magnitude and location of the largest peak below 500 Hz using standard peak-finding methods. If the largest phase variation is between +3 and −5 degrees, no further action is taken and simple unity filters are used for $O_{1hat}$, $O_{2hat}$, and $H_{AC}(z)$. If the largest phase is greater than three degrees or less than negative five degrees, then the phase and frequency information is sent to the "Compensation Filter" subroutine, where $f_1$ and $f_2$ are calculated and the model filters $O_{1HAT}(z)$ and $O_{2HAT}(z)$ are generated.

Figure 15:
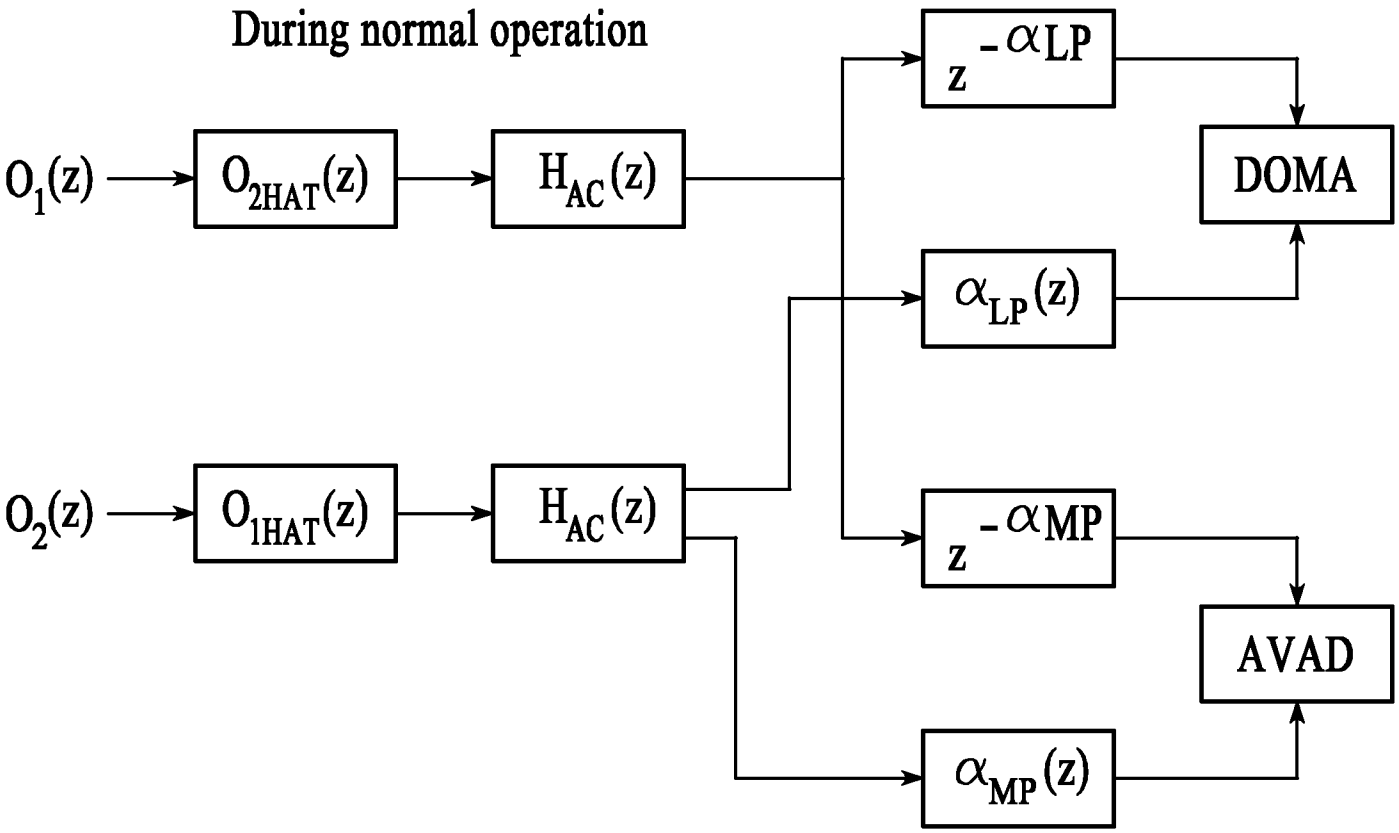
FIG. 15 is a flow diagram of the calibration filters during normal operation, under an embodiment.

But, as described above, the combination of $O_{1HAT}(z)$ and $O_{2HAT}(z)$ can lead to significant loss of response below 300 Hz, and the amount of loss depends on both the location of the 3-dB frequencies and their difference. So, the next stage (middle plot of FIG. 14) involves convolving $O_{1HAT}(z)$ with $O_{2HAT}(z)$ and comparing it to a "Standard Response" filter (currently a 200 Hz single-pole highpass filter). The linear phase FIR filter needed to correct the amplitude response of the combination of $O_{1HAT}(z)$ and $O_{2HAT}(z)$ is then determined and output as $H_{AC}(z)$. Finally, for the second white noise burst, $O_{1HAT}(z)$, $O_{2HAT}(z)$, and $H_{AC}(z)$ are used as shown in the bottom flow of FIG. 14 to calculate the second calibration filter $\alpha_{MP}(z)$, where "MP" denotes a minimum phase filter. That is, the filter is allowed to be non-linear. A third filter $\alpha_{LP}(z)$ may also be generated by forcing the second filter $\alpha_{MP}(z)$ to have linear phase with the same amplitude response, using standard techniques. It may also be truncated or zero-padded if desired. Either or both of these may be used in subsequent calculations depending on the application. For instance, FIG. 15 contains a flow diagram for operation of a microphone array using the calibration, under an embodiment. The minimum phase filter and its delay are used for the AVAD (acoustic voice activity detection) algorithm and the linear phase filter and its delay are used to form the virtual microphones for use in the DOMA denoising algorithm.

The delays of 40 and 40.1 samples used in the top and bottom part of FIG. 14 are specific to the system used for the embodiment and the algorithm is not so limited. The delays used there are to time-align the signals before using them in the algorithm and should be adjusted for each embodiment to compensate for analog-to-digital channel delays and the like.

Finally, since most calibrations are carried out in non-ideal chambers subject to internal reflections, a (normally linear phase) "Cal chamber correction" filter as seen in FIG. 14 can be used to correct for known calibration chamber issues. This filter can be approximated by examining hundreds or thousands of calibration responses and looking for similarities in all responses or measured using a reference microphone or by other methods known to those skilled in the art. For optimal performance, this requires that each calibration chamber be set up in an identical manner as much as possible. Once this correction filter is known, it is convolved with either the calibration filter $\alpha_0(z)$ if the initial phase difference is between −5 and +3 degrees or the calibration filter $\alpha_{MP}(z)$ otherwise. This correction filter is optional and may be set to unity if desired.

Now, the calibrated outputs of the system are $$\tilde{0}_1(z)=0_1(z)\hat{0}_2(z)H_{AC}(z)$$

$$\tilde{0}_2(z)=0_2(z)\hat{0}_1(z)H_{AC}(z)\alpha_{MP}(z)$$

where again, the minimum phase filter can be transformed to a linear phase filter of equivalent amplitude response if desired.

A method of reducing the phase variation of $O_1$ and $O_2$ due to 3-dB frequency mismatches has been shown. The method used is to estimate the 3-dB frequency of the microphones using the peak frequency and amplitude of the $\alpha_0(z)$ peak below 500 Hz. Estimates of the 3-dB frequencies for three different headsets yielded very accurate magnitude responses at all frequencies and good phase estimates below 1000 Hz. Tests on three headsets showed good reduction of phase difference for headsets with significant (e.g., greater than +−6 deg) differences. This reduction in relative phase is often accompanied by a significant decrease in response below 500 Hz, but an algorithm has been presented that will restore the response to one that is desired, so that all compensated microphone combinations will end up with similar frequency responses. This is highly desirable in a consumer electronic product.

Results of Using the v5 Calibration on Many Different Headsets

The version 5 (v5, $\alpha_{MP}(z)$ used) calibration method or algorithm described above is a compensation subroutine that minimizes the amplitude and phase effects of mismatched mechanical filters in the microphones. These mismatched filters can cause variations of up to +−25 degrees in the phase and +−10 dB in the magnitude of the alpha filter at DC. These variations caused the noise suppression performance to vary by more than 21 dB and the devoicing performance to vary by more than 12 dB, causing significant variation in the speech and noise response of the headsets. The effects that the v5 cal routine has on the amplitude and phase response mismatches are examined and the correlated denoising and devoicing performance compared to the previous conventional version 4 (v4, only $\alpha_0(z)$ used) calibration method. These were tested first at Aliph using six headsets and then at the manufacturer using 100 headsets.

Six Headsets

The v5 calibration algorithm was implemented and tested on six units. Four of the units had large phase deviations and two smaller deviations. The relative magnitude and phase results using the old (solid line) calibration algorithm and the new (dashed) calibration algorithm are shown in FIGS. 20 and 21.

Figure 20:
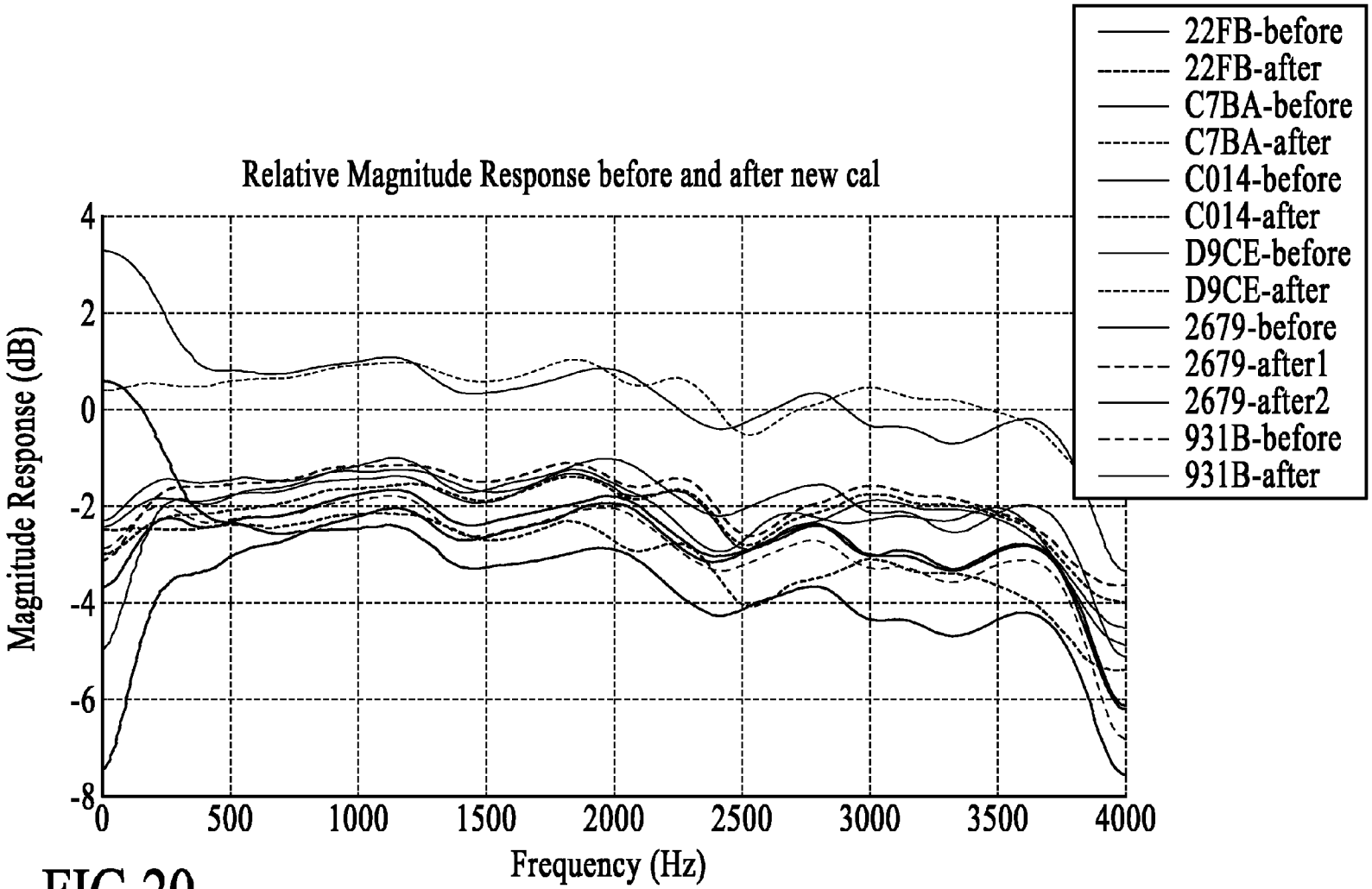
FIG. 20 shows a magnitude response of six test headsets using v4 (solid lines) and v5 (dashed), under an embodiment. The "flares" at DC have been eliminated, reducing the 1 kHz normalized difference in responses from more than 8 dB to less than 2 dB.

FIG. 20 shows magnitude response of six test headsets using v4 (solid lines) and v5 (dashed). The "flares" at DC have been eliminated, reducing the 1 kHz normalized difference in responses from more than 8 dB to less than 2 dB.

Figure 21:
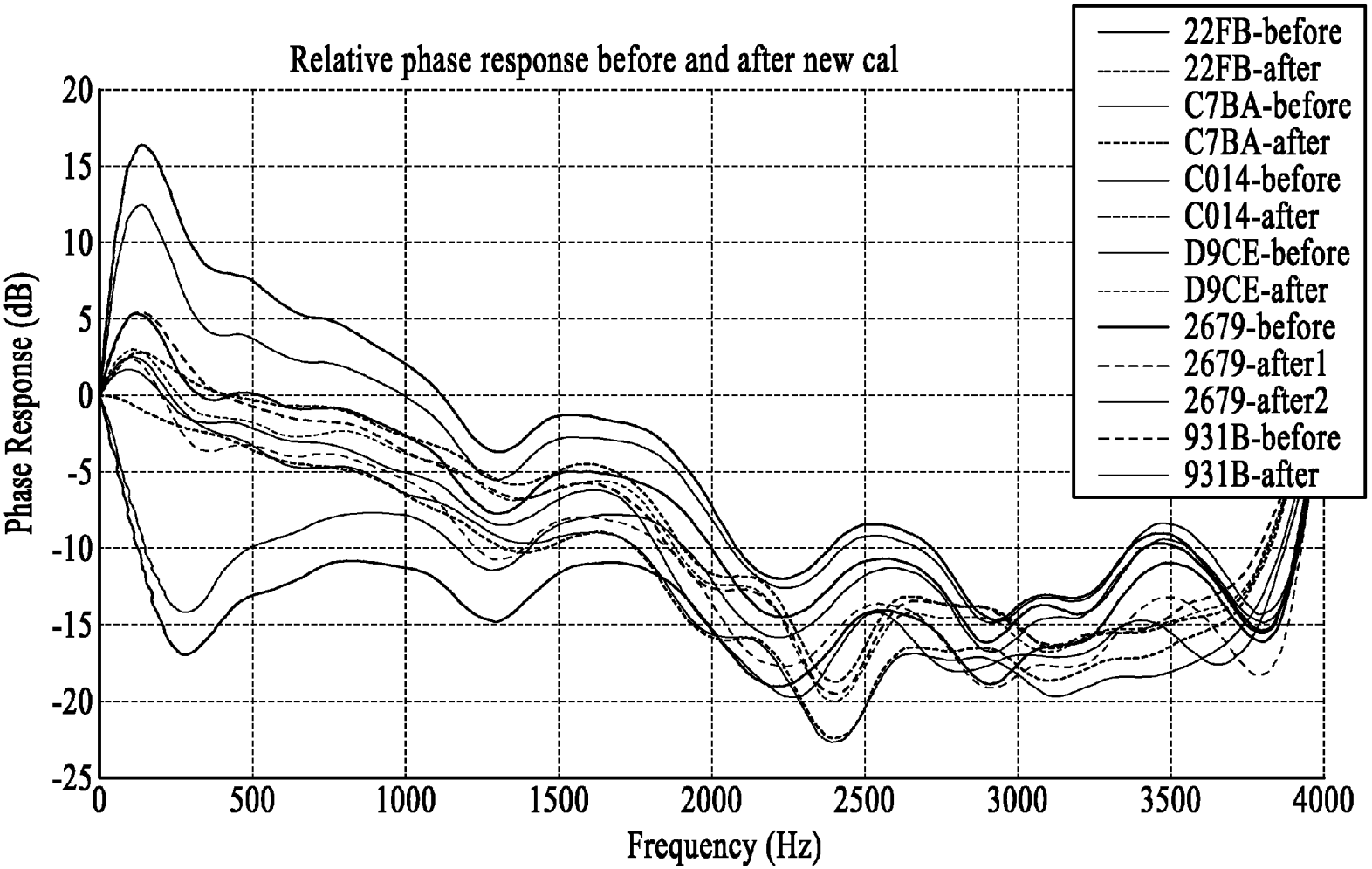
FIG. 21 shows a phase response of six test headsets using v4 (solid lines) and v5 (dashed), under an embodiment. The large peaks below 500 Hz have been eliminated, reducing phase differences from 34 degrees to less than 7 degrees.

FIG. 21 shows phase response of six test headsets using v4 (solid lines) and v5 (dashed). The large peaks below 500 Hz have been eliminated, reducing phase differences from 34 degrees to less than 7 degrees.

The v5 algorithm was thus successful in eliminating the large magnitude flares near DC in FIG. 20, and the spread in phase went from 34 degrees (+−17) to less than 7 degrees (+5, −2) below 500 Hz in FIG. 21.

To correlate the reduced amplitude and phase difference with headset performance, full denoising/devoicing tests were run on all six headsets using both v4 and v5 calibration methods and the results compared to the headset with the smallest initial phase difference using the v5 calibration. The reduction in phase and amplitude differences shown in FIGS. 20 and 21 resulted in significantly improved denoising/devoicing performances, as shown in FIG. 22. FIG. 22 shows a table of the approximate denoising, devoicing, and SNR increase in dB using headset 931B-v5 as the standard. Pathfinder-only denoising and devoicing changes were used to compile the table. SNR differences of up to 11 dB were compensated to within 0 to −3 dB of the standard headset. Denoising differences between calibration versions were up to 21 dB before and 2 dB after. Devoicing differences were up to 12 dB before and 2 dB after.

The average denoising at low frequencies (125 to 750 Hz) varied by up to 21 dB between headsets using v4. In v5, that difference dropped to 2 dB. Devoicing varied by up to 12 dB using v4; this was reduced to 2 dB in v5. The large differences in denoising and devoicing manifest themselves not only in SNR differences, but the spectral tilt of the user's voice. Using v4, the spectral tilt could vary several dB at low frequencies, which means that a user could sound different on headsets with large phase and magnitude differences. With v5, a user will sound the same on any of the headsets.

Speech quality and wind resistance were also significantly improved using v5 compared to v4. In live in-car tests, a male and female speaker spoke several standard sentences in the presence of loud talk radio with the window cracked six inches. On the v4 headsets, there is a significant amount of modulation, "swishing" at low frequencies, and musicality at all frequencies. The v5 headsets, on the other hand, have no modulation, no swishing or musicality, significantly higher quality, intelligibility, and naturalness, and spectrally similar outputs.

The performance of the headsets was significantly better using v5—even for the units that required no phase correction, due to the use of the standard response and the deletion of the phase of the anechoic/calibration chamber compensation filter.

Ninety-Nine Factory Headsets

One hundred headsets were pulled from the production line, calibrated using v4, and then recalibrated using v5. The magnitude and phase responses were plotted for both the v4 and v5 alpha filters. The mean and standard deviations were calculated, which should be accurate to within 5% or so given the relatively large sample size. One headset failed before the v5 cal could be applied and was removed from the v4 sample, leaving us with 99 comparable sets.

Figure 23:
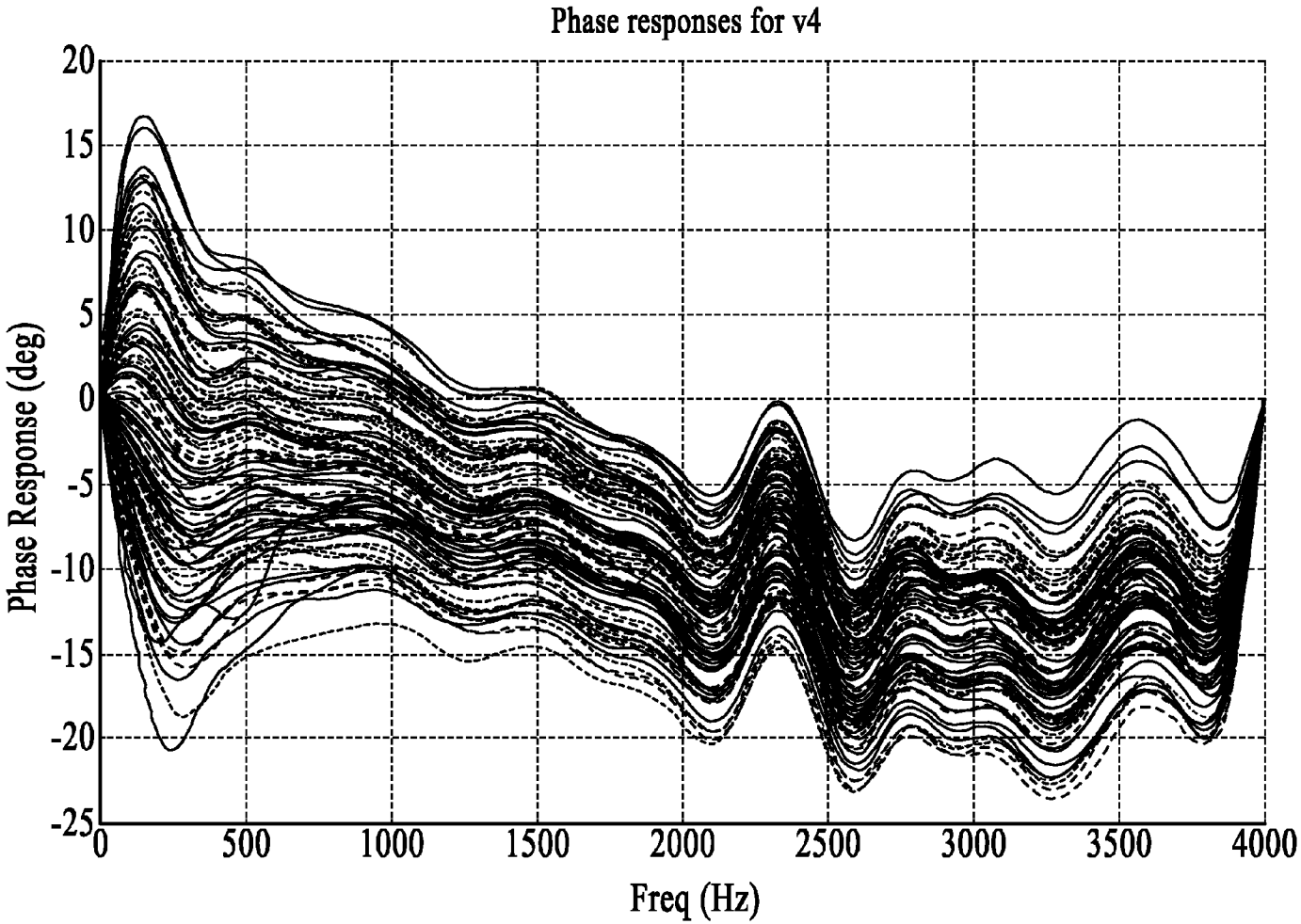
FIG. 23 shows phase responses of 99 headsets using v4 calibration, under an embodiment. The spread in max phase runs from −21 to +17 degrees, which results in significant performance differences.
Figure 24:
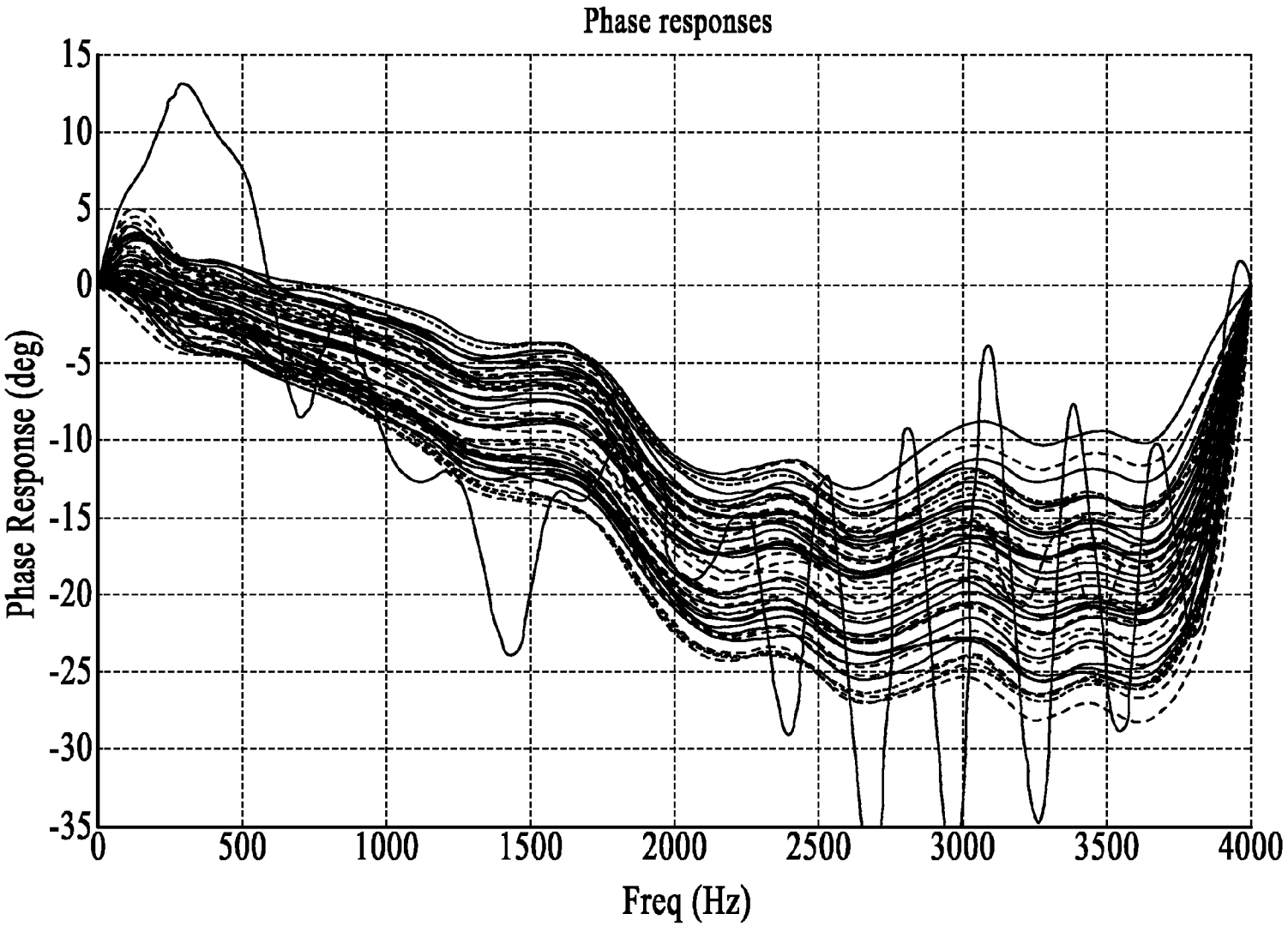
FIG. 24 shows phase responses of 99 headsets using v5 calibration, under an embodiment. The outlier yellow plot was likely due to operator error. The spread in max phase has changed from −21 to +17 degrees to +−5 degrees below 500 Hz. The magnitude variations near DC were similarly eliminated. These headsets should be indistinguishable in performance.

The phase responses for the v4 cal are shown in FIG. 23. This 38-degree spread (−21 to +17 degrees) is typical to what is normally observed with headsets using these microphones. These headsets would vary widely in their performance, even more than the 21 dB observed in the six headsets above. Compare these phase responses to the same headsets using the v5 calibration in FIG. 24. The spread has been reduced to less than 10 degrees below 500 Hz, rendering these headsets practically indistinguishable in performance. There is also significantly less ripple in the phase response for v5. There was one headset that returned a spurious response (likely due to operator error) but it would have been caught by the v5 error-checking routine.

Figure 25:
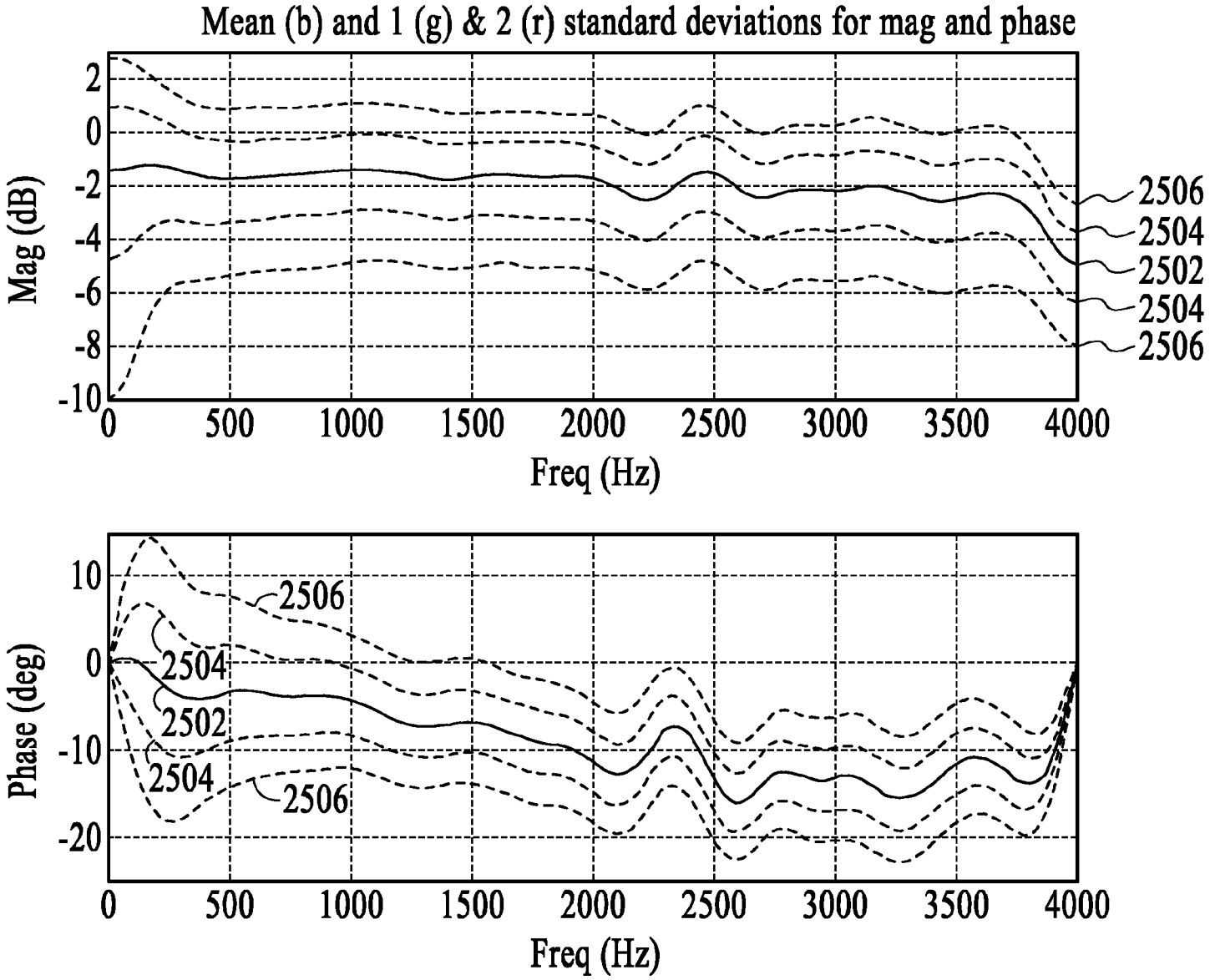
FIG. 25 shows mean, +−1σ, and +−2σ of the magnitude (top) and phase (bottom) responses of 99 headsets using v4 calibration, under an embodiment. The 2σ spread in magnitude at DC is almost 13 dB, and for phase is 31 degrees. If +5 and −10 degrees are taken to be the cutoff for good performance, then about 40% of these headsets will have significantly poorer performance than the others.

FIG. 25 shows mean 2502, +−1σ 2504, and +−2σ 2506 of the magnitude (top) and phase (bottom) responses of 99 headsets using v4 calibration. The 2σ spread in magnitude at DC is almost 13 dB, and for phase is 31 degrees. If +5 and −10 degrees are taken to be the cutoff for good performance, then about 40% of these headsets will have significantly poorer performance than the others.

Figure 26:
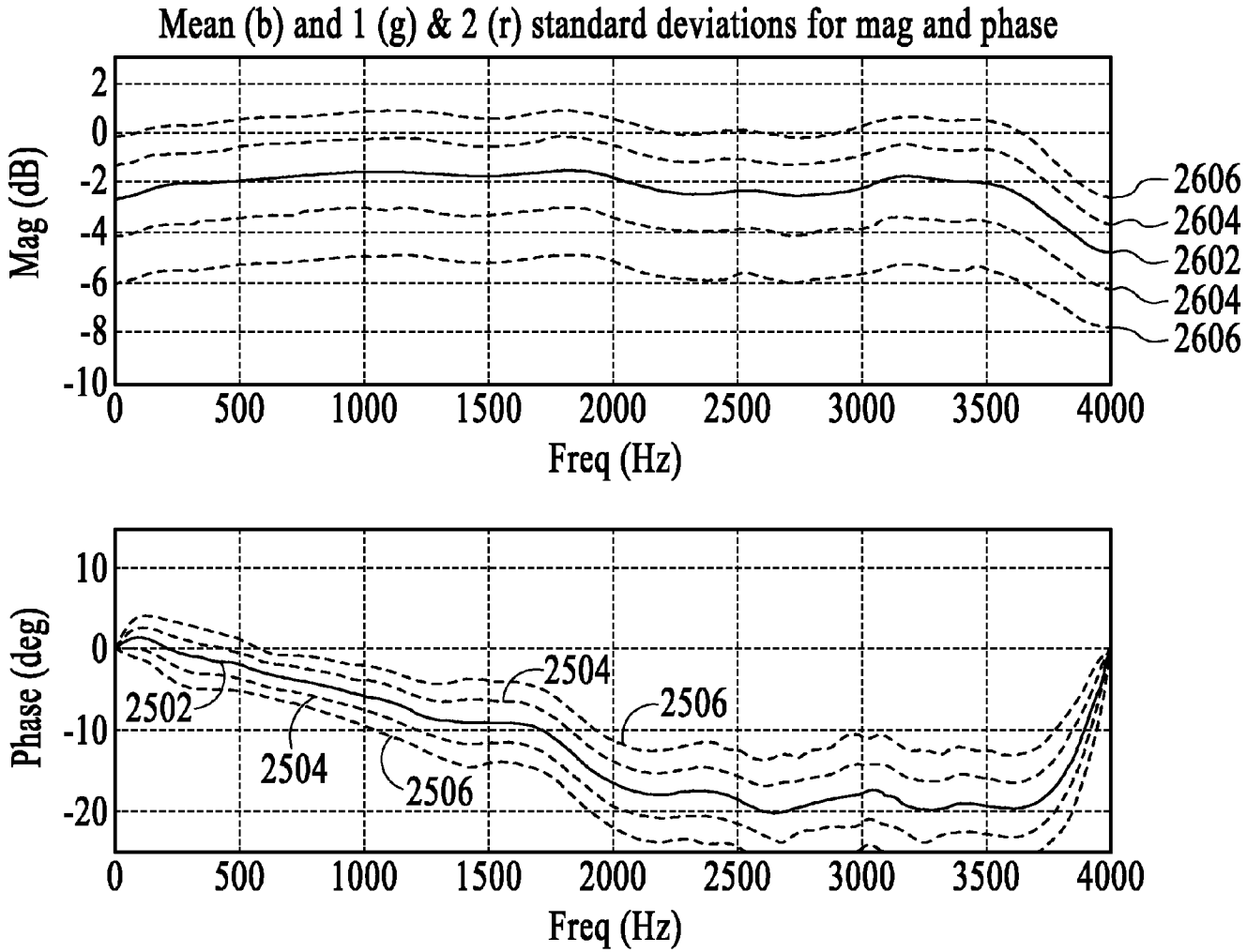
FIG. 26 shows mean, +−1σ, and +−2σ of the magnitude (top) and phase (bottom) responses of 99 headsets using v5 calibration, under an embodiment. The 2σ spread in magnitude at DC is now only 6 dB (within spec) with less ripple, and for phase is less than 7 degrees with significantly less ripple. These headsets should be indistinguishable in performance.

FIG. 26 shows mean 2602, +−1σ 2604, and +−2σ 2606 of the magnitude (top) and phase (bottom) responses of 99 headsets using v5 calibration. The 2σ spread in magnitude at DC is now only 6 dB (within spec) with less ripple, and for phase is less than 7 degrees with significantly less ripple. These headsets should be indistinguishable in performance.

The mean 2502 and standard deviations (2504 for +−1σ, 2506 for +−2σ) for the v4 cal in FIG. 25 show that at DC there is a 13 dB difference in magnitude response and a 31 degree spread below 500 Hz for +−2σ. This is reduced to 6 dB in magnitude (which is the specification for the microphones, +−3 dB) and 7 degrees in phase for v5 shown in FIG. 26. Also, there is significantly less ripple in both the magnitude and the phase responses. This is a phenomenal improvement in calibration accuracy and will significantly improve performance for all headsets.

Figure 27:
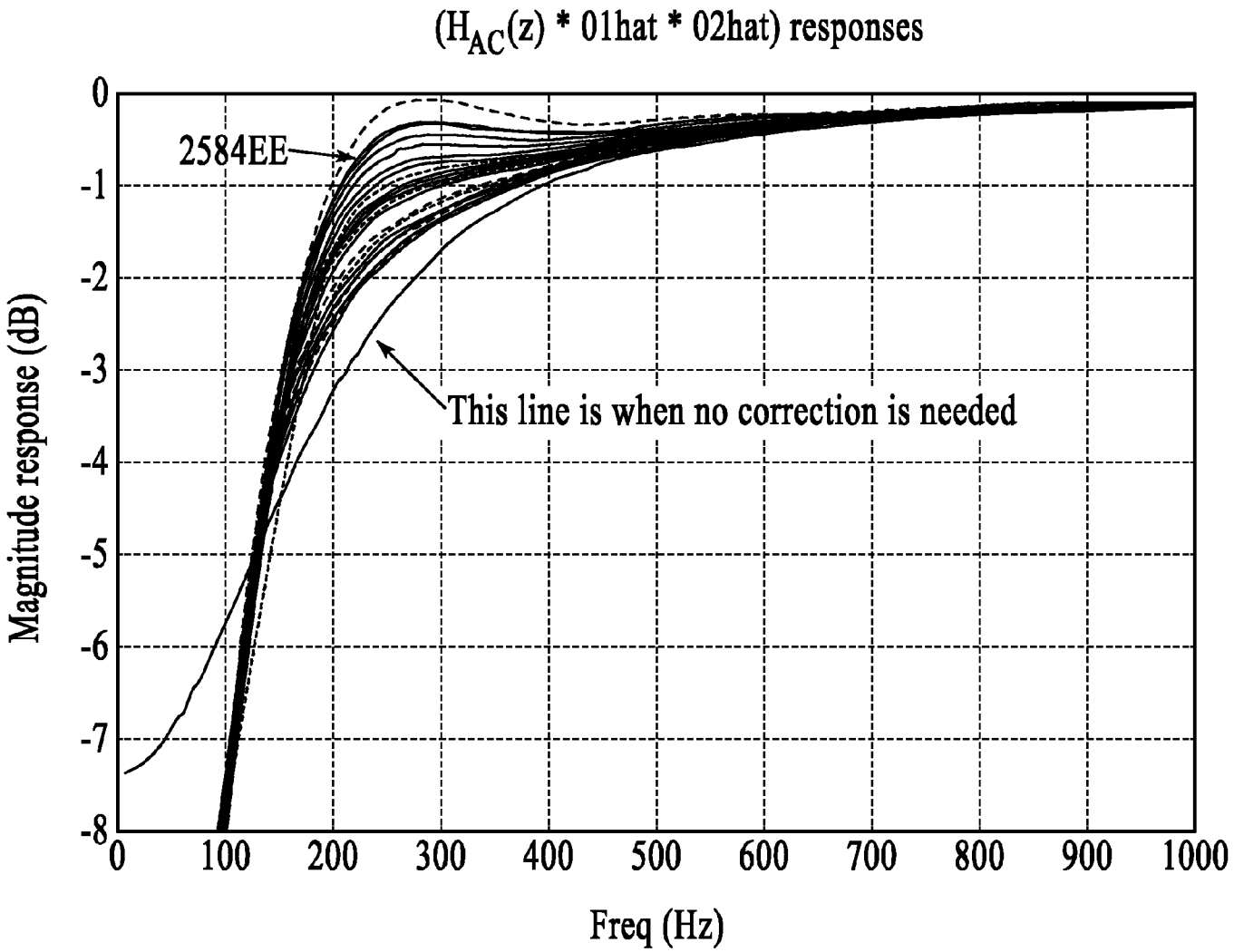
FIG. 27 shows magnitude response for the combination of O1hat, O2hat, and $H_{AC}$, under an embodiment. This will be modulated by $O_1$'s native response to arrive at the final input response to the system. The annotated line shows what the current system does when no phase correction is needed; this has been changed to a unity filter for now and will be updated to a 150 Hz HP for v6. All of the compensated responses are within +−1 dB and their 3 dB points within +−25 Hz.

Also examined is the relationship between $O1_{hat}$, $O2_{hat}$, and $H_{AC}(z)$. This gives some idea of how spectrally similar the outputs of the microphones (also the inputs to DOMA) will be. This is not the final response, though, as the real response will be modulated by the native response of $O_1$, which can vary +−3 dB. The response for v5 is shown in FIG. 27, which shows magnitude response for the combination of O1hat, O2hat, and $H_{AC}$. This will be modulated by $O_1$'s native response to arrive at the final input response to the system. The annotated line shows what the current system does when no phase correction is needed; this has been changed to a unity filter for now and will be updated to a 150 Hz HP for v6 as described herein. All of the compensated responses are within +−1 dB and their 3 dB points within +−25 Hz—indistinguishable to the end user. The unit with the poor v5 cal (headset 2584EE) has a normal response here, indicating that it was not an algorithmic problem that let to its unusual response.

Finally, the limits on compensation seem to be correct. Currently, the phase difference is not compensated for if the maximum value of the phase is between −5 and +3 degrees below 500 Hz. FIG. 28 shows initial and final maximum phases for initial maximum near the upper limit. For headsets with initial maximum phases above 5 degrees, there was always a reduction in maximum phase. Between 3-5 degrees, there was some reduction in phase and some small increases. Below 3 degrees there was little change or a small increase. Thus 3 degrees is a good upper limit in determining whether or not to compensate for phase differences.

As shown in FIG. 28, any headset with a maximum phase more than 5 degrees is always reduced in phase difference. Between 3-5 degrees, there was some reduction in phase but some small increases (red text) as well. Below 3 degrees there was little change or a small increase. Thus 3 degrees is a good upper limit in determining whether or not to compensate for phase differences.

The same was true of the negative values, with the exception that no phase differences were increased. That is, the largest negative values observed were from headsets that were very close to the cutoff, but the maximum value never increased, so the −5 degree threshold is left in place.

Interestingly, the largest maximum phase values (more than +−15 degrees) were normally compensated to within +−2.5 degrees—amazingly good compensations, indicating that the model used is appropriate and accurate.

The reduction in magnitude and phase spread and subsequent improvement in headset performance using the v5 calibration algorithm has generally reduced the percentage of under-performing headsets manufactured. Differences in denoising have been reduced from 21 dB to 2 dB. Differences in devoicing have been reduced from 12 dB to 2 dB. Headsets that sounded vastly different using v4 are now functionally identical using v5.

In addition, denoising artifacts such as swishing, musicality, and other irritants have been significantly reduced or eliminated. The outgoing speech quality and intelligibility is significantly higher, even for units with small phase differences. The spectral tilt of the microphones has been normalized, making the user sound more natural and making it easier to set the TX equalization. The increase in performance and robustness that was realized with the use of the v5 calibration is significantly large.

Finally, with the v5 calibration, testing of different algorithms using different units will be much more uniform, with differences in performance arising more from the algorithm under test rather than unit-to unit microphone differences. This should result in improved performance in all areas.

In the v6 calibration, described below, the microphone outputs are normalized to a standard level so that the input to DOMA will be functionally identical for all headsets, further normalizing the user's speech so that it will sound more natural and uniform in all noise environments.

Alternative v5 Calibration Method

The v5 calibration routine described above significantly increased the performance of all headsets by a combination of eliminating phase and magnitude differences in the alpha filter caused by different mechanical HP filter 3-dB points. It also used a "Standard response" (i.e. a 200 Hz HP filter) to normalize the spectral response of $O_1$ and $O_2$ for those units that were phase-corrected. However, it did not impose a standard gain (that is, the gain of $O_1$ at 1 kHz could vary up to the spec, +−3 dB) and it also did not normalize the spectral response for units that did not require phase-correcting (units that had very small alpha filter phase peaks below 500 Hz). These units had similar 3-dB frequencies and were simply passed through using unity filters for $O1_{hat}$, $O2_{hat}$, and $H_{AC}$. However, just because the 3-dB frequencies were similar does not mean they were in the right place—they can vary from 100 Hz to 400+ Hz. Therefore, even if they have very little alpha phase difference, they can have a different spectral response than the phase-corrected units. A second branch of processing is introduced below that takes the units that do not need phase correction and normalizes their amplitude response to be similar to those that do require phase correction. The "Standard response" used below is now assumed to have both a desired amplitude response and a fixed gain at 750 Hz.

Version 4 (v4) and Version 5 Calibration

The v4 calibration was a typical state-of-the-art microphone calibration system. The two microphones to be calibrated were exposed to an acoustic source designed so that the acoustic input to the microphones was as similar as possible in both amplitude and phase. The source used in this embodiment consisted of a 1 kHz sync tone and two 3-second white noise bursts (spectrally flat between approximately 125 Hz and 3875 Hz) separated by 1 second of silence. White noise was used to equally weight the spectrums of the microphones to make the adaptive filter algorithm as accurate as possible. The input to the microphones may be whitened further using a reference microphone to record and compensate for any non-ideal response from the loudspeaker used, as known to those skilled in the art.

This system worked reasonably well, but differences in the amplitude and phase responses below 500 soon became apparent. These differences were traced to the use of mechanical highpass (HP) filters in the microphones, designed to make the microphones less responsive to wind noise. When the 3-dB points of these filters were farther apart than about 50 Hz or so, the differences in amplitude and phase responses were large enough to disrupt virtual microphone formation below 500 Hz. A new method of compensating for these HP filters was needed, and this was the version 5 (v5) algorithm described above. A refinement of the v5 algorithm is described below, and referred to herein as the version 6 (v6) algorithm or method, which includes standardization of $O_1$ and $O_2$ responses for all headsets—even those with similar 3-dB points.

The Version 6 (v6) Algorithm

Version 6 is relatively simple in that only one extra step is required from v5, and it is only required for arrays that do not require compensation—that is, phase-matched arrays whose maximum phase below 500 Hz is less than three degrees and greater than negative 5 degrees. Instead of using the second white noise burst to calculate $O_{1HAT}$, $O_{2HAT}$, and $H_{AC}$, we can use it to impose the "Standard response" in FIG. 14 on the phase-matched headsets. We simply take the calibrated outputs of v5:

$$\tilde{O}_1(z)=O_1(z)$$

$$\tilde{O}_2(z)=O_2(z)\alpha_0(z)$$

and record the response of either calibrated microphone (either may be used, we used $O_1(z)$) to the second white noise burst. We then lowpass filter and decimate the recorded output by four to reduce the bandwidth from 4 kHz (8 kHz sampling rate) to 1 kHz. This is not required, but simplifies the following steps, since we are just trying to determine the 3-dB point, which will almost always be below 1 kHz. We then use a conventional technique such as the power spectral density (PSD) to calculate the approximate response of the calibrated microphones. This calculation does not require the accuracy of the calculation used above to approximate $f_1$ and $f_2$, since we are simply trying to normalize the overall responses and accuracy to +−50 Hz or even more is acceptable. The calibrated responses are compared to the "Standard Response" used in FIG. 14. A compensation filter $H_{BC}(z)$ is generated using the difference between the "Standard Response" and the calculated responses, and both calibrated outputs are filtered with the $H_{BC}(z)$ filter to recover the standard response. Thus the v6 outputs are $$\tilde{O}_1(z)=O_1(z)H_{BC}(z)$$

$$\tilde{O}_2(z)=O_2(z)\alpha_0(z)H_{BC}(z)$$

where again, only the arrays that did not need phase compensation are used.

In addition, as a final step, the calibrated outputs of both v5 and v6 can be normalized to the same gain at a fixed frequency—we have used 750 Hz to good effect. However, this is not required, as manufacturing tolerances of +−3 dB are easily obtained and variances in speech volume between users are commonly much larger than 6 dB. An automatic gain compensation algorithm can be used to compensate for different user volumes in lieu of the above if desired.

Figure 29:
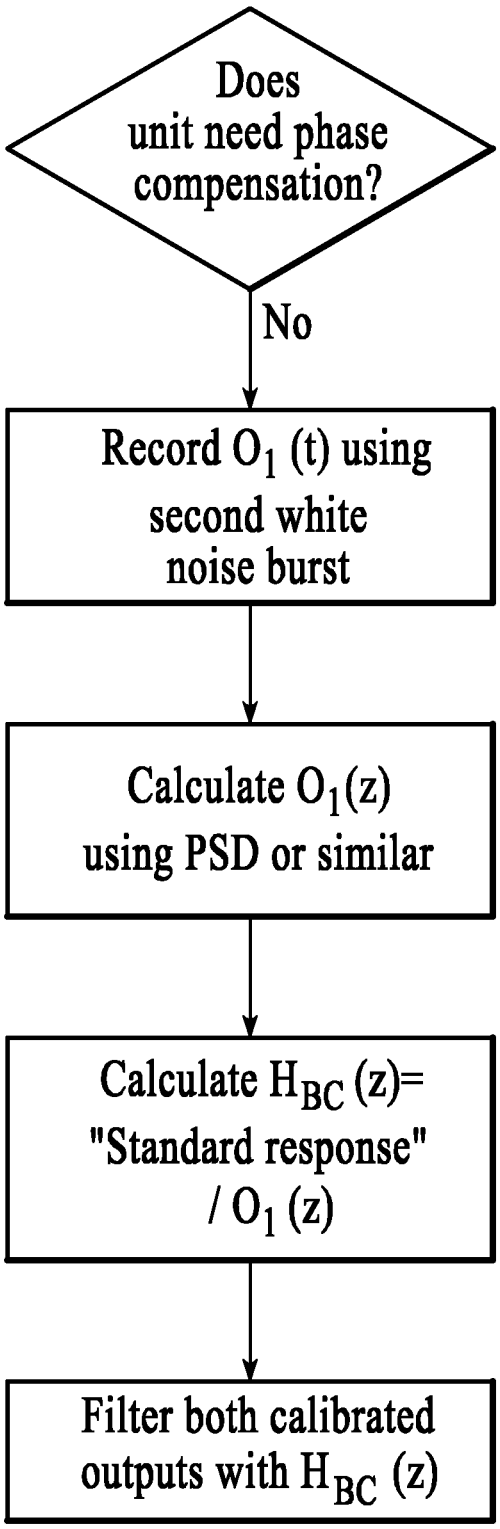
FIG. 29 is a flow chart of the v6 algorithm where headsets without significant phase difference also get normalized to the standard response, under an embodiment.

FIG. 29 shows a flow chart of the v6 algorithm where arrays without significant phase difference also get normalized to the standard response, under an embodiment. The recorded responses of $O_1$ from the second burst of white noise are analyzed using any standard algorithm (such as the PSD) to calculate the approximate amplitude response of $O_1(z)$. The difference between the $O_1$ amplitude response and the desired "Standard response" (in our case, a first-order highpass RC filter with a 3-dB frequency of 200 Hz) is used to generate the compensation filter $H_{BC}(z)$, which is then used to filter both calibrated outputs from v5.

Alternative v4 Calibration Method Using Software Update (No Recalibration Required)

The v5 and v6 calibration algorithms described above are effective at normalizing the response of the microphones and reducing the effect of mismatched 3-dB frequencies on the alpha phase and amplitude near DC. But, they require the unit to be re-calibrated, and this is difficult to accomplish for previously-shipped headsets. While these shipped headsets cannot all be recalibrated, they still may gain some performance just from the reduction of the phase and magnitude differences.

Version 4.1 (v4.1) Algorithm

The v5 algorithm described herein reduces the amplitude and phase mismatches by determining the 3-dB frequencies $f_1$ and $f_2$ for $O_1$ and $O_3$. Then, RC models of the mechanical filters are constructed, as described herein, using:

$$\hat{O}_N(z) \approx \frac{\sqrt{A_N}\,(1-z^{-1})}{A_N - z^{-1}} = \frac{\frac{1}{\sqrt{A_N}}(1-z^{-1})}{1-\frac{1}{A_N}z^{-1}} \quad \text{[Eq. 1]}$$

$$\text{where } A_N = 1 + \frac{2\pi f_N}{f_S}$$

and $f_s$ is the sampling frequency. Then, $O_1$ is filtered using $O_{2hat}$ and $O_2$ is filtered using $O_{1hat}$ and $\alpha_1(z)$ calculated by $$\alpha_{MP}(z) = \frac{O_1(z)\hat{O}_2(z)}{O_2(z)\hat{O}_1(z)} = \alpha_0(z)\frac{\hat{O}_2(z)}{\hat{O}_1(z)} = \alpha_0(z)\frac{\frac{1}{\sqrt{A_2}}(1-z^{-1})}{1-\frac{1}{A_2}z^{-1}}\frac{1-\frac{1}{A_1}z^{-1}}{\frac{1}{\sqrt{A_1}}(1-z^{-1})}$$

$$\alpha_{MP}(z) = \alpha_0(z)\sqrt{\frac{A_1}{A_2}}\cdot\frac{\left(1-\frac{1}{A_1}z^{-1}\right)}{\left(1-\frac{1}{A_2}z^{-1}\right)}$$

The compensation filter $\alpha_C(z)$ is therefore $$\alpha_C(z) = \sqrt{\frac{A_1}{A_2}}\cdot\frac{\left(1-\frac{1}{A_1}z^{-1}\right)}{\left(1-\frac{1}{A_2}z^{-1}\right)} \quad \text{[Eq. 2]}$$

Figure 30:
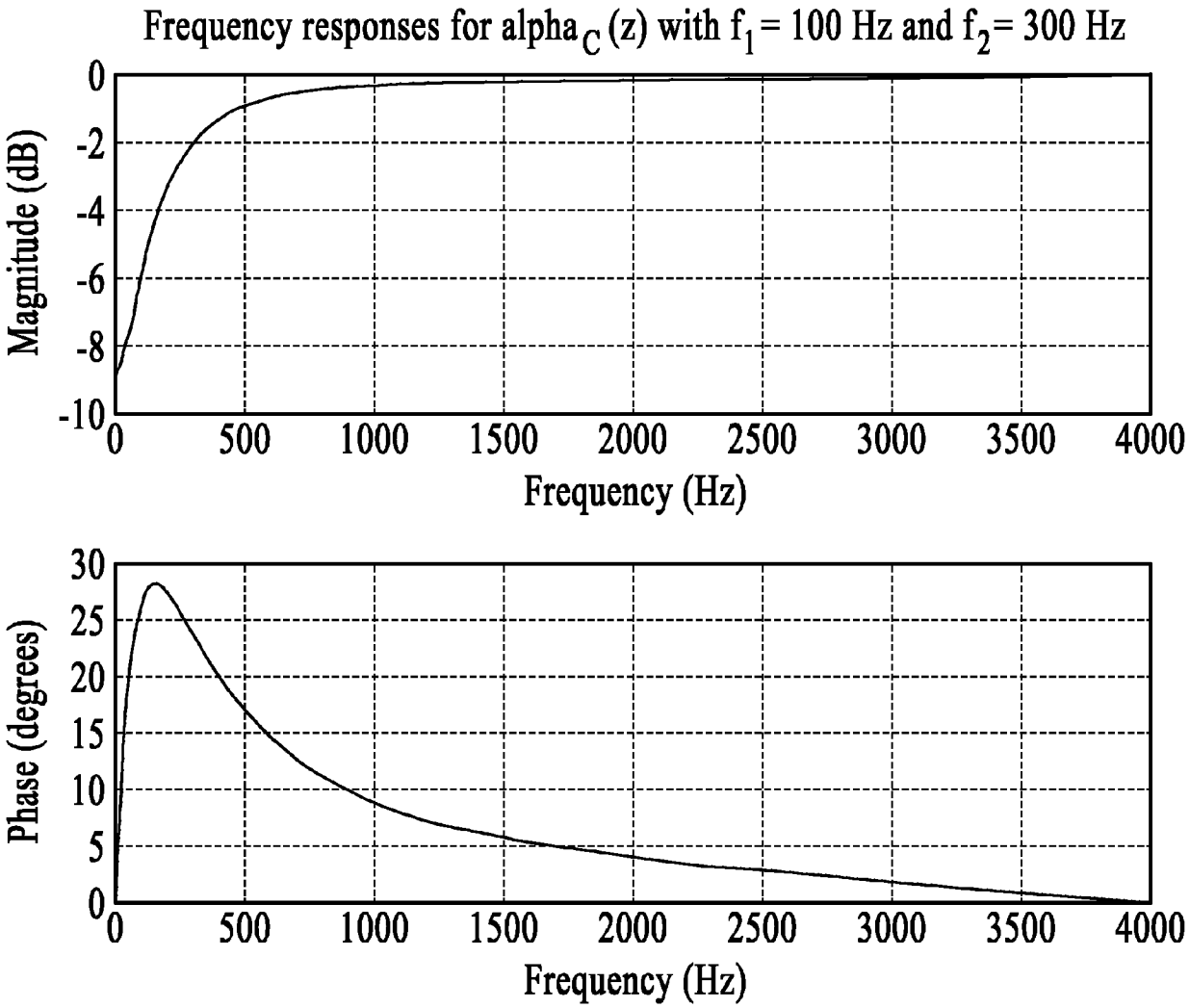
FIG. 30 shows a frequency response for $\alpha_C(z)$ using $f_1$=100 Hz and $f_2$=300 Hz, under an embodiment.

Since $A_1$ and $A_2$ are constrained to be slightly more than unity, this filter will never be unstable. FIG. 30 shows the response of an $\alpha_C(z)$ using $f_1$=100 Hz and $f_2$=300 Hz, under an embodiment. If $f_1$=300 Hz and $f_2$=100 Hz, the magnitude and phase are inverted from those shown in FIG. 30.

Figure 31:
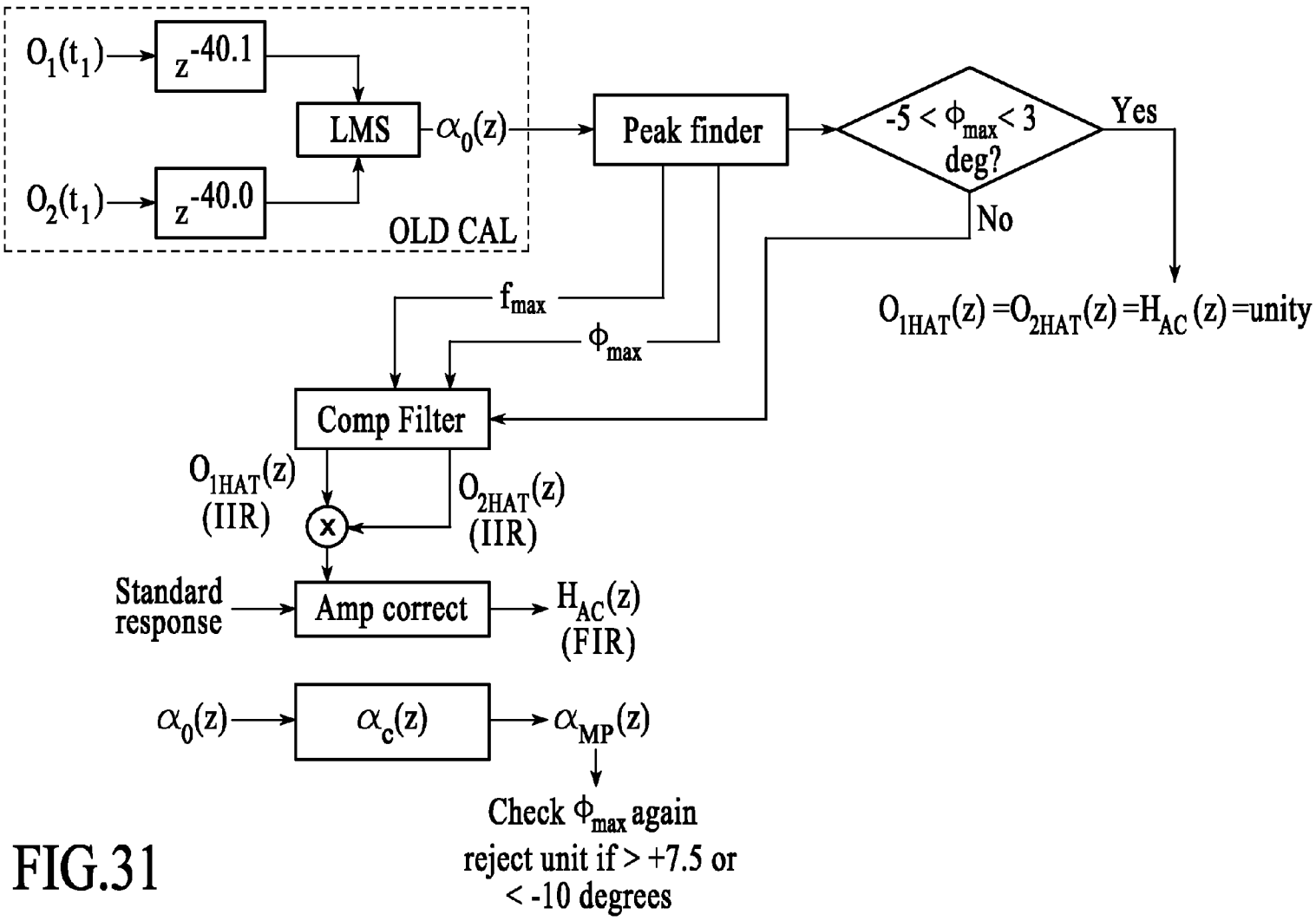
FIG. 31 shows a flow of the v4.1 calibration algorithm, under an embodiment. Since no new information is possible, the benefits are limited to $O_{1HAT}$, $O_{2HAT}$, and $H_{AC}(z)$ for units that have sufficient alpha phase.
Figure 32:
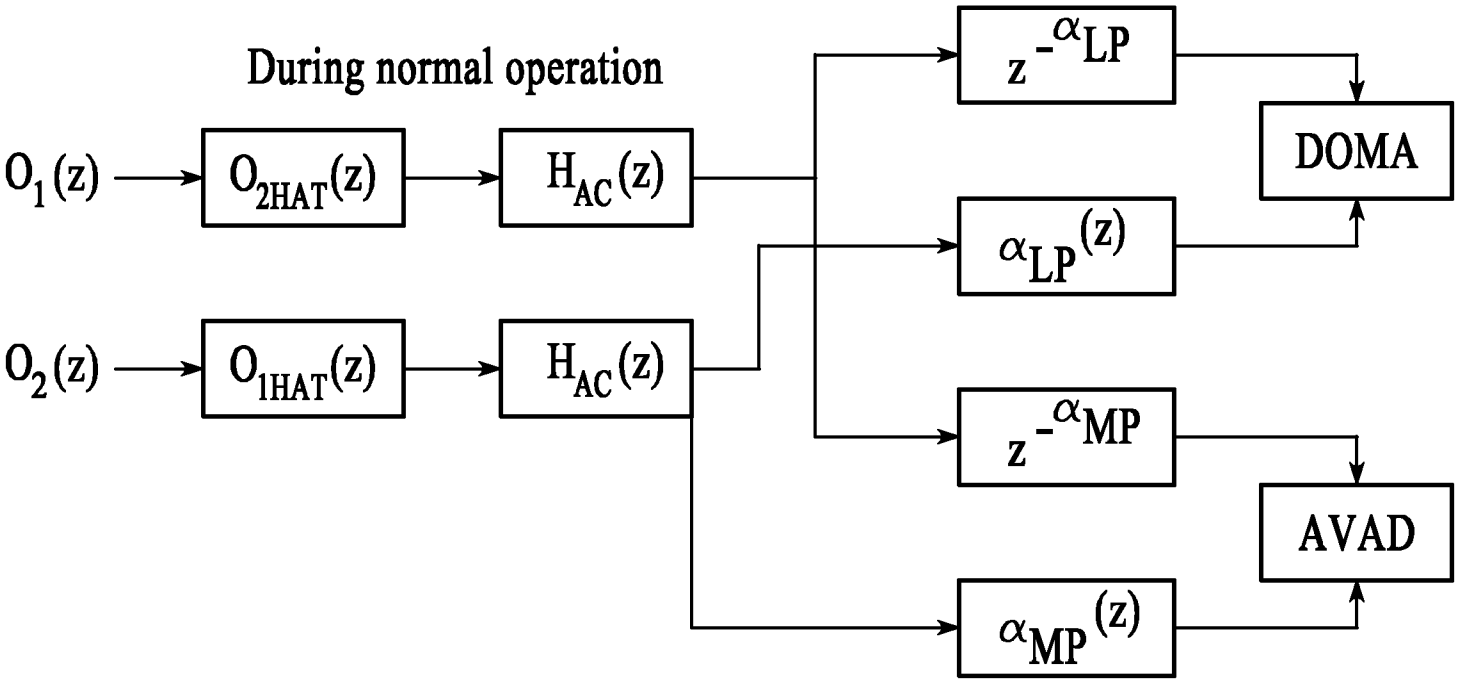
FIG. 32 shows the use of the filters of an embodiment prior to the DOMA and AVAD algorithms, under an embodiment.

The calculation of $H_{AC}(z)$ using $O_{1hat}$ and $O_{2hat}$ proceeds as in v5. FIG. 31 shows a flow diagram for the v4.1 calibration algorithm, under an embodiment. Since no new information is possible, the benefits are limited to $O_{1HAT}$, $O_{2HAT}$, and $H_{AC}(z)$ for units that have sufficient alpha phase. FIG. 32 shows use of the new filters prior to the DOMA and AVAD algorithms. The implementation of $O_{1hat}$, $O_{2hat}$, and $H_{AC}$ into the DOMA and AVAD algorithms is unchanged from v5.

A variation of the v5 calibration algorithm that could be applied to v4 calibrations as a software update has been shown in the v4.1 calibration algorithm. This update would reduce the effects of 3-dB mismatches and normalize the response of the microphones, but would not be as effective as re-calibrating the unit.

Dual Omnidirectional Microphone Array (DOMA)

A dual omnidirectional microphone array (DOMA) that provides improved noise suppression is described herein. Numerous systems and methods for calibrating the DOMA was described above. Compared to conventional arrays and algorithms, which seek to reduce noise by nulling out noise sources, the array of an embodiment is used to form two distinct virtual directional microphones which are configured to have very similar noise responses and very dissimilar speech responses. The only null formed by the DOMA is one used to remove the speech of the user from $V_2$. The two virtual microphones of an embodiment can be paired with an adaptive filter algorithm and/or VAD algorithm to significantly reduce the noise without distorting the speech, significantly improving the SNR of the desired speech over conventional noise suppression systems. The embodiments described herein are stable in operation, flexible with respect to virtual microphone pattern choice, and have proven to be robust with respect to speech source-to-array distance and orientation as well as temperature and calibration techniques. Numerous systems and methods for calibrating the DOMA was described above.

Figure 33:
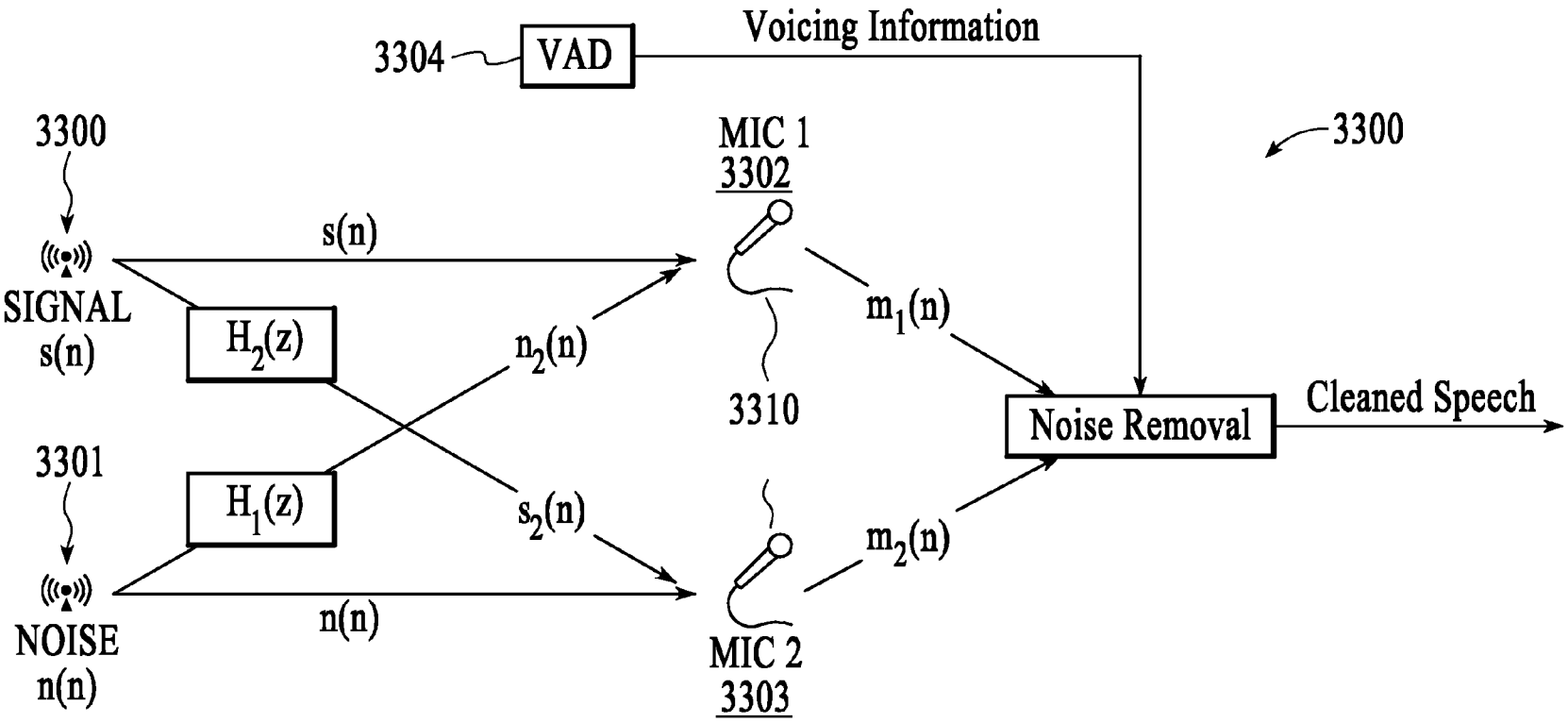
FIG. 33 is a two-microphone adaptive noise suppression system, under an embodiment.

FIG. 33 is a two-microphone adaptive noise suppression system 3300, under an embodiment. The two-microphone system 3300 including the combination of physical microphones MIC 1 and MIC 2 along with the processing or circuitry components to which the microphones couple (described in detail below, but not shown in this figure) is referred to herein as the dual omnidirectional microphone array (DOMA) 3310, but the embodiment is not so limited. Referring to FIG. 33, in analyzing the single noise source 3301 and the direct path to the microphones, the total acoustic information coming into MIC 1 (3302, which can be an physical or virtual microphone) is denoted by $m_1(n)$. The total acoustic information coming into MIC 2 (103, which can also be an physical or virtual microphone) is similarly labeled $m_2(n)$. In the z (digital frequency) domain, these are represented as $M_1(z)$ and $M_2(z)$. Then, $$M_1(z)=S(z)+N_2(z)$$

$$M_2(z)=N(z)+S_2(z)$$

with $$N_2(z)=N(z)H_1(z)$$

$$S_2(z)=S(z)H_2(z),$$

so that $$M_1(z)=S(z)+N(z)H_1(z)$$

$$M_2(z)=N(z)+S(z)H_2(z). \quad \text{Eq. 1}$$

This is the general case for all two microphone systems. Equation 1 has four unknowns and only two known relationships and therefore cannot be solved explicitly.

However, there is another way to solve for some of the unknowns in Equation 1. The analysis starts with an examination of the case where the speech is not being generated, that is, where a signal from the VAD subsystem 3304 (optional) equals zero. In this case, s(n)=S(z)=0, and Equation 1 reduces to $$M_{1N}(z)=N(z)H_1(z)$$

$$M_{2N}(z)=N(z),$$

where the N subscript on the M variables indicate that only noise is being received. This leads to $$M_{1N}(z) = M_{2N}(z)H_1(z) \quad \text{Eq. 2}$$

$$H_1(z) = \frac{M_{1N}(z)}{M_{2N}(z)}.$$

The function $H_1(z)$ can be calculated using any of the available system identification algorithms and the microphone outputs when the system is certain that only noise is being received. The calculation can be done adaptively, so that the system can react to changes in the noise.

A solution is now available for $H_1(z)$, one of the unknowns in Equation 1. The final unknown, $H_2(z)$, can be determined by using the instances where speech is being produced and the VAD equals one. When this is occurring, but the recent (perhaps less than 1 second) history of the microphones indicate low levels of noise, it can be assumed that n(s)=N(z)~0. Then Equation 1 reduces to $$M_{1S}(z)=S(z)$$

$$M_{2S}(z)=S(z)H_2(z),$$

which in turn leads to $$M_{2S}(z) = M_{1S}(z)H_2(z)$$

$$H_2(z) = \frac{M_{2S}(z)}{M_{1S}(z)},$$

which is the inverse of the $H_1(z)$ calculation. However, it is noted that different inputs are being used (now only the speech is occurring whereas before only the noise was occurring). While calculating $H_2(z)$, the values calculated for $H_1(z)$ are held constant (and vice versa) and it is assumed that the noise level is not high enough to cause errors in the $H_2(z)$ calculation.

After calculating $H_1(z)$ and $H_2(z)$, they are used to remove the noise from the signal. If Equation 1 is rewritten as $$S(z)=M_1(z)-N(z)H_1(z)$$

$$N(z)=M_2(z)-S(z)H_2(z)$$

$$S(z)=M_1(z)-[M_2(z)-S(z)H_2(z)]H_1(z)$$

$$S(z)[1-H_2(z)H_1(z)]=M_1(z)-M_2(z)H_1(z),$$

then N(z) may be substituted as shown to solve for S(z) as $$S(z) = \frac{M_1(z) - M_2(z)H_1(z)}{1 - H_1(z)H_2(z)}. \quad \text{Eq. 3}$$

If the transfer functions $H_1(z)$ and $H_2(z)$ can be described with sufficient accuracy, then the noise can be completely removed and the original signal recovered. This remains true without respect to the amplitude or spectral characteristics of the noise. If there is very little or no leakage from the speech source into $M_2$, then $H_2(z)\approx 0$ and Equation 3 reduces to $$S(z)\approx M_1(z)-M_2(z)H_1(z) \quad \text{Eq. 4}$$

Equation 4 is much simpler to implement and is very stable, assuming $H_1(z)$ is stable. However, if significant speech energy is in $M_2(z)$, devoicing can occur. In order to construct a well-performing system and use Equation 4, consideration is given to the following conditions:

R1. Availability of a perfect (or at least very good) VAD in noisy conditions

R2. Sufficiently accurate $H_1(z)$

R3. Very small (ideally zero) $H_2(z)$.

R4. During speech production, $H_1(z)$ cannot change substantially.

R5. During noise, $H_2(z)$ cannot change substantially.

Condition R1 is easy to satisfy if the SNR of the desired speech to the unwanted noise is high enough. "Enough" means different things depending on the method of VAD generation. If a VAD vibration sensor is used, as in Burnett U.S. Pat. No. 7,256,048, accurate VAD in very low SNRs (−10 dB or less) is possible. Acoustic-only methods using information from $O_1$ and $O_2$ can also return accurate VADs, but are limited to SNRs of ~3 dB or greater for adequate performance.

Condition R5 is normally simple to satisfy because for most applications the microphones will not change position with respect to the user's mouth very often or rapidly. In those applications where it may happen (such as hands-free conferencing systems) it can be satisfied by configuring Mic2 so that $H_2(z)\approx 0$.

Satisfying conditions R2, R3, and R4 are more difficult but are possible given the right combination of $V_1$ and $V_2$. Methods are examined below that have proven to be effective in satisfying the above, resulting in excellent noise suppression performance and minimal speech removal and distortion in an embodiment.

The DOMA, in various embodiments, can be used with the Pathfinder system as the adaptive filter system or noise removal. The Pathfinder system, available from AliphCom, San Francisco, Calif., is described in detail in other patents and patent applications referenced herein. Alternatively, any adaptive filter or noise removal algorithm can be used with the DOMA in one or more various alternative embodiments or configurations.

When the DOMA is used with the Pathfinder system, the Pathfinder system generally provides adaptive noise cancellation by combining the two microphone signals (e.g., Mic1, Mic2) by filtering and summing in the time domain. The adaptive filter generally uses the signal received from a first microphone of the DOMA to remove noise from the speech received from at least one other microphone of the DOMA, which relies on a slowly varying linear transfer function between the two microphones for sources of noise. Following processing of the two channels of the DOMA, an output signal is generated in which the noise content is attenuated with respect to the speech content, as described in detail below.

Figure 34:
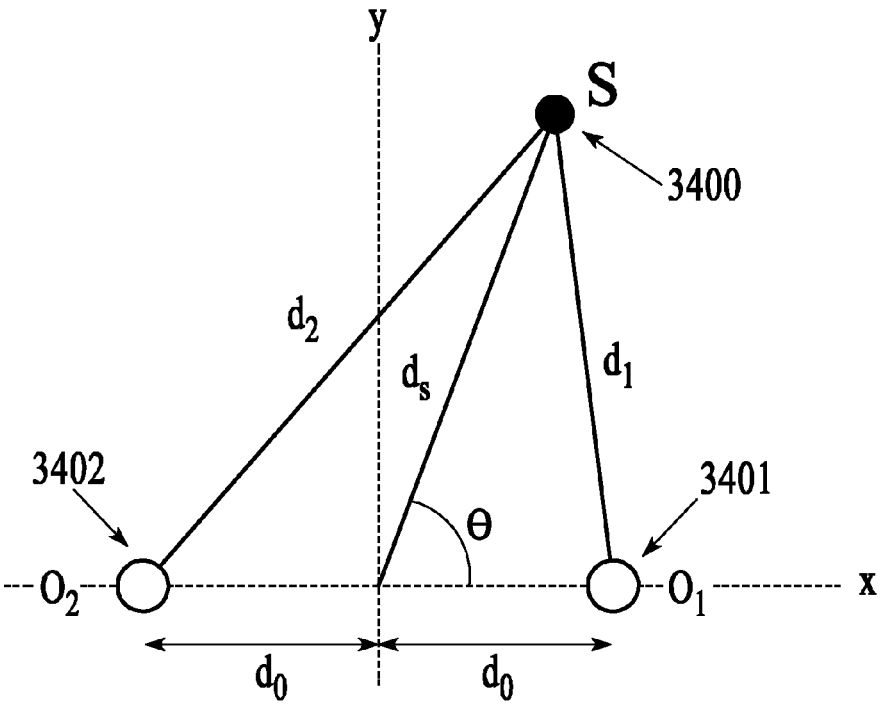
FIG. 34 is an array and speech source (S) configuration, under an embodiment. The microphones are separated by a distance approximately equal to $2d_0$, and the speech source is located a distance $d_s$ away from the midpoint of the array at an angle θ. The system is axially symmetric so only $d_s$ and θ need be specified.
Figure 35:
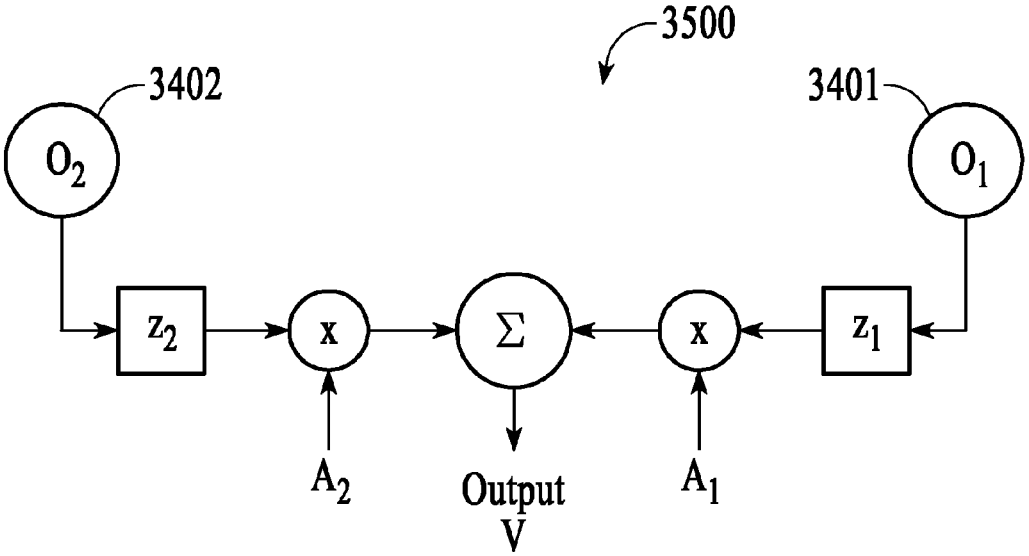
FIG. 35 is a block diagram for a first order gradient microphone using two omnidirectional elements $O_1$ and $O_2$, under an embodiment.

FIG. 34 is a generalized two-microphone array (DOMA) including an array 3401/3402 and speech source S configuration, under an embodiment. FIG. 35 is a system 3500 for generating or producing a first order gradient microphone V using two omnidirectional elements $O_1$ and $O_2$, under an embodiment. The array of an embodiment includes two physical microphones 3401 and 3402 (e.g., omnidirectional microphones) placed a distance $2d_0$ apart and a speech source 3400 is located a distance $d_s$ away at an angle of θ. This array is axially symmetric (at least in free space), so no other angle is needed. The output from each microphone 3401 and 3402 can be delayed ($z_1$ and $z_2$), multiplied by a gain ($A_1$ and $A_2$), and then summed with the other as demonstrated in FIG. 35. The output of the array is or forms at least one virtual microphone, as described in detail below. This operation can be over any frequency range desired. By varying the magnitude and sign of the delays and gains, a wide variety of virtual microphones (VMs), also referred to herein as virtual directional microphones, can be realized. There are other methods known to those skilled in the art for constructing VMs but this is a common one and will be used in the enablement below.

Figure 36:
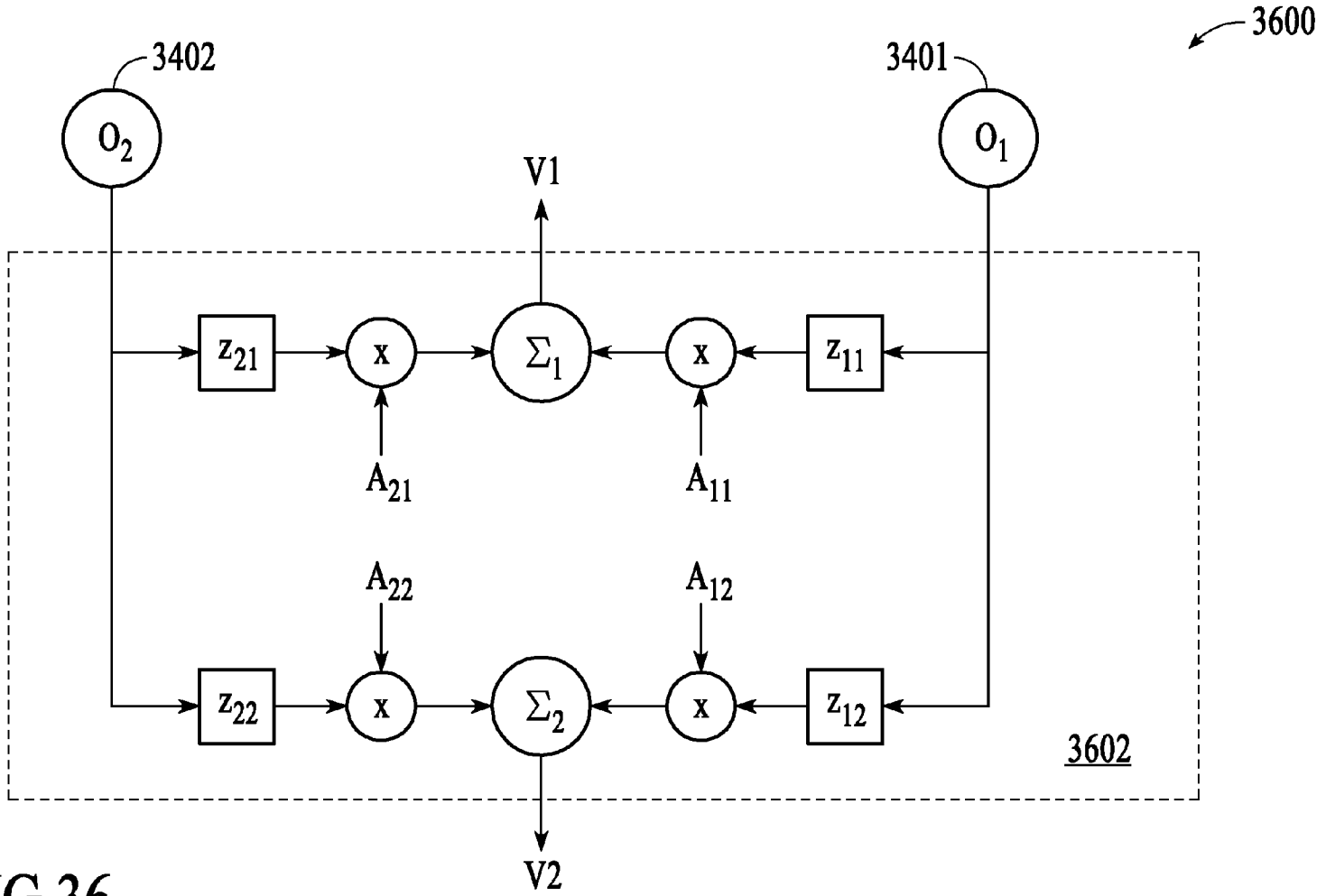
FIG. 36 is a block diagram for a DOMA including two physical microphones configured to form two virtual microphones $V_1$ and $V_2$, under an embodiment.

As an example, FIG. 36 is a block diagram for a DOMA 3600 including two physical microphones configured to form two virtual microphones $V_1$ and $V_2$, under an embodiment. The DOMA includes two first order gradient microphones $V_1$ and $V_2$ formed using the outputs of two microphones or elements $O_1$ and $O_2$ (3401 and 3402), under an embodiment. The DOMA of an embodiment includes two physical microphones 3401 and 3402 that are omnidirectional microphones, as described above with reference to FIGS. 34 and 35. The output from each microphone is coupled to a processing component 3602, or circuitry, and the processing component outputs signals representing or corresponding to the virtual microphones $V_1$ and $V_2$.

In this example system 3600, the output of physical microphone 3401 is coupled to processing component 3602 that includes a first processing path that includes application of a first delay $z_{11}$ and a first gain $A_{11}$ and a second processing path that includes application of a second delay $z_{12}$ and a second gain $A_{12}$. The output of physical microphone 3402 is coupled to a third processing path of the processing component 3602 that includes application of a third delay $z_{21}$ and a third gain $A_{21}$ and a fourth processing path that includes application of a fourth delay $z_{22}$ and a fourth gain $A_{22}$. The output of the first and third processing paths is summed to form virtual microphone $V_1$, and the output of the second and fourth processing paths is summed to form virtual microphone $V_2$.

Figure 37:
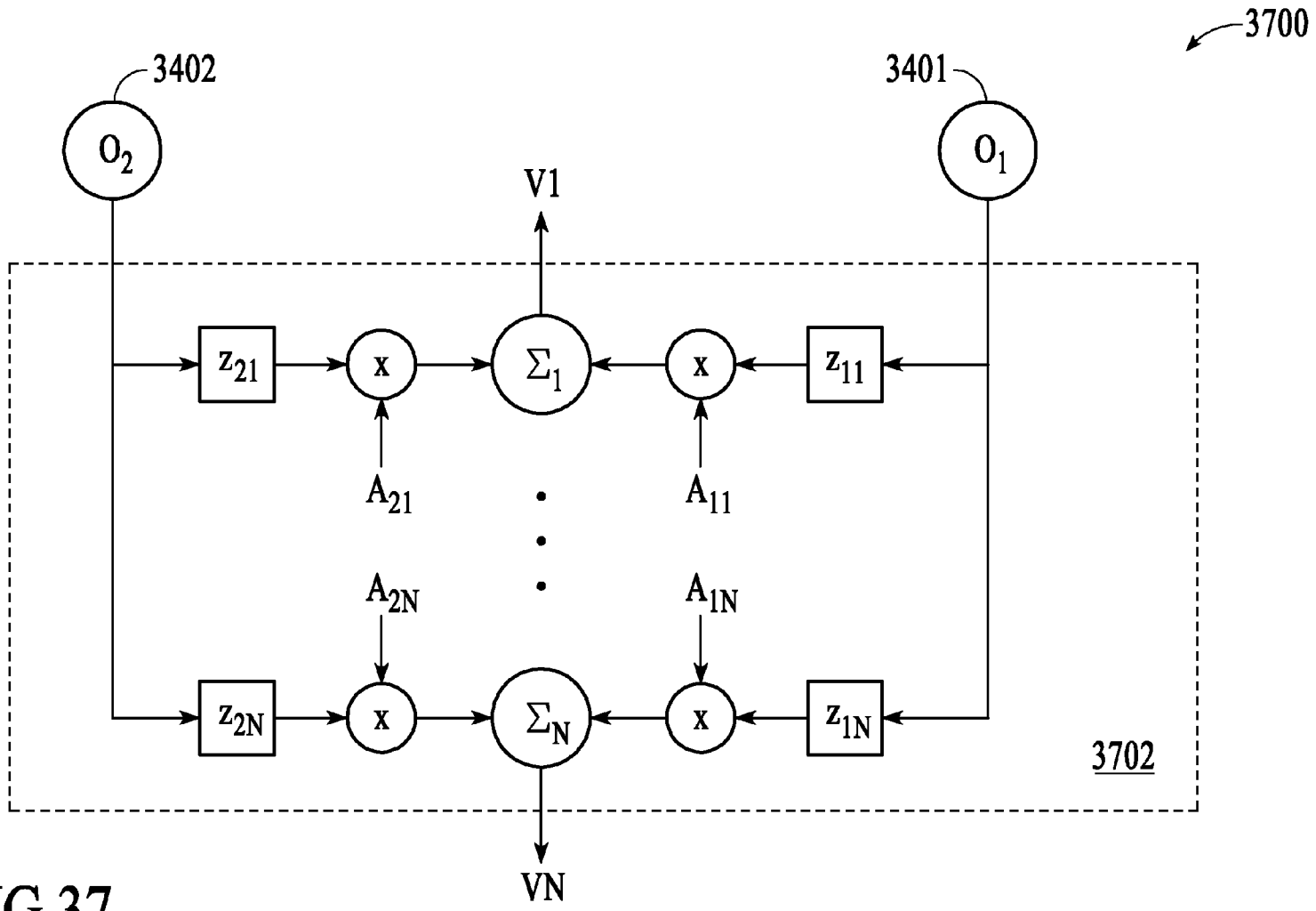
FIG. 37 is a block diagram for a DOMA including two physical microphones configured to form N virtual microphones $V_1$ through $V_N$, where N is any number greater than one, under an embodiment.

As described in detail below, varying the magnitude and sign of the delays and gains of the processing paths leads to a wide variety of virtual microphones (VMs), also referred to herein as virtual directional microphones, can be realized. While the processing component 3602 described in this example includes four processing paths generating two virtual microphones or microphone signals, the embodiment is not so limited. For example, FIG. 37 is a block diagram for a DOMA 3700 including two physical microphones configured to form N virtual microphones $V_1$ through $V_N$, where N is any number greater than one, under an embodiment. Thus, the DOMA can include a processing component 3702 having any number of processing paths as appropriate to form a number N of virtual microphones.

The DOMA of an embodiment can be coupled or connected to one or more remote devices. In a system configuration, the DOMA outputs signals to the remote devices. The remote devices include, but are not limited to, at least one of cellular telephones, satellite telephones, portable telephones, wireline telephones, Internet telephones, wireless transceivers, wireless communication radios, personal digital assistants (PDAs), personal computers (PCs), headset devices, head-worn devices, and earpieces.

Furthermore, the DOMA of an embodiment can be a component or subsystem integrated with a host device. In this system configuration, the DOMA outputs signals to components or subsystems of the host device. The host device includes, but is not limited to, at least one of cellular telephones, satellite telephones, portable telephones, wireline telephones, Internet telephones, wireless transceivers, wireless communication radios, personal digital assistants (PDAs), personal computers (PCs), headset devices, head-worn devices, and earpieces.

Figure 38:
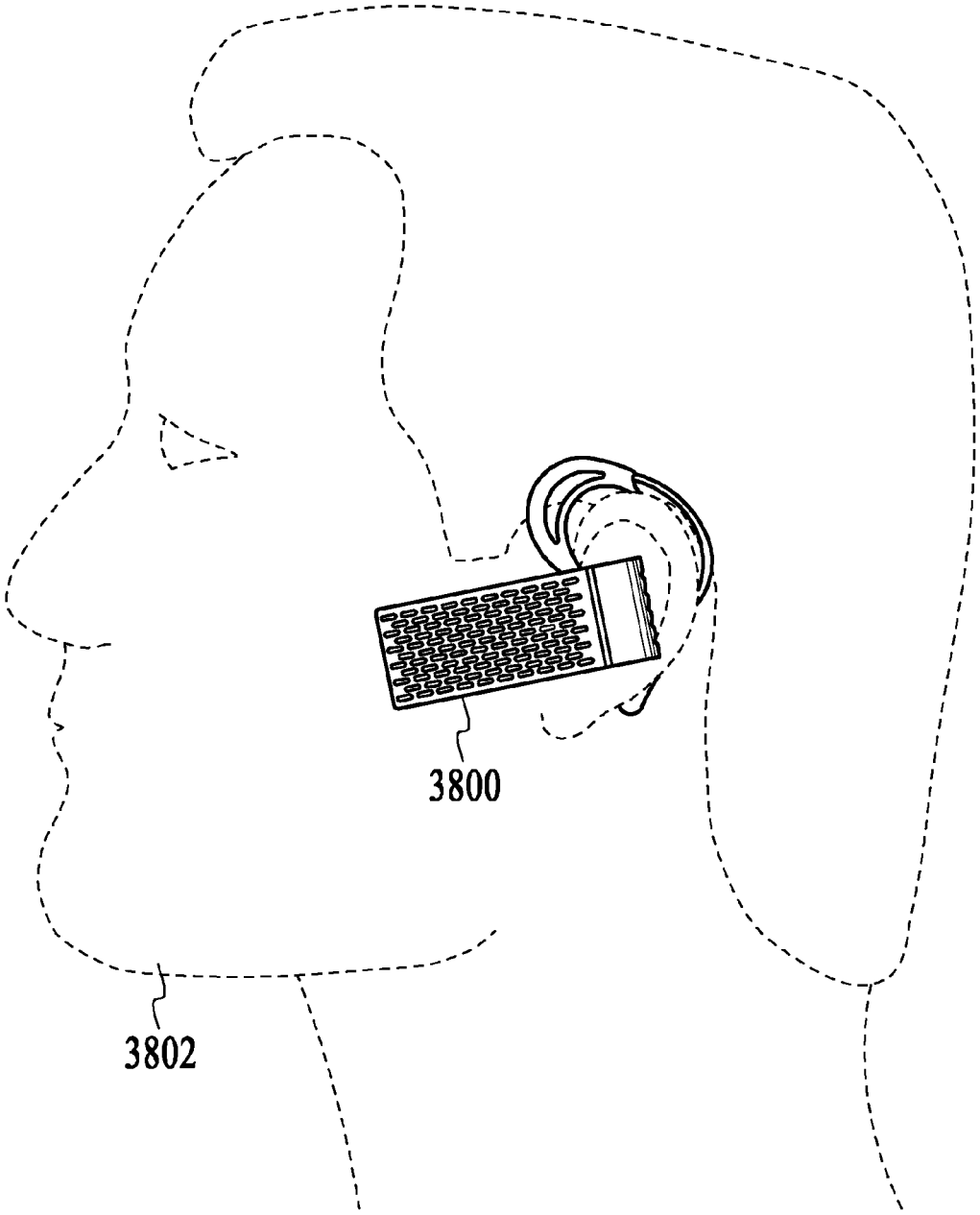
FIG. 38 is an example of a headset or head-worn device that includes the DOMA, as described herein, under an embodiment.

As an example, FIG. 38 is an example of a headset or head-worn device 3800 that includes the DOMA, as described herein, under an embodiment. The headset 3800 of an embodiment includes a housing having two areas or receptacles (not shown) that receive and hold two microphones (e.g., $O_1$ and $O_2$). The headset 3800 is generally a device that can be worn by a speaker 3802, for example, a headset or earpiece that positions or holds the microphones in the vicinity of the speaker's mouth. The headset 3800 of an embodiment places a first physical microphone (e.g., physical microphone $O_1$) in a vicinity of a speaker's lips. A second physical microphone (e.g., physical microphone $O_2$) is placed a distance behind the first physical microphone. The distance of an embodiment is in a range of a few centimeters behind the first physical microphone or as described herein (e.g., described with reference to FIGS. 33-37). The DOMA is symmetric and is used in the same configuration or manner as a single close-talk microphone, but is not so limited.

Figure 39:
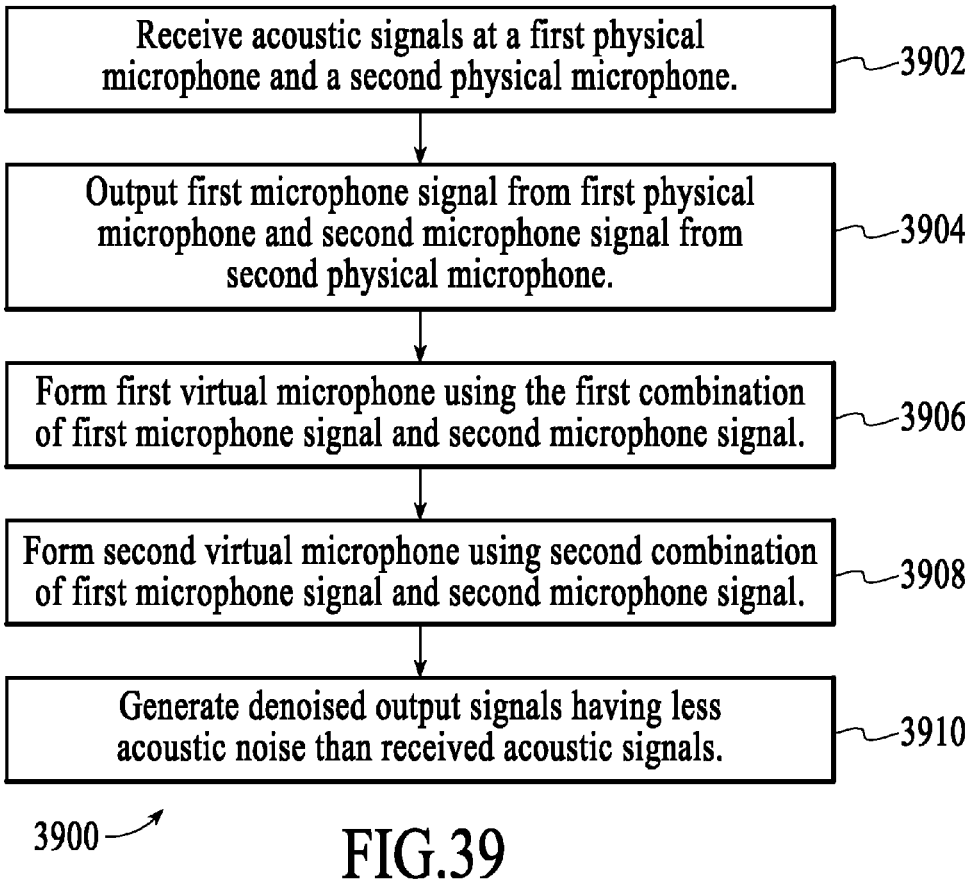
FIG. 39 is a flow diagram for denoising acoustic signals using the DOMA, under an embodiment.

FIG. 39 is a flow diagram for denoising 3900 acoustic signals using the DOMA, under an embodiment. The denoising 3900 begins by receiving 3902 acoustic signals at a first physical microphone and a second physical microphone. In response to the acoustic signals, a first microphone signal is output from the first physical microphone and a second microphone signal is output from the second physical microphone 3904. A first virtual microphone is formed 3906 by generating a first combination of the first microphone signal and the second microphone signal. A second virtual microphone is formed 3908 by generating a second combination of the first microphone signal and the second microphone signal, and the second combination is different from the first combination. The first virtual microphone and the second virtual microphone are distinct virtual directional microphones with substantially similar responses to noise and substantially dissimilar responses to speech. The denoising 3900 generates 3910 output signals by combining signals from the first virtual microphone and the second virtual microphone, and the output signals include less acoustic noise than the acoustic signals.

Figure 40:
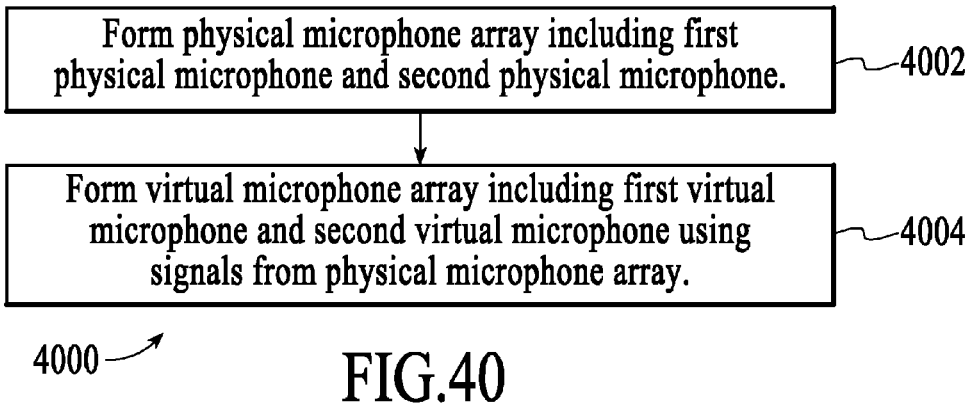
FIG. 40 is a flow diagram for forming the DOMA, under an embodiment.

FIG. 40 is a flow diagram for forming 4000 the DOMA, under an embodiment. Formation 4000 of the DOMA includes forming 4002 a physical microphone array including a first physical microphone and a second physical microphone. The first physical microphone outputs a first microphone signal and the second physical microphone outputs a second microphone signal. A virtual microphone array is formed 4004 comprising a first virtual microphone and a second virtual microphone. The first virtual microphone comprises a first combination of the first microphone signal and the second microphone signal. The second virtual microphone comprises a second combination of the first microphone signal and the second microphone signal, and the second combination is different from the first combination. The virtual microphone array including a single null oriented in a direction toward a source of speech of a human speaker.

The construction of VMs for the adaptive noise suppression system of an embodiment includes substantially similar noise response in $V_1$ and $V_2$. Substantially similar noise response as used herein means that $H_1(z)$ is simple to model and will not change much during speech, satisfying conditions R2 and R4 described above and allowing strong denoising and minimized bleedthrough.

The construction of VMs for the adaptive noise suppression system of an embodiment includes relatively small speech response for $V_2$. The relatively small speech response for $V_2$ means that $H_2(z)\approx 0$, which will satisfy conditions R3 and R5 described above.

The construction of VMs for the adaptive noise suppression system of an embodiment further includes sufficient speech response for $V_1$ so that the cleaned speech will have significantly higher SNR than the original speech captured by $O_1$.

The description that follows assumes that the responses of the omnidirectional microphones $O_1$ and $O_2$ to an identical acoustic source have been normalized so that they have exactly the same response (amplitude and phase) to that source. This can be accomplished using standard microphone array methods (such as frequency-based calibration) well known to those versed in the art.

Referring to the condition that construction of VMs for the adaptive noise suppression system of an embodiment includes relatively small speech response for $V_2$, it is seen that for discrete systems $V_2(z)$ can be represented as:

$$V_2(z) = O_2(z) - z^{-\gamma}\beta O_1(z)$$

$$\text{where } \beta = \frac{d_1}{d_2}$$

$$\gamma = \frac{d_2 - d_1}{c} \cdot f_s \text{ (samples)}$$

$$d_1 = \sqrt{d_s^2 - 2d_s d_0 \cos(\theta) + d_0^2}$$

$$d_2 = \sqrt{d_s^2 + 2d_s d_0 \cos(\theta) + d_0^2}$$

The distances $d_1$ and $d_2$ are the distance from $O_1$ and $O_2$ to the speech source (see FIG. 34), respectively, and $\gamma$ is their difference divided by c, the speed of sound, and multiplied by the sampling frequency $f_s$. Thus $\gamma$ is in samples, but need not be an integer. For non-integer $\gamma$, fractional-delay filters (well known to those versed in the art) may be used.

It is important to note that the $\beta$ above is not the conventional $\beta$ used to denote the mixing of VMs in adaptive beamforming; it is a physical variable of the system that depends on the intra-microphone distance $d_0$ (which is fixed) and the distance $d_s$ and angle $\theta$, which can vary. As shown below, for properly calibrated microphones, it is not necessary for the system to be programmed with the exact $\beta$ of the array. Errors of approximately 10-15% in the actual $\beta$ (i.e. the $\beta$ used by the algorithm is not the $\beta$ of the physical array) have been used with very little degradation in quality. The algorithmic value of $\beta$ may be calculated and set for a particular user or may be calculated adaptively during speech production when little or no noise is present. However, adaptation during use is not required for nominal performance.

Figure 41:
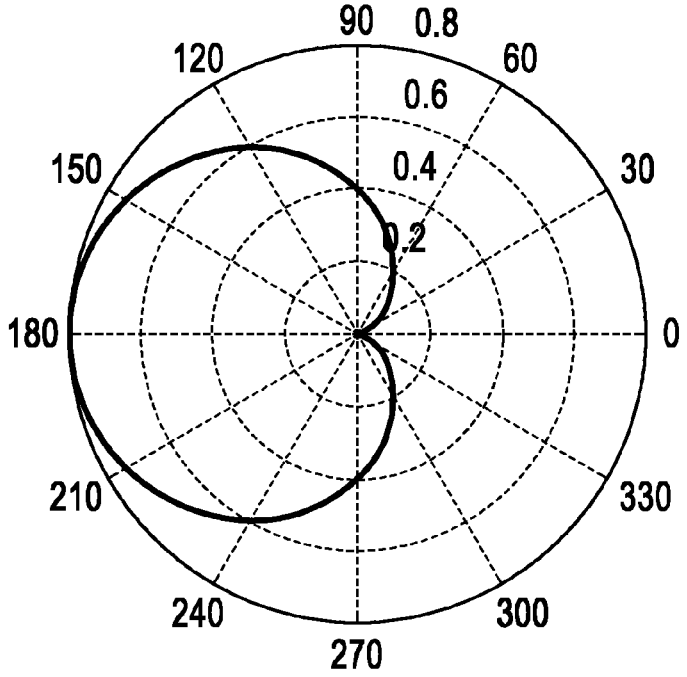
FIG. 41 is a plot of linear response of virtual microphone $V_2$ to a 1 kHz speech source at a distance of 0.1 m, under an embodiment. The null is at 0 degrees, where the speech is normally located.
Figure 42:
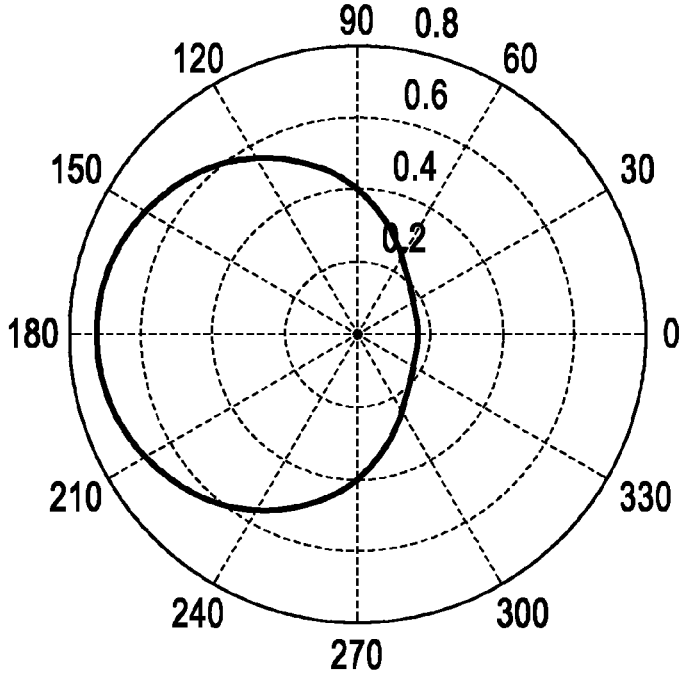
FIG. 42 is a plot of linear response of virtual microphone $V_2$ to a 1 kHz noise source at a distance of 1.0 m, under an embodiment. There is no null and all noise sources are detected.

FIG. 41 is a plot of linear response of virtual microphone $V_2$ with $\beta$=0.8 to a 1 kHz speech source at a distance of 0.1 m, under an embodiment. The null in the linear response of virtual microphone $V_2$ to speech is located at 0 degrees, where the speech is typically expected to be located. FIG. 42 is a plot of linear response of virtual microphone $V_2$ with $\beta$=0.8 to a 1 kHz noise source at a distance of 1.0 m, under an embodiment. The linear response of $V_2$ to noise is devoid of or includes no null, meaning all noise sources are detected.

The above formulation for $V_2(z)$ has a null at the speech location and will therefore exhibit minimal response to the speech. This is shown in FIG. 41 for an array with $d_0$=10.7 mm and a speech source on the axis of the array ($\theta$=0) at 10 cm ($\beta$=0.8). Note that the speech null at zero degrees is not present for noise in the far field for the same microphone, as shown in FIG. 42 with a noise source distance of approximately 1 meter. This insures that noise in front of the user will be detected so that it can be removed. This differs from conventional systems that can have difficulty removing noise in the direction of the mouth of the user.

The $V_1(z)$ can be formulated using the general form for $V_1(z)$:

$$V_1(z)=\alpha_A O_1(z)\cdot z^{-d_A}-\alpha_B O_2(z)\cdot z^{-d_B}$$

Since $$V_2(z)=O_2(z)-z^{-\gamma}\beta O_1(z)$$

and, since for noise in the forward direction $$O_{2N}(z)=O_{1N}(z)\cdot z^{-\gamma},$$

then $$V_{2N}(z)=O_{1N}(z)\cdot z^{-\gamma}-z^{-\gamma}\beta O_{1N}(z)$$

$$V_{2N}(z)=(1-\beta)(O_{1N}(z)\cdot z^{-\gamma})$$

If this is then set equal to $V_1(z)$ above, the result is $$V_{1N}(z)=\alpha_A O_{1N}(z)\cdot z^{-d_A}-\alpha_B O_{1N}(z)\cdot z^{-\gamma}\cdot z^{-d_B}=(1-\beta)(O_{1N}(z)\cdot z^{-\gamma})$$

thus the following may be set $d_A=\gamma$
$d_B=0$
$\alpha_A=1$
$\alpha_B=\beta$ to get $$V_1(z)=O_1(z)\cdot z^{-\gamma}-\beta O_2(z)$$

The definitions for $V_1$ and $V_2$ above mean that for noise $H_1(z)$ is:

$$H_1(z)=\frac{V_1(z)}{V_2(z)}=\frac{-\beta O_2(z)+O_1(z)\cdot z^{-\gamma}}{O_2(z)-z^{-\gamma}\beta O_1(z)}$$

which, if the amplitude noise responses are about the same, has the form of an allpass filter. This has the advantage of being easily and accurately modeled, especially in magnitude response, satisfying R2.

This formulation assures that the noise response will be as similar as possible and that the speech response will be proportional to $(1-\beta^2)$. Since $\beta$ is the ratio of the distances from $O_1$ and $O_2$ to the speech source, it is affected by the size of the array and the distance from the array to the speech source.

Figure 43:
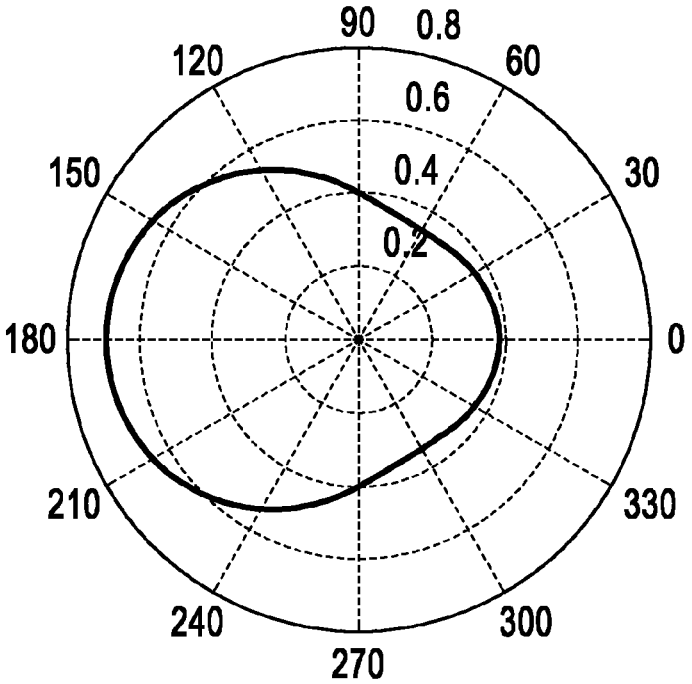
FIG. 43 is a plot of linear response of virtual microphone $V_1$ to a 1 kHz speech source at a distance of 0.1 m, under an embodiment. There is no null and the response for speech is greater than that shown in FIG. 9.

FIG. 43 is a plot of linear response of virtual microphone $V_1$ with $\beta$=0.8 to a 1 kHz speech source at a distance of 0.1 m, under an embodiment. The linear response of virtual microphone $V_1$ to speech is devoid of or includes no null and the response for speech is greater than that shown in FIG. 4.

Figure 44:
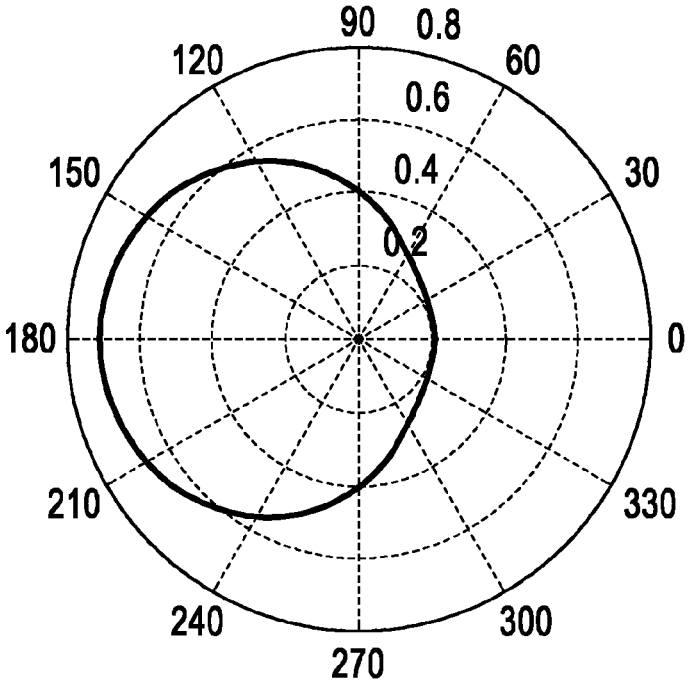
FIG. 44 is a plot of linear response of virtual microphone $V_1$ to a 1 kHz noise source at a distance of 1.0 m, under an embodiment. There is no null and the response is very similar to $V_2$ shown in FIG. 10.

FIG. 44 is a plot of linear response of virtual microphone $V_1$ with $\beta$=0.8 to a 1 kHz noise source at a distance of 1.0 m, under an embodiment. The linear response of virtual microphone $V_1$ to noise is devoid of or includes no null and the response is very similar to $V_2$ shown in FIG. 5.

Figure 45:
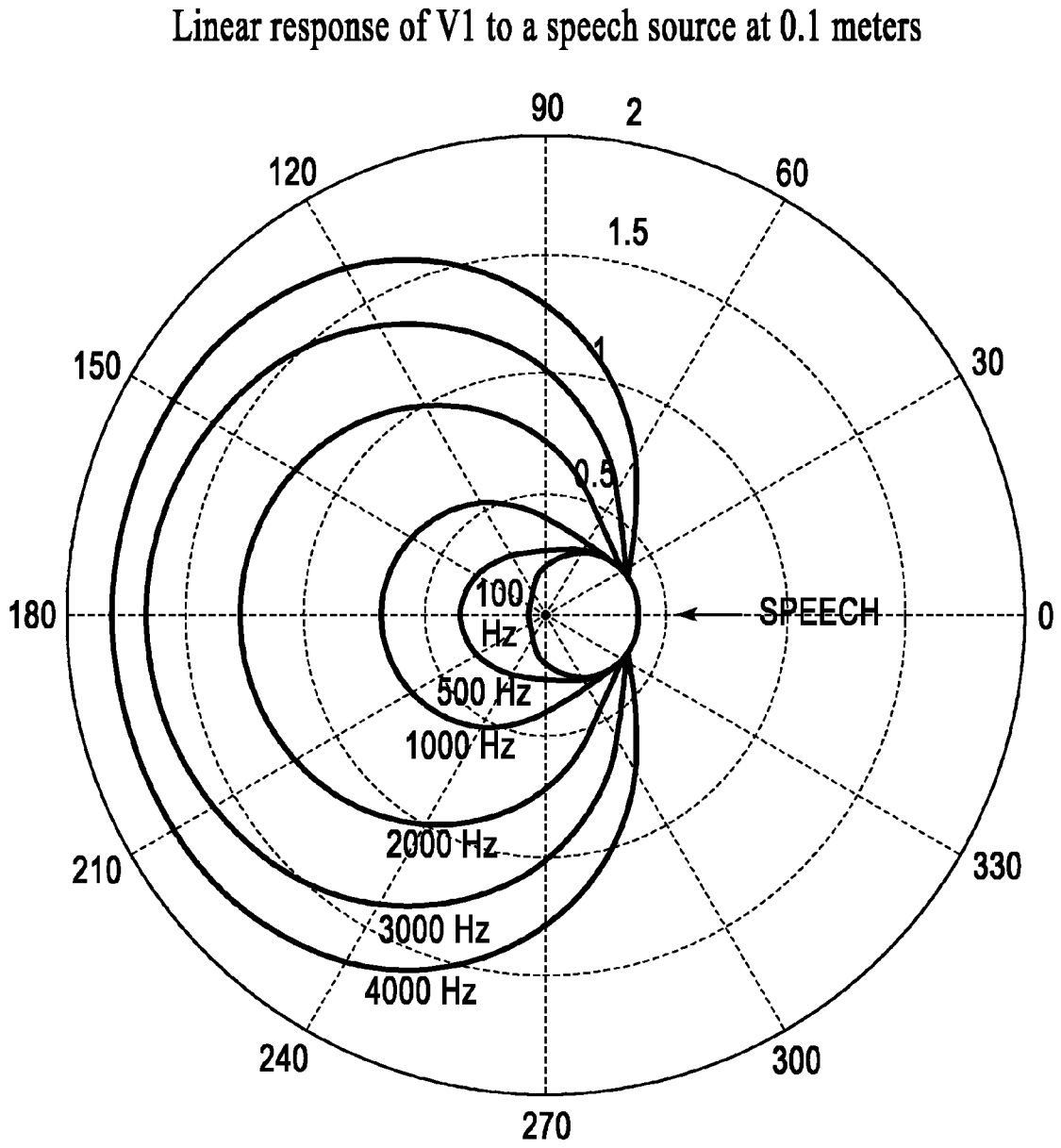
FIG. 45 is a plot of linear response of virtual microphone $V_1$ to a speech source at a distance of 0.1 m for frequencies of 100, 500, 1000, 2000, 3000, and 4000 Hz, under an embodiment.
Figure 46:
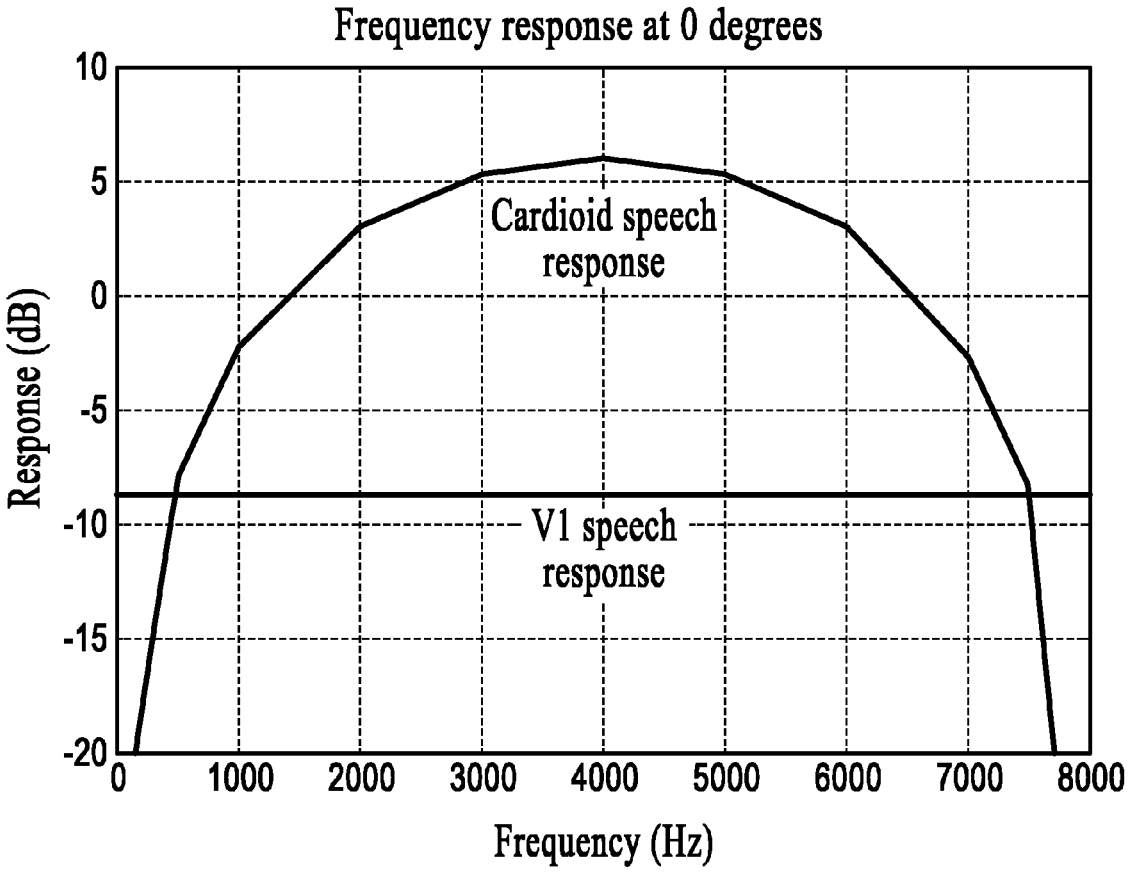
FIG. 46 is a plot showing comparison of frequency responses for speech for the array of an embodiment and for a conventional cardioid microphone.

FIG. 45 is a plot of linear response of virtual microphone $V_1$ with $\beta$=0.8 to a speech source at a distance of 0.1 m for frequencies of 100, 500, 1000, 2000, 3000, and 4000 Hz, under an embodiment. FIG. 46 is a plot showing comparison of frequency responses for speech for the array of an embodiment and for a conventional cardioid microphone.

The response of $V_1$ to speech is shown in FIG. 43, and the response to noise in FIG. 44. Note the difference in speech response compared to $V_2$ shown in FIG. 9 and the similarity of noise response shown in FIG. 42. Also note that the orientation of the speech response for $V_1$ shown in FIG. 43 is completely opposite the orientation of conventional systems, where the main lobe of response is normally oriented toward the speech source. The orientation of an embodiment, in which the main lobe of the speech response of $V_1$ is oriented away from the speech source, means that the speech sensitivity of $V_1$ is lower than a normal directional microphone but is flat for all frequencies within approximately +−30 degrees of the axis of the array, as shown in FIG. 45. This flatness of response for speech means that no shaping postfilter is needed to restore omnidirectional frequency response. This does come at a price—as shown in FIG. 46, which shows the speech response of $V_1$ with $\beta$=0.8 and the speech response of a cardioid microphone. The speech response of $V_1$ is approximately 0 to ~13 dB less than a normal directional microphone between approximately 500 and 7500 Hz and approximately 0 to 10+ dB greater than a directional microphone below approximately 500 Hz and above 7500 Hz for a sampling frequency of approximately 16000 Hz. However, the superior noise suppression made possible using this system more than compensates for the initially poorer SNR.

It should be noted that FIGS. 41-44 assume the speech is located at approximately 0 degrees and approximately 10 cm, $\beta$=0.8, and the noise at all angles is located approximately 1.0 meter away from the midpoint of the array. Generally, the noise distance is not required to be 1 m or more, but the denoising is the best for those distances. For distances less than approximately 1 m, denoising will not be as effective due to the greater dissimilarity in the noise responses of $V_1$ and $V_2$. This has not proven to be an impediment in practical use—in fact, it can be seen as a feature. Any "noise" source that is ~10 cm away from the earpiece is likely to be desired to be captured and transmitted.

The speech null of $V_2$ means that the VAD signal is no longer a critical component. The VAD's purpose was to ensure that the system would not train on speech and then subsequently remove it, resulting in speech distortion. If, however, $V_2$ contains no speech, the adaptive system cannot train on the speech and cannot remove it. As a result, the system can denoise all the time without fear of devoicing, and the resulting clean audio can then be used to generate a VAD signal for use in subsequent single-channel noise suppression algorithms such as spectral subtraction. In addition, constraints on the absolute value of $H_1(z)$ (i.e. restricting it to absolute values less than two) can keep the system from fully training on speech even if it is detected. In reality, though, speech can be present due to a mis-located $V_2$ null and/or echoes or other phenomena, and a VAD sensor or other acoustic-only VAD is recommended to minimize speech distortion.

Depending on the application, β and γ may be fixed in the noise suppression algorithm or they can be estimated when the algorithm indicates that speech production is taking place in the presence of little or no noise. In either case, there may be an error in the estimate of the actual β and γ of the system. The following description examines these errors and their effect on the performance of the system. As above, "good performance" of the system indicates that there is sufficient denoising and minimal devoicing.

The effect of an incorrect β and γ on the response of $V_1$ and $V_2$ can be seen by examining the definitions above:

$$V_1(z)=O_1(z)\cdot z^{-\gamma_T}-\beta_T O_2(z)$$

$$V_2(z)=O_2(z)-z^{-\gamma_T}\beta_T O_1(z)$$

where $\beta_T$ and $\gamma_T$ denote the theoretical estimates of β and γ used in the noise suppression algorithm. In reality, the speech response of $O_2$ is $$O_{2S}(z)=\beta_R O_{1S}(z)\cdot z^{-\gamma_R}$$

where $\beta_R$ and $\gamma_R$ denote the real β and γ of the physical system. The differences between the theoretical and actual values of β and γ can be due to mis-location of the speech source (it is not where it is assumed to be) and/or a change in air temperature (which changes the speed of sound). Inserting the actual response of $O_2$ for speech into the above equations for $V_1$ and $V_2$ yields $$V_{1S}(z)=O_{1S}(z)[z^{-\gamma_T}-\beta_T\beta_R z^{-\gamma_R}]$$

$$V_{2S}(z)=O_{1S}(z)[\beta_R z^{-\gamma_R}-\beta_T z^{-\gamma_T}]$$

If the difference in phase is represented by $$\gamma_R=\gamma_T+\gamma_D$$

And the difference in amplitude as $$\beta_R=B\beta_T$$

then $$V_{1S}(z)=O_{1S}(z)z^{-\gamma_T}[1-B\beta_T^2 z^{-\gamma_D}]$$

$$V_{2S}(z)=\beta_T O_{1S}(z)z^{-\gamma_T}[Bz^{-\gamma_D}-1] \qquad \text{Eq. 5}$$

Figure 47:
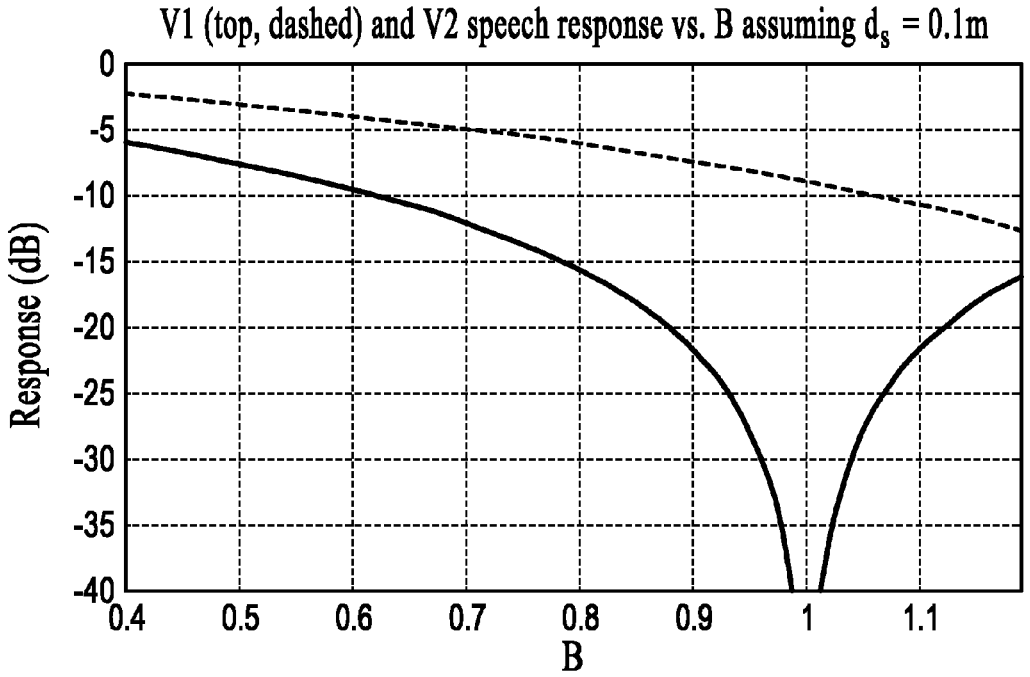
FIG. 47 is a plot showing speech response for $V_1$ (top, dashed) and $V_2$ (bottom, solid) versus B with $d_s$ assumed to be 0.1 m, under an embodiment. The spatial null in $V_2$ is relatively broad.
Figure 48:
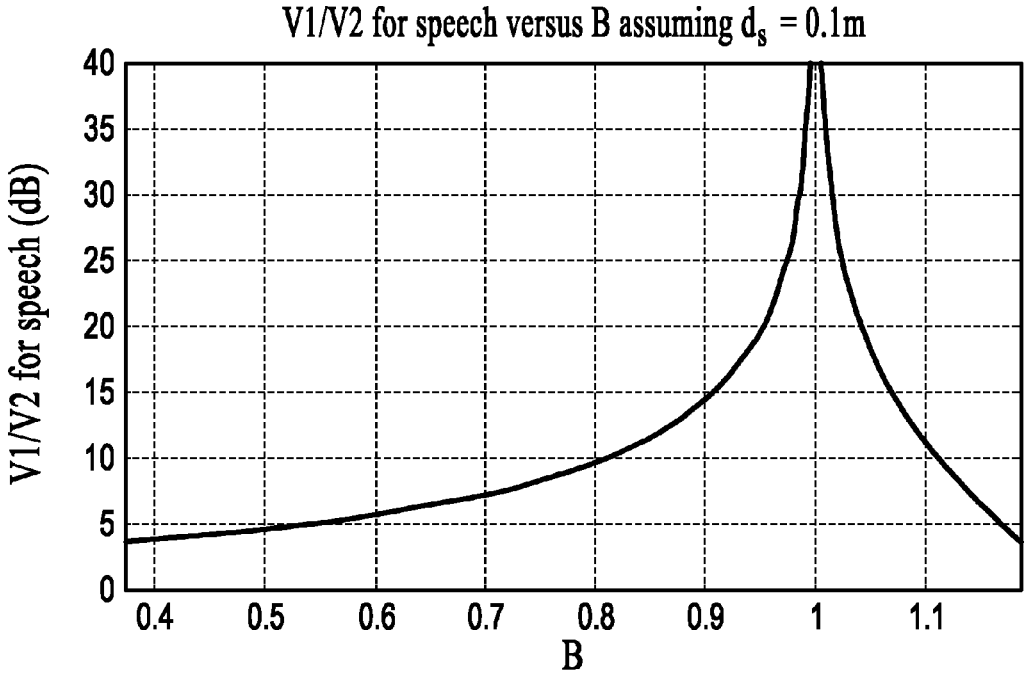
FIG. 48 is a plot showing a ratio of $V_1/V_2$ speech responses shown in FIG. 10 versus B, under an embodiment. The ratio is above 10 dB for all $0.8<B<1.1$. This means that the physical β of the system need not be exactly modeled for good performance.
Figure 49:
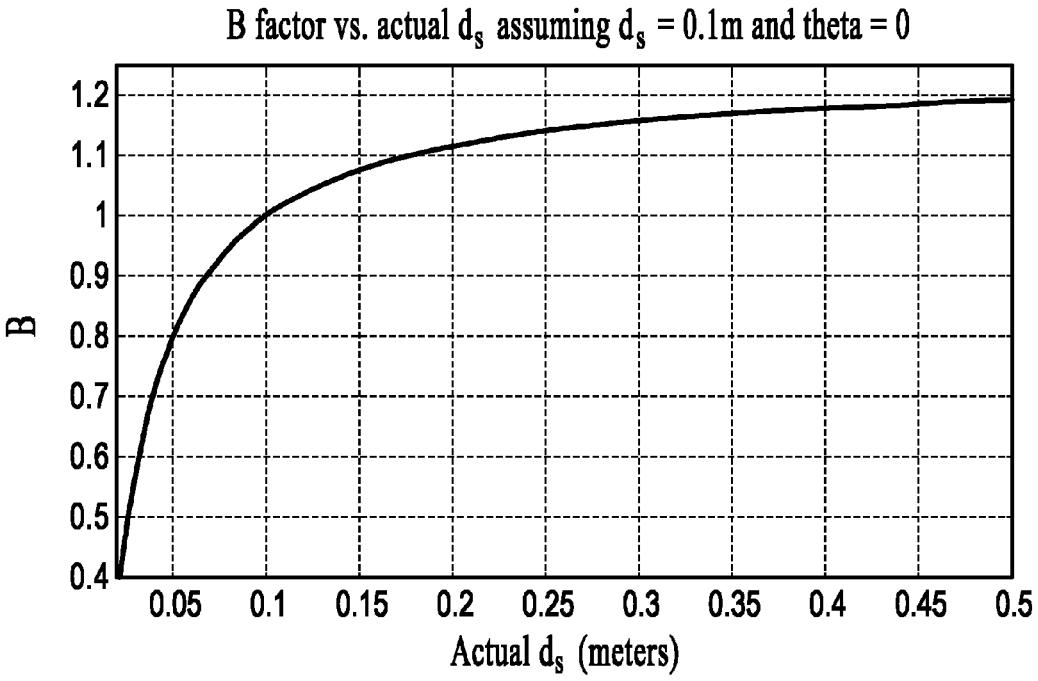
FIG. 49 is a plot of B versus actual $d_s$ assuming that $d_s=10$ cm and theta=0, under an embodiment.
Figure 50:
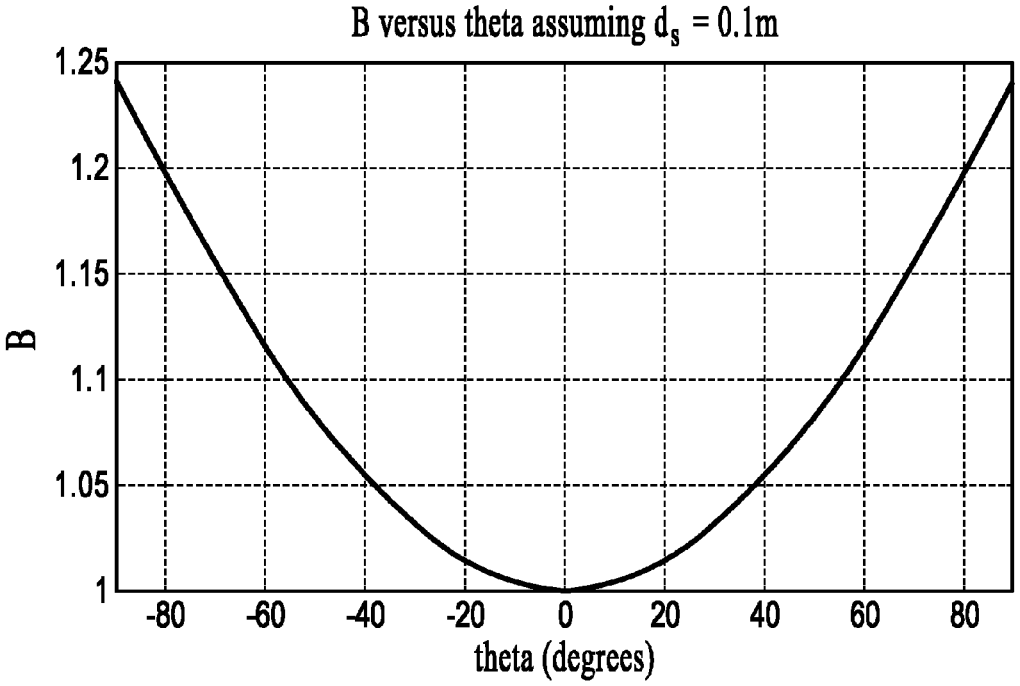
FIG. 50 is a plot of B versus theta with $d_s=10$ cm and assuming $d_s=10$ cm, under an embodiment.

The speech cancellation in $V_2$ (which directly affects the degree of devoicing) and the speech response of $V_1$ will be dependent on both B and D. An examination of the case where D=0 follows. FIG. 47 is a plot showing speech response for $V_1$ (top, dashed) and $V_2$ (bottom, solid) versus B with $d_s$ assumed to be 0.1 m, under an embodiment. This plot shows the spatial null in $V_2$ to be relatively broad. FIG. 48 is a plot showing a ratio of $V_1/V_2$ speech responses shown in FIG. 42 versus B, under an embodiment. The ratio of $V_1/V_2$ is above 10 dB for all 0.8<B<1.1, and this means that the physical β of the system need not be exactly modeled for good performance. FIG. 49 is a plot of B versus actual $d_s$ assuming that $d_s$=10 cm and theta=0, under an embodiment. FIG. 50 is a plot of B versus theta with $d_s$=10 cm and assuming $d_s$=10 cm, under an embodiment.

In FIG. 47, the speech response for $V_1$ (upper, dashed) and $V_2$ (lower, solid) compared to $O_1$ is shown versus B when $d_s$ is thought to be approximately 10 cm and θ=0. When B=1, the speech is absent from $V_2$. In FIG. 48, the ratio of the speech responses in FIG. 42 is shown. When 0.8<B<1.1, the $V_1/V_2$ ratio is above approximately 10 dB—enough for good performance. Clearly, if D=0, B can vary significantly without adversely affecting the performance of the system. Again, this assumes that calibration of the microphones so that both their amplitude and phase response is the same for an identical source has been performed.

The B factor can be non-unity for a variety of reasons. Either the distance to the speech source or the relative orientation of the array axis and the speech source or both can be different than expected. If both distance and angle mismatches are included for B, then $$B=\frac{\beta_R}{\beta_T}\frac{\sqrt{d_{SR}^2-2d_{SR}d_0\cos(\theta_R)+d_0^2}}{\sqrt{d_{SR}^2+2d_{SR}d_0\cos(\theta_R)+d_0^2}}\cdot\frac{\sqrt{d_{ST}^2+2d_{ST}d_0\cos(\theta_T)+d_0^2}}{\sqrt{d_{ST}^2-2d_{ST}d_0\cos(\theta_T)+d_0^2}}$$

where again the T subscripts indicate the theorized values and R the actual values. In FIG. 49, the factor B is plotted with respect to the actual $d_s$ with the assumption that $d_s$=10 cm and θ=0. So, if the speech source in on-axis of the array, the actual distance can vary from approximately 5 cm to 18 cm without significantly affecting performance—a significant amount. Similarly, FIG. 50 shows what happens if the speech source is located at a distance of approximately 10 cm but not on the axis of the array. In this case, the angle can vary up to approximately +−55 degrees and still result in a B less than 1.1, assuring good performance. This is a significant amount of allowable angular deviation. If there is both angular and distance errors, the equation above may be used to determine if the deviations will result in adequate performance. Of course, if the value for $\beta_T$ is allowed to update during speech, essentially tracking the speech source, then B can be kept near unity for almost all configurations.

An examination follows of the case where B is unity but D is nonzero. This can happen if the speech source is not where it is thought to be or if the speed of sound is different from what it is believed to be. From Equation 5 above, it can be sees that the factor that weakens the speech null in $V_2$ for speech is $$N(z)=Bz^{-\gamma_D}-1$$

or in the continuous domain $$N(s)=Be^{-Ds}-1.$$

Figure 51:
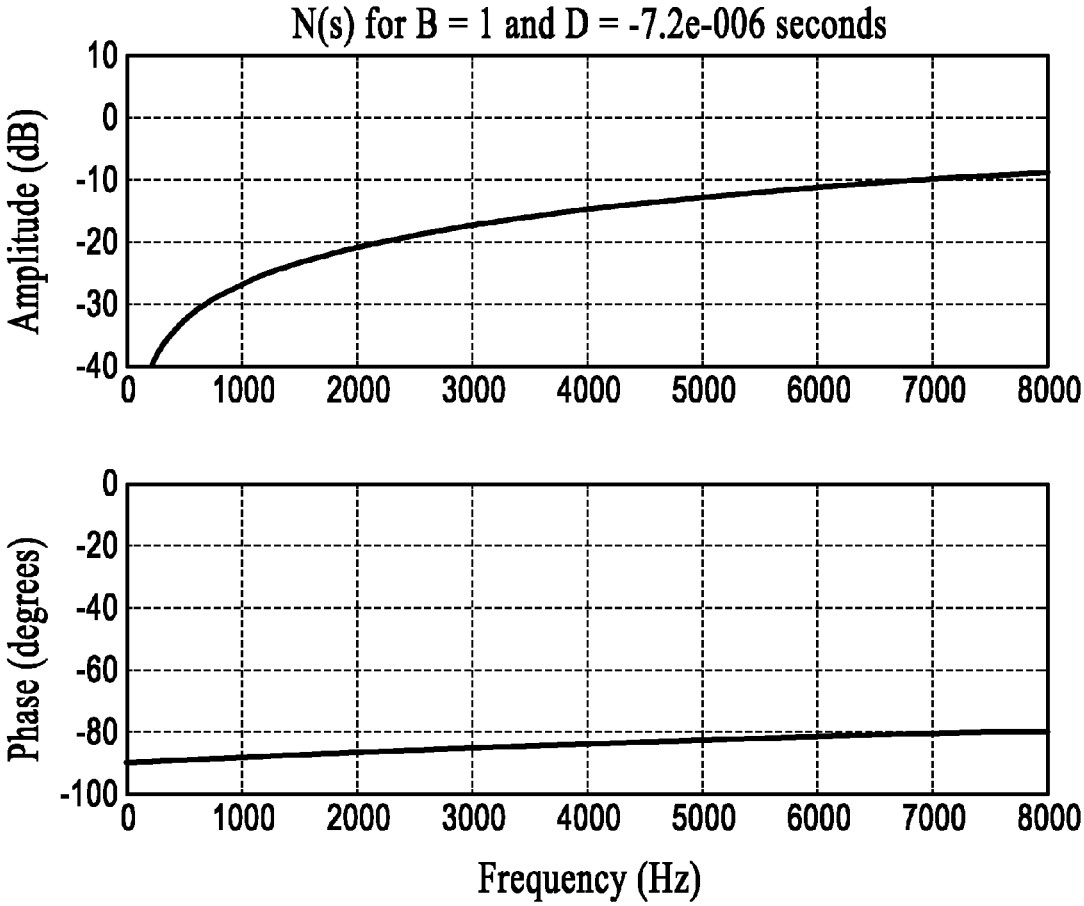
FIG. 51 is a plot of amplitude (top) and phase (bottom) response of N(s) with B=1 and D=−7.2 μsec, under an embodiment. The resulting phase difference clearly affects high frequencies more than low.

Since γ is the time difference between arrival of speech at $V_1$ compared to $V_2$, it can be errors in estimation of the angular location of the speech source with respect to the axis of the array and/or by temperature changes. Examining the temperature sensitivity, the speed of sound varies with temperature as $$c=331.3+(0.606T)\text{m/s}$$

where T is degrees Celsius. As the temperature decreases, the speed of sound also decreases. Setting 20 C as a design temperature and a maximum expected temperature range to −40 C to +60 C (−40 F to 140 F). The design speed of sound at 20 C is 343 m/s and the slowest speed of sound will be 307 m/s at −40 C with the fastest speed of sound 362 m/s at 60 C. Set the array length ($2d_0$) to be 21 mm. For speech sources on the axis of the array, the difference in travel time for the largest change in the speed of sound is $$\nabla t_{MAX} = \frac{d}{c_1} - \frac{d}{c_2} = 0.021\text{ m}\left(\frac{1}{343\text{ m/s}} - \frac{1}{307\text{ m/s}}\right) = -7.2\times10^{-6}\text{ sec}$$

or approximately 7 microseconds. The response for N(s) given B=1 and D=7.2 μsec is shown in FIG. 51. FIG. 51 is a plot of amplitude (top) and phase (bottom) response of N(s) with B=1 and D=−7.2 μsec, under an embodiment. The resulting phase difference clearly affects high frequencies more than low. The amplitude response is less than approximately −10 dB for all frequencies less than 7 kHz and is only about −9 dB at 8 kHz. Therefore, assuming B=1, this system would likely perform well at frequencies up to approximately 8 kHz. This means that a properly compensated system would work well even up to 8 kHz in an exceptionally wide (e.g., −40 C to 80 C) temperature range. Note that the phase mismatch due to the delay estimation error causes N(s) to be much larger at high frequencies compared to low.

Figure 52:
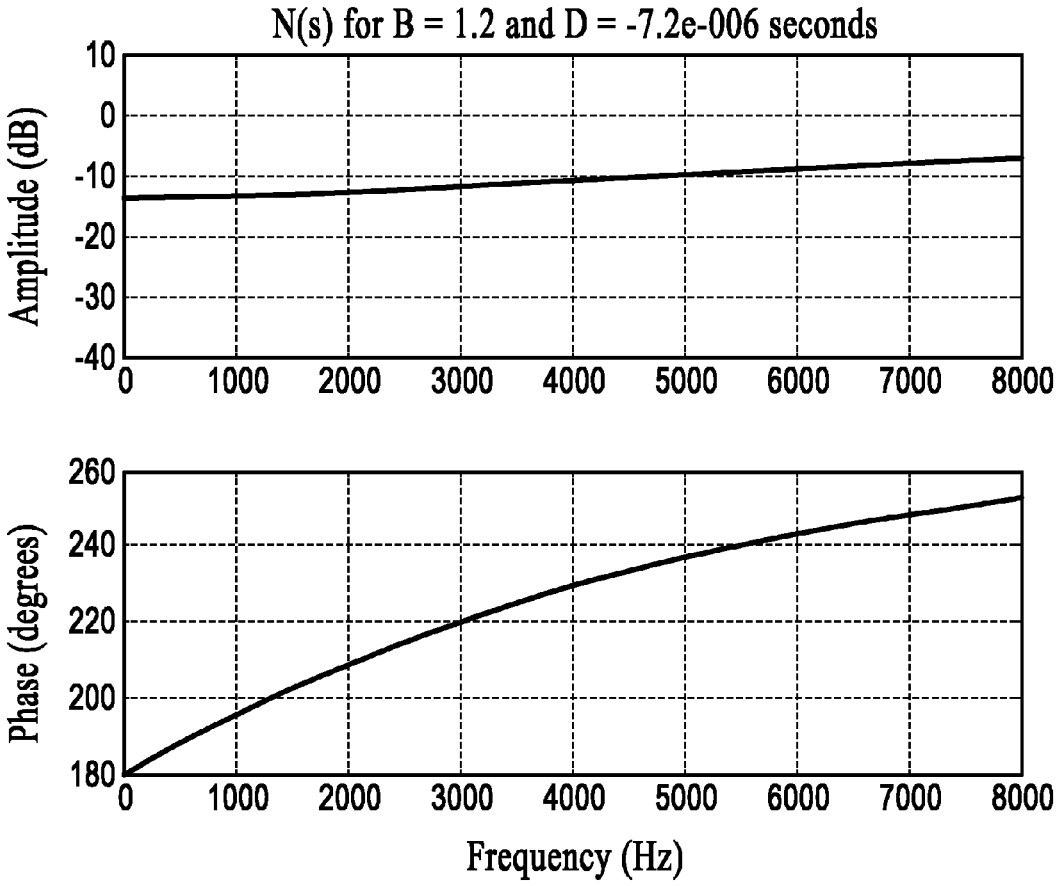
FIG. 52 is a plot of amplitude (top) and phase (bottom) response of N(s) with B=1.2 and D=−7.2 μsec, under an embodiment. Non-unity B affects the entire frequency range.

If B is not unity, the robustness of the system is reduced since the effect from non-unity B is cumulative with that of non-zero D. FIG. 52 shows the amplitude and phase response for B=1.2 and D=7.2 μsec. FIG. 52 is a plot of amplitude (top) and phase (bottom) response of N(s) with B=1.2 and D=−7.2 μsec, under an embodiment. Non-unity B affects the entire frequency range. Now N(s) is below approximately −10 dB only for frequencies less than approximately 5 kHz and the response at low frequencies is much larger. Such a system would still perform well below 5 kHz and would only suffer from slightly elevated devoicing for frequencies above 5 kHz. For ultimate performance, a temperature sensor may be integrated into the system to allow the algorithm to adjust $\gamma_T$ as the temperature varies.

Another way in which D can be non-zero is when the speech source is not where it is believed to be—specifically, the angle from the axis of the array to the speech source is incorrect. The distance to the source may be incorrect as well, but that introduces an error in B, not D.

Referring to FIG. 34, it can be seen that for two speech sources (each with their own $d_s$ and θ) that the time difference between the arrival of the speech at $O_1$ and the arrival at $O_2$ is $$\Delta t = \frac{1}{c}(d_{12} - d_{11} - d_{22} + d_{21})$$

where $$d_{11} = \sqrt{d_{S1}^2 - 2d_{S1}d_0\cos(\theta_1) + d_0^2}$$

$$d_{12} = \sqrt{d_{S1}^2 + 2d_{S1}d_0\cos(\theta_1) + d_0^2}$$

$$d_{21} = \sqrt{d_{S2}^2 - 2d_{S2}d_0\cos(\theta_2) + d_0^2}$$

$$d_{22} = \sqrt{d_{S2}^2 + 2d_{S2}d_0\cos(\theta_2) + d_0^2}$$

Figure 53:
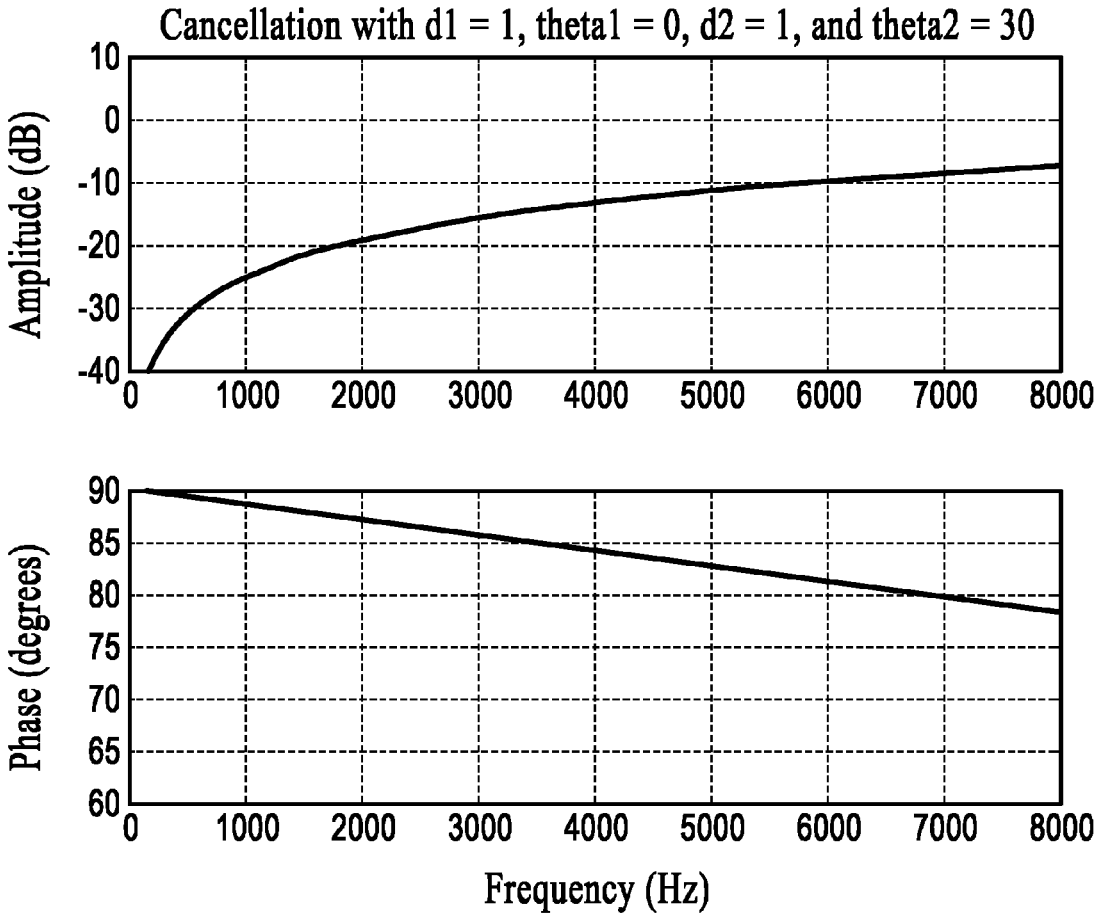
FIG. 53 is a plot of amplitude (top) and phase (bottom) response of the effect on the speech cancellation in $V_2$ due to a mistake in the location of the speech source with q1=0 degrees and q2=30 degrees, under an embodiment. The cancellation remains below −10 dB for frequencies below 6 kHz.
Figure 54:
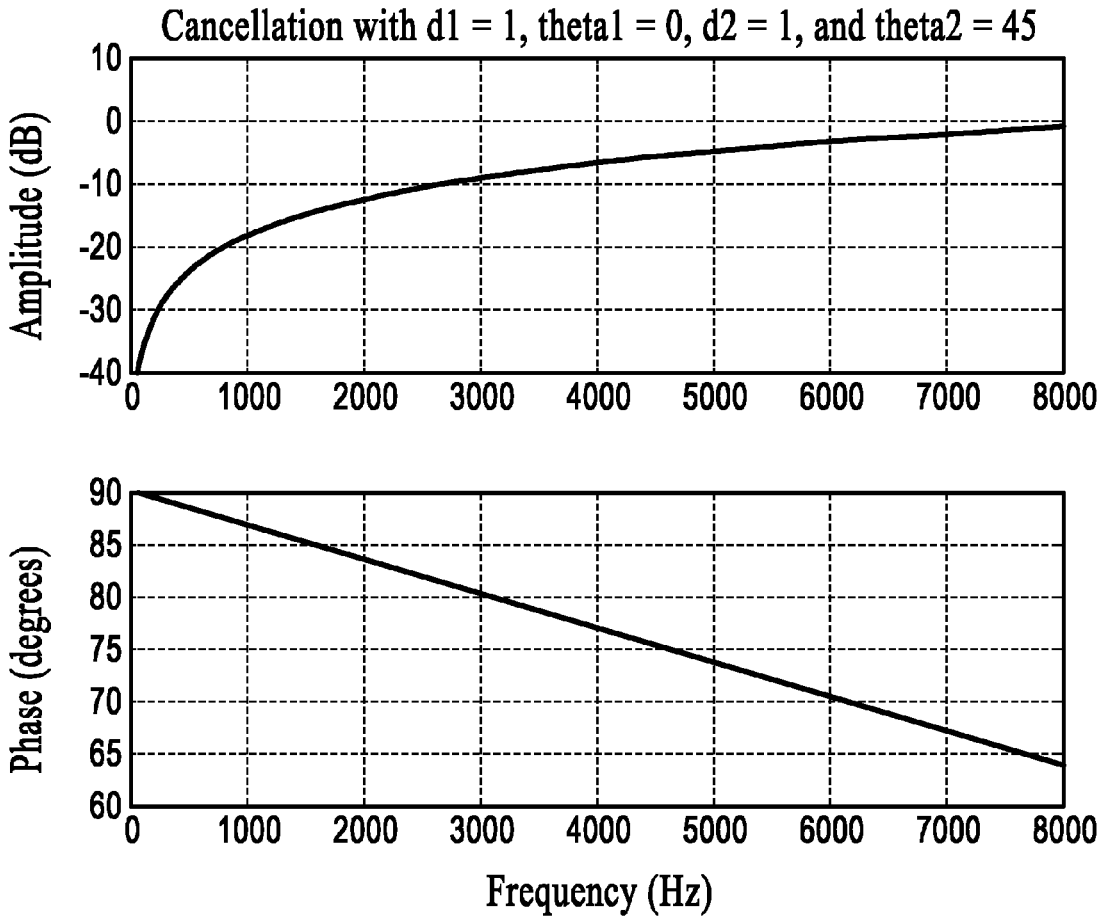
FIG. 54 is a plot of amplitude (top) and phase (bottom) response of the effect on the speech cancellation in $V_2$ due to a mistake in the location of the speech source with q1=0 degrees and q2=45 degrees, under an embodiment. The cancellation is below −10 dB only for frequencies below about 2.8 kHz and a reduction in performance is expected.

The $V_2$ speech cancellation response for $\theta_1$=0 degrees and $\theta_2$=30 degrees and assuming that B=1 is shown in FIG. 53. FIG. 53 is a plot of amplitude (top) and phase (bottom) response of the effect on the speech cancellation in $V_2$ due to a mistake in the location of the speech source with q1=0 degrees and q2=30 degrees, under an embodiment. Note that the cancellation is still below −10 dB for frequencies below 6 kHz. The cancellation is still below approximately −10 dB for frequencies below approximately 6 kHz, so an error of this type will not significantly affect the performance of the system. However, if $\theta_2$ is increased to approximately 45 degrees, as shown in FIG. 54, the cancellation is below approximately −10 dB only for frequencies below approximately 2.8 kHz. FIG. 54 is a plot of amplitude (top) and phase (bottom) response of the effect on the speech cancellation in $V_2$ due to a mistake in the location of the speech source with q1=0 degrees and q2=45 degrees, under an embodiment. Now the cancellation is below −10 dB only for frequencies below about 2.8 kHz and a reduction in performance is expected. The poor $V_2$ speech cancellation above approximately 4 kHz may result in significant devoicing for those frequencies.

The description above has assumed that the microphones $O_1$ and $O_2$ were calibrated so that their response to a source located the same distance away was identical for both amplitude and phase. This is not always feasible, so a more practical calibration procedure is presented below. It is not as accurate, but is much simpler to implement. Begin by defining a filter α(z) such that:

$$O_{1C}(z)=\alpha(z)O_{2C}(z)$$

where the "C" subscript indicates the use of a known calibration source. The simplest one to use is the speech of the user. Then $$O_{1S}(z)=\alpha(z)O_{2C}(z)$$

The microphone definitions are now:

$$V_1(z)=O_1(z)\cdot z^{-\gamma}-\beta(z)\alpha(z)O_2(z)$$

$$V_2(z)=\alpha(z)O_2(z)-z^{-\gamma}\beta(z)O_1(z)$$

The β of the system should be fixed and as close to the real value as possible. In practice, the system is not sensitive to changes in β and errors of approximately +−5% are easily tolerated. During times when the user is producing speech but there is little or no noise, the system can train α(z) to remove as much speech as possible. This is accomplished by:

1. Construct an adaptive system as shown in FIG. 33 with $\beta O_{1S}(z)z^{-\gamma}$ in the "MIC1" position, $O_{2S}(z)$ in the "MIC2" position, and α(z) in the $H_1(z)$ position.
2. During speech, adapt α(z) to minimize the residual of the system.
3. Construct $V_1(z)$ and $V_2(z)$ as above.

A simple adaptive filter can be used for α(z) so that only the relationship between the microphones is well modeled. The system of an embodiment trains only when speech is being produced by the user. A sensor like the SSM is invaluable in determining when speech is being produced in the absence of noise. If the speech source is fixed in position and will not vary significantly during use (such as when the array is on an earpiece), the adaptation should be infrequent and slow to update in order to minimize any errors introduced by noise present during training.

The above formulation works very well because the noise (far-field) responses of $V_1$ and $V_2$ are very similar while the speech (near-field) responses are very different. However, the formulations for $V_1$ and $V_2$ can be varied and still result in good performance of the system as a whole. If the definitions for $V_1$ and $V_2$ are taken from above and new variables B1 and B2 are inserted, the result is:

$$V_1(z)=O_1(z)\cdot z^{-\gamma_T}-B_1\beta_T O_2(z)$$

$$V_2(z)=O_2(z)-z^{-\gamma_T}B_2\beta_T O_1(z)$$

where B1 and B2 are both positive numbers or zero. If B1 and B2 are set equal to unity, the optimal system results as described above. If B1 is allowed to vary from unity, the response of $V_1$ is affected. An examination of the case where B2 is left at 1 and B1 is decreased follows. As B1 drops to approximately zero, $V_1$ becomes less and less directional, until it becomes a simple omnidirectional microphone when B1=0. Since B2=1, a speech null remains in $V_2$, so very different speech responses remain for $V_1$ and $V_2$. However, the noise responses are much less similar, so denoising will not be as effective. Practically, though, the system still performs well. B1 can also be increased from unity and once again the system will still denoise well, just not as well as with B1=1.

If B2 is allowed to vary, the speech null in $V_2$ is affected. As long as the speech null is still sufficiently deep, the system will still perform well. Practically values down to approximately B2=0.6 have shown sufficient performance, but it is recommended to set B2 close to unity for optimal performance.

Similarly, variables $\epsilon$ and $\Delta$ may be introduced so that:

$$V_1(z)=(\epsilon-\beta)O_{2N}(z)+(1+\Delta)O_{1N}(z)z^{-\gamma}$$

$$V_2(z)=(1+\Delta)O_{2N}(z)+(\epsilon-\beta)O_{1N}(z)z^{-\gamma}$$

This formulation also allows the virtual microphone responses to be varied but retains the all-pass characteristic of $H_1(z)$.

In conclusion, the system is flexible enough to operate well at a variety of B1 values, but B2 values should be close to unity to limit devoicing for best performance.

Figure 55:
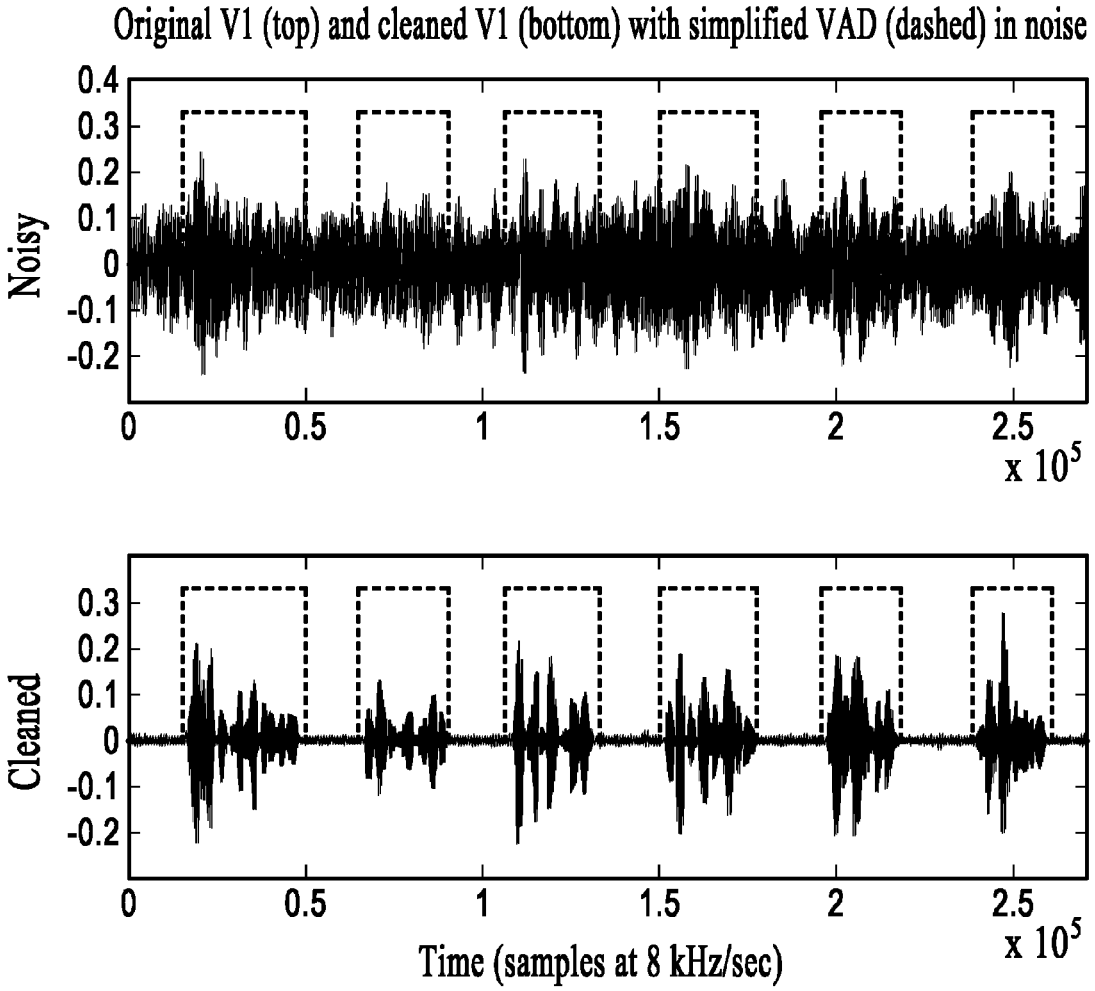
FIG. 55 shows experimental results for a $2d_0=19$ mm array using a linear β of 0.83 on a Bruel and Kjaer Head and Torso Simulator (HATS) in very loud (~85 dBA) music/speech noise environment, under an embodiment. The noise has been reduced by about 25 dB and the speech hardly affected, with no noticeable distortion.

Experimental results for a $2d_0$=19 mm array using a linear $\beta$ of 0.83 and B1=B2=1 on a Bruel and Kjaer Head and Torso Simulator (HATS) in very loud (~85 dBA) music/speech noise environment are shown in FIG. 55. The alternate microphone calibration technique discussed above was used to calibrate the microphones. The noise has been reduced by about 25 dB and the speech hardly affected, with no noticeable distortion. Clearly the technique significantly increases the SNR of the original speech, far outperforming conventional noise suppression techniques.

Embodiments described herein include a method executing on a processor, the method comprising inputting a signal into a first microphone and a second microphone. The method of an embodiment comprises determining a first response of the first microphone to the signal. The method of an embodiment comprises determining a second response of the second microphone to the signal. The method of an embodiment comprises generating a first filter model of the first microphone and a second filter model of the second microphone from the first response and the second response. The method of an embodiment comprises forming a calibrated microphone array by applying the second filter model to the first response of the first microphone and applying the first filter model to the second response of the second microphone.

Embodiments described herein include a method executing on a processor, the method comprising: inputting a signal into a first microphone and a second microphone; determining a first response of the first microphone to the signal; determining a second response of the second microphone to the signal; generating a first filter model of the first microphone and a second filter model of the second microphone from the first response and the second response; and forming a calibrated microphone array by applying the second filter model to the first response of the first microphone and applying the first filter model to the second response of the second microphone.

The method of an embodiment comprises generating a third filter model that normalizes the first response and the second response.

The generating of the third filter model of an embodiment comprises convolving the first filter model with the second filter model.

The method of an embodiment comprises comparing a result of the convolving with a standard response filter.

The standard response filter of an embodiment comprises a highpass filter having a pole at a frequency of approximately 200 Hertz.

The third filter model of an embodiment corrects an amplitude response of the result of the convolving.

The third filter model of an embodiment is a linear phase finite impulse response (FIR) filter.

The method of an embodiment comprises applying the third filter model to a signal resulting from the applying of the second filter model to the first response of the first microphone.

The method of an embodiment comprises applying the third filter model to a signal resulting from the applying of the first filter model to the second response of the second microphone.

The method of an embodiment comprises inputting a second signal into the system. The method of an embodiment comprises determining a third response of the first microphone by applying the second filter model and the third filter model to an output of the first microphone resulting from the second signal. The method of an embodiment comprises determining a fourth response of the second microphone by applying the first filter model and the third filter model to an output of the second microphone resulting from the second signal.

The method of an embodiment comprises generating a fourth filter model from a combination of the third response and the fourth response.

The generating of the fourth filter model of an embodiment comprises applying an adaptive filter to the third response and the fourth response.

The fourth filter model of an embodiment is a minimum phase filter model.

The method of an embodiment comprises generating a fifth filter model from the fourth filter model.

The fifth filter model of an embodiment is a linear phase filter model.

Forming the calibrated microphone array of an embodiment comprises applying the third filter model to at least one of an output of the first filter model and an output of the second filter model.

Forming the calibrated microphone array of an embodiment comprises applying the third filter model to the output of the first filter model and the output of the second filter model.

The method of an embodiment comprises applying the second filter model and the third filter model to a signal output of the first microphone.

The method of an embodiment comprises applying the first filter model, the third filter model and the fifth filter model to a signal output of the second microphone.

The calibrated microphone array of an embodiment comprises amplitude response calibration and phase response calibration.

The method of an embodiment comprises generating a first microphone signal by applying the second filter model and the third filter model to a signal output of the first microphone. The method of an embodiment comprises generating a first delayed first microphone signal by applying a first delay filter to the first microphone signal. The method of an embodiment comprises inputting the first delayed first microphone signal to a processing component, wherein the processing component generates a virtual microphone array comprising a first virtual microphone and a second virtual microphone.

The method of an embodiment comprises generating a second microphone signal by applying the first filter model, the third filter model and the fifth filter model to a signal output of the second microphone. The method of an embodiment comprises inputting the second microphone signal to the processing component.

The method of an embodiment comprises generating a second delayed first microphone signal by applying a second delay filter to the first microphone signal. The method of an embodiment comprises inputting the second delayed first microphone signal to an acoustic voice activity detector.

The method of an embodiment comprises generating a third microphone signal by applying the first filter model, the third filter model and the fourth filter model to a signal output of the second microphone. The method of an embodiment comprises inputting the third microphone signal to the acoustic voice activity detector.

The method of an embodiment comprises generating a first microphone signal by applying the second filter model and the third filter model to a signal output of the first microphone. The method of an embodiment comprises generating a second microphone signal by applying the first filter model, the third filter model and the fifth filter model to a signal output of the second microphone.

The method of an embodiment comprises forming a first virtual microphone by generating a first combination of the first microphone signal and the second microphone signal. The method of an embodiment comprises forming a second virtual microphone by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

Forming the first virtual microphone of an embodiment includes forming the first virtual microphone to have a first linear response to speech that is devoid of a null, wherein the speech is human speech.

Forming the second virtual microphone of an embodiment includes forming the second virtual microphone to have a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The second signal of an embodiment is a white noise signal.

The generating of the first filter model and the second filter model of an embodiment comprises: calculating a calibration filter by applying an adaptive filter to the first response and the second response; and determining a peak magnitude and a peak location of a largest peak of the calibration filter, wherein the largest peak is a largest peak located below a frequency of approximately 500 Hertz.

When a largest phase variation of the calibration filter of an embodiment is approximately in a range between three degrees and negative 5 degrees, the generating of the first filter model and the second filter model comprises using unity filters for each of the first filter model, the second filter model and the third filter model.

The method of an embodiment comprises, when a largest phase variation of the calibration filter is greater than three degrees, calculating a first frequency corresponding to the first microphone and a second frequency corresponding to the second microphone.

The first frequency and the second frequency of an embodiment is a 3-decibel frequency.

The generating of the first filter model and the second filter model of an embodiment comprises using the first frequency and the second frequency to generate the first filter model and the second filter model.

The first filter model of an embodiment is an infinite impulse response (IIR) model.

The second filter model of an embodiment is an infinite impulse response (IIR) model.

The signal of an embodiment is a white noise signal.

Embodiments described herein include a system comprising a microphone array comprising a first microphone and a second microphone. The system of an embodiment comprises a first filter coupled to an output of the second microphone. The first filter models a response of the first microphone to a noise signal. The system of an embodiment comprises a second filter coupled to an output of the first microphone. The second filter models a response of the second microphone to the noise signal. The system of an embodiment comprises a processor coupled to the first filter and the second filter.

Embodiments described herein include a system comprising: a microphone array comprising a first microphone and a second microphone; a first filter coupled to an output of the second microphone, wherein the first filter models a response of the first microphone to a noise signal; a second filter coupled to an output of the first microphone, wherein the second filter models a response of the second microphone to the noise signal; and a processor coupled to the first filter and the second filter.

The system of an embodiment comprises a third filter coupled to an output of at least one of the first filter and the second filter.

The third filter of an embodiment normalizes the first response and the second response.

The third filter of an embodiment is generated by convolving a response of the first filter with a response of the second filter and comparing a result of the convolving with a standard response filter.

The third filter of an embodiment corrects an amplitude response of the result of the convolving.

The third filter of an embodiment is a linear phase finite impulse response (FIR) filter.

The system of an embodiment comprises coupling the third filter to an output of the second filter.

The system of an embodiment comprises coupling the third filter to an output of the first filter.

The system of an embodiment comprises a fourth filter coupled to an output of the third filter that is coupled to the second microphone.

The fourth filter of an embodiment is a minimum phase filter.

The fourth filter of an embodiment is generated by: determining a third response of the first microphone by applying a response of the second filter and a response of the third filter to an output of the first microphone resulting from a second signal; determining a fourth response of the second microphone by applying a response of the first filter and a response of the third filter to an output of the second microphone resulting from the second signal; and generating the fourth filter from a combination of the third response and the fourth response.

The generating of the fourth filter of an embodiment comprises applying an adaptive filter to the third response and the fourth response.

The system of an embodiment comprises a fifth filter that is a linear phase filter.

The fifth filter of an embodiment is generated from the fourth filter.

The system of an embodiment comprises at least one of the fourth filter and the fifth filter coupled to an output of the third filter that is coupled to the first filter and the second microphone.

The system of an embodiment comprises outputting a first microphone signal from a signal path including the first microphone coupled to the second filter and the third filter. The system of an embodiment comprises generating a first delayed first microphone signal by applying a first delay filter to the first microphone signal. The system of an embodiment comprises inputting the first delayed first microphone signal to the processor, wherein the processor generates a virtual microphone array comprising a first virtual microphone and a second virtual microphone.

The system of an embodiment comprises outputting a second microphone signal from a signal path including the second microphone coupled to the first filter, the third filter and the fifth filter. The system of an embodiment comprises inputting the second microphone signal to the processor.

The system of an embodiment comprises generating a second delayed first microphone signal by applying a second delay filter to the first microphone signal. The system of an embodiment comprises inputting the second delayed first microphone signal to an acoustic voice activity detector (AVAD).

The system of an embodiment comprises outputting a third microphone signal from a signal path including the second microphone coupled to the first filter, the third filter and the fourth filter. The system of an embodiment comprises inputting the third microphone signal to the acoustic voice activity detector.

The system of an embodiment comprises outputting a first microphone signal from a signal path including the first microphone coupled to the second filter and the third filter. The system of an embodiment comprises outputting a second microphone signal from a signal path including the second microphone coupled to the first filter, the third filter and the fifth filter.

The system of an embodiment comprises a first virtual microphone, wherein the first virtual microphone is formed by generating a first combination of the first microphone signal and the second microphone signal. The system of an embodiment comprises a second virtual microphone, wherein the second virtual microphone is formed by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

Forming the first virtual microphone of an embodiment includes forming the first virtual microphone to have a first linear response to speech that is devoid of a null, wherein the speech is human speech.

Forming the second virtual microphone of an embodiment includes forming the second virtual microphone to have a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

Generating the first filter and the second filter of an embodiment comprises: calculating a calibration filter by applying an adaptive filter to the first response and the second response; and determining a peak magnitude and a peak location of a largest peak of the calibration filter, wherein the largest peak is a largest peak located below a frequency of approximately 500 Hertz.

When a largest phase variation of the calibration filter of an embodiment is in a range between approximately positive three (3) degrees and negative five (5) degrees, the generating of the first filter and the second filter comprises using unity filters for each of the first filter, the second filter and the third filter.

The system of an embodiment comprises, when a largest phase variation of the calibration filter is greater than positive three (3) degrees, calculating a first frequency corresponding to the first microphone and a second frequency corresponding to the second microphone.

Each of the first frequency and the second frequency of an embodiment is a three-decibel frequency.

The generating of the first filter and the second filter of an embodiment comprises using the first frequency and the second frequency to generate the first filter and the second filter.

The first filter of an embodiment is an infinite impulse response (IIR) filter.

The second filter of an embodiment is an infinite impulse response (IIR) filter.

The signal of an embodiment is a white noise signal.

The microphone array of an embodiment comprises amplitude response calibration and phase response calibration.

Embodiments described herein include a system comprising a microphone array comprising a first microphone and a second microphone. The system of an embodiment comprises a first filter coupled to an output of the second microphone. The first filter models a response of the first microphone to a noise signal and outputs a second microphone signal. The system of an embodiment comprises a second filter coupled to an output of the first microphone. The second filter models a response of the second microphone to the noise signal and outputs a first microphone signal. The first microphone signal is calibrated with the second microphone signal. The system of an embodiment comprises a processor coupled to the microphone array and generating from the first microphone signal and the second microphone signal a virtual microphone array comprising a first virtual microphone and a second virtual microphone.

Embodiments described herein include a system comprising: a microphone array comprising a first microphone and a second microphone; a first filter coupled to an output of the second microphone, wherein the first filter models a response of the first microphone to a noise signal and outputs a second microphone signal; a second filter coupled to an output of the first microphone, wherein the second filter models a response of the second microphone to the noise signal and outputs a first microphone signal, wherein the first microphone signal is calibrated with the second microphone signal; and a processor coupled to the microphone array and generating from the first microphone signal and the second microphone signal a virtual microphone array comprising a first virtual microphone and a second virtual microphone.

The system of an embodiment comprises a third filter coupled to an output of at least one of the first filter and the second filter.

The third filter of an embodiment normalizes the first response and the second response.

The third filter of an embodiment is a linear phase finite impulse response (FIR) filter.

The third filter of an embodiment is coupled to an output of the second filter.

The third filter of an embodiment is coupled to an output of the first filter.

The system of an embodiment comprises a fourth filter coupled to an output of a signal path including the third filter and the second microphone.

The fourth filter of an embodiment is a minimum phase filter.

The system of an embodiment comprises a fifth filter coupled to an output of a signal path including the third filter and the second microphone The fifth filter of an embodiment is a linear phase filter.

The fifth filter of an embodiment is derived from the fourth filter.

The system of an embodiment comprises at least one of the fourth filter and the fifth filter coupled to an output of a signal path including the third filter, the first filter and the second microphone.

The system of an embodiment comprises outputting a first microphone signal from a signal path including the first microphone coupled to the second filter and the third filter. The system of an embodiment comprises generating a first delayed first microphone signal by applying a first delay filter to the first microphone signal. The system of an embodiment comprises inputting the first delayed first microphone signal to the processor, wherein the processor generates a virtual microphone array comprising a first virtual microphone and a second virtual microphone.

The system of an embodiment comprises outputting a second microphone signal from a signal path including the second microphone coupled to the first filter, the third filter and the fifth filter. The system of an embodiment comprises inputting the second microphone signal to the processor.

The system of an embodiment comprises generating a second delayed first microphone signal by applying a second delay filter to the first microphone signal. The system of an embodiment comprises inputting the second delayed first microphone signal to a voice activity detector (VAD).

The system of an embodiment comprises outputting a third microphone signal from a signal path including the second microphone coupled to the first filter, the third filter and the fourth filter. The system of an embodiment comprises inputting the third microphone signal to the voice activity detector (VAD).

The system of an embodiment comprises outputting the first microphone signal from a signal path including the first microphone coupled to the second filter and the third filter. The system of an embodiment comprises outputting the second microphone signal from a signal path including the second microphone coupled to the first filter, the third filter and the fifth filter.

The first filter and the second filter of an embodiment are generated by: calculating a calibration filter by applying an adaptive filter to the first response and the second response; and determining a peak magnitude and a peak location of a largest peak of the calibration filter, wherein the largest peak is a largest peak located below a frequency of approximately 500 Hertz.

When a largest phase variation of the calibration filter of an embodiment is approximately in a range between positive three (3) degrees and negative five (5) degrees, the generating of the first filter and the second filter comprises using unity filters for each of the first filter, the second filter and the third filter.

The system of an embodiment comprises, when a largest phase variation of the calibration filter is greater than positive three (3) degrees, calculating a first frequency corresponding to the first microphone and a second frequency corresponding to the second microphone.

The first frequency and the second frequency of an embodiment is a three-decibel frequency.

The first frequency and the second frequency of an embodiment are used to generate the first filter and the second filter.

The first filter of an embodiment is an infinite impulse response (IIR) filter.

The second filter of an embodiment is an infinite impulse response (IIR) filter.

The signal of an embodiment is a white noise signal.

The microphone array of an embodiment comprises amplitude response calibration and phase response calibration.

The system of an embodiment comprises an adaptive noise removal application running on the processor and generating denoised output signals by forming a plurality of combinations of signals output from the first virtual microphone and the second virtual microphone, wherein the denoised output signals include less acoustic noise than acoustic signals received at the microphone array.

The first and second microphones of an embodiment are omnidirectional

The first virtual microphone of an embodiment has a first linear response to speech that is devoid of a null, wherein the speech is human speech.

The second virtual microphone of an embodiment has a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The first microphone and the second microphone of an embodiment are positioned along an axis and separated by a first distance.

A midpoint of the axis of an embodiment is a second distance from a speech source that generates the speech, wherein the speech source is located in a direction defined by an angle relative to the midpoint.

The first virtual microphone of an embodiment comprises the second microphone signal subtracted from the first microphone signal.

The first microphone signal of an embodiment is delayed.

The delay of an embodiment is raised to a power that is proportional to a time difference between arrival of the speech at the first virtual microphone and arrival of the speech at the second virtual microphone.

The delay of an embodiment is raised to a power that is proportional to a sampling frequency multiplied by a quantity equal to a third distance subtracted from a fourth distance, the third distance being between the first microphone and the speech source and the fourth distance being between the second microphone and the speech source.

The second microphone signal of an embodiment is multiplied by a ratio, wherein the ratio is a ratio of a third distance to a fourth distance, the third distance being between the first microphone and the speech source and the fourth distance being between the second microphone and the speech source.

The second virtual microphone of an embodiment comprises the first microphone signal subtracted from the second microphone signal.

The first microphone signal of an embodiment is delayed.

The delay of an embodiment is raised to a power that is proportional to a time difference between arrival of the speech at the first virtual microphone and arrival of the speech at the second virtual microphone.

The power of an embodiment is proportional to a sampling frequency multiplied by a quantity equal to a third distance subtracted from a fourth distance, the third distance being between the first microphone and the speech source and the fourth distance being between the second microphone and the speech source.

The first microphone signal of an embodiment is multiplied by a ratio, wherein the ratio is a ratio of the third distance to the fourth distance.

The first virtual microphone of an embodiment comprises the second microphone signal subtracted from a delayed version of the first microphone signal.

The second virtual microphone of an embodiment comprises a delayed version of the first microphone signal subtracted from the second microphone signal.

The system of an embodiment comprises a voice activity detector (VAD) coupled to the processor, the VAD generating voice activity signals.

The system of an embodiment comprises a communication channel coupled to the processor, the communication channel comprising at least one of a wireless channel, a wired channel, and a hybrid wireless/wired channel.

The system of an embodiment comprises a communication device coupled to the processor via the communication channel, the communication device comprising one or more of cellular telephones, satellite telephones, portable telephones, wireline telephones, Internet telephones, wireless transceivers, wireless communication radios, personal digital assistants (PDAs), and personal computers (PCs).

Embodiments described herein include a method executing on a processor, the method comprising receiving signals at a microphone array comprising a first microphone and a second microphone. The method of an embodiment comprises filtering an output of the second microphone with a first filter. The first filter comprises a first filter model that models a response of the first microphone to a noise signal and outputs a second microphone signal. The method of an embodiment comprises filtering an output of the first microphone with a second filter. The second filter comprises a second filter model that models a response of the second microphone to the noise signal and outputs a first microphone signal. The first microphone signal is calibrated with the second microphone signal. The method of an embodiment comprises generating from the first microphone signal and the second microphone signal a virtual microphone array comprising a first virtual microphone and a second virtual microphone.

Embodiments described herein include a method executing on a processor, the method comprising: receiving signals at a microphone array comprising a first microphone and a second microphone; filtering an output of the second microphone with a first filter, wherein the first filter comprises a first filter model that models a response of the first microphone to a noise signal and outputs a second microphone signal; filtering an output of the first microphone with a second filter, wherein the second filter comprises a second filter model that models a response of the second microphone to the noise signal and outputs a first microphone signal, wherein the first microphone signal is calibrated with the second microphone signal; and generating from the first microphone signal and the second microphone signal a virtual microphone array comprising a first virtual microphone and a second virtual microphone.

The method of an embodiment comprises generating a third filter model that normalizes the first response and the second response.

The generating of the third filter model of an embodiment comprises convolving the first filter model with the second filter model and comparing a result of the convolving with a standard response filter, wherein the third filter model corrects an amplitude response of the result of the convolving.

The third filter model of an embodiment is a linear phase finite impulse response (FIR) filter.

The method of an embodiment comprises applying the third filter model to a signal resulting from the applying of the second filter model to the first response of the first microphone.

The method of an embodiment comprises applying the third filter model to a signal resulting from the applying of the first filter model to the second response of the second microphone.

The method of an embodiment comprises determining a third response of the first microphone by applying the second filter model and the third filter model to an output of the first microphone resulting from a second signal. The method of an embodiment comprises determining a fourth response of the second microphone by applying the first filter model and the third filter model to an output of the second microphone resulting from the second signal. The method of an embodiment comprises generating a fourth filter model from a combination of the third response and the fourth response, wherein the generating of the fourth filter model comprises applying an adaptive filter to the third response and the fourth response.

The fourth filter model of an embodiment is a minimum phase filter model.

The method of an embodiment comprises generating a fifth filter model from the fourth filter model.

The fifth filter model of an embodiment is a linear phase filter model.

Forming the microphone array of an embodiment comprises applying the third filter model to at least one of an output of the first filter model and an output of the second filter model.

Forming the microphone array of an embodiment comprises applying the third filter model to the output of the first filter model and the output of the second filter model.

The method of an embodiment comprises applying the second filter model and the third filter model to a signal output of the first microphone.

The method of an embodiment comprises applying the first filter model, the third filter model and the fifth filter model to a signal output of the second microphone.

The microphone array of an embodiment comprises amplitude response calibration and phase response calibration.

The method of an embodiment comprises generating denoised output signals by forming a plurality of combinations of signals output from the first virtual microphone and the second virtual microphone, wherein the denoised output signals include less acoustic noise than acoustic signals received at the microphone array.

The method of an embodiment comprises generating the first microphone signal by applying the second filter model and the third filter model to a signal output of the first microphone. The method of an embodiment comprises generating a first delayed first microphone signal by applying a first delay filter to the first microphone signal. The method of an embodiment comprises inputting the first delayed first microphone signal to the processor.

The method of an embodiment comprises generating a second microphone signal by applying the first filter model, the third filter model and the fifth filter model to a signal output of the second microphone. The method of an embodiment comprises inputting the second microphone signal to the processor.

The method of an embodiment comprises generating a second delayed first microphone signal by applying a second delay filter to the first microphone signal. The method of an embodiment comprises inputting the second delayed first microphone signal to an acoustic voice activity detector.

The method of an embodiment comprises generating a third microphone signal by applying the first filter model, the third filter model and the fourth filter model to a signal output of the second microphone. The method of an embodiment comprises inputting the third microphone signal to the acoustic voice activity detector.

The method of an embodiment comprises generating the first microphone signal by applying the second filter model and the third filter model to a signal output of the first microphone, and generating the second microphone signal by applying the first filter model, the third filter model and the fifth filter model to a signal output of the second microphone.

At least one of the first filter model and the second filter model of an embodiment is an infinite impulse response (IIR) model.

The method of an embodiment comprises forming the first virtual microphone by generating a first combination of the first microphone signal and the second microphone signal. The method of an embodiment comprises forming the second virtual microphone by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

Forming the first virtual microphone of an embodiment includes forming the first virtual microphone to have a first linear response to speech that is devoid of a null, wherein the speech is human speech.

Forming the second virtual microphone of an embodiment includes forming the second virtual microphone to have a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The method of an embodiment comprises positioning the first physical microphone and the second physical microphone along an axis and separating the first and second physical microphones by a first distance.

A midpoint of the axis of an embodiment is a second distance from a speech source that generates the speech, wherein the speech source is located in a direction defined by an angle relative to the midpoint.

Forming the first virtual microphone of an embodiment comprises subtracting the second microphone signal subtracted from the first microphone signal.

The method of an embodiment comprises delaying the first microphone signal.

The method of an embodiment comprises raising the delay to a power that is proportional to a time difference between arrival of the speech at the first virtual microphone and arrival of the speech at the second virtual microphone.

The method of an embodiment comprises raising the delay to a power that is proportional to a sampling frequency multiplied by a quantity equal to a third distance subtracted from a fourth distance, the third distance being between the first physical microphone and the speech source and the fourth distance being between the second physical microphone and the speech source.

The method of an embodiment comprises multiplying the second microphone signal by a ratio, wherein the ratio is a ratio of a third distance to a fourth distance, the third distance being between the first physical microphone and the speech source and the fourth distance being between the second physical microphone and the speech source.

Forming the second virtual microphone of an embodiment comprises subtracting the first microphone signal from the second microphone signal.

The method of an embodiment comprises delaying the first microphone signal.

The method of an embodiment comprises raising the delay to a power that is proportional to a time difference between arrival of the speech at the first virtual microphone and arrival of the speech at the second virtual microphone.

The method of an embodiment comprises raising the delay to a power that is proportional to a sampling frequency multiplied by a quantity equal to a third distance subtracted from a fourth distance, the third distance being between the first physical microphone and the speech source and the fourth distance being between the second physical microphone and the speech source.

The method of an embodiment comprises multiplying the first microphone signal by a ratio, wherein the ratio is a ratio of the third distance to the fourth distance.

Forming the first virtual microphone of an embodiment comprises subtracting the second microphone signal from a delayed version of the first microphone signal.

Forming the second virtual microphone of an embodiment comprises: forming a quantity by delaying the first microphone signal; and subtracting the quantity from the second microphone signal.

The DOMA and corresponding calibration methods (v4, v1, v5, v6) can be a component of a single system, multiple systems, and/or geographically separate systems. The DOMA and corresponding calibration methods (v4, v4.1, v5, v6) can also be a subcomponent or subsystem of a single system, multiple systems, and/or geographically separate systems. The DOMA and corresponding calibration methods (v4, v4.1, v5, v6) can be coupled to one or more other components (not shown) of a host system or a system coupled to the host system.

One or more components of the DOMA and corresponding calibration methods (v4, v4.1, v5, v6) and/or a corresponding system or application to which the DOMA and corresponding calibration methods (v4, v4.1, v5, v6) is coupled or connected includes and/or runs under and/or in association with a processing system. The processing system includes any collection of processor-based devices or computing devices operating together, or components of processing systems or devices, as is known in the art. For example, the processing system can include one or more of a portable computer, portable communication device operating in a communication network, and/or a network server. The portable computer can be any of a number and/or combination of devices selected from among personal computers, cellular telephones, personal digital assistants, portable computing devices, and portable communication devices, but is not so limited. The processing system can include components within a larger computer system.

The processing system of an embodiment includes at least one processor and at least one memory device or subsystem. The processing system can also include or be coupled to at least one database. The term "processor" as generally used herein refers to any logic processing unit, such as one or more central processing units (CPUs), digital signal processors (DSPs), application-specific integrated circuits (ASIC), etc. The processor and memory can be monolithically integrated onto a single chip, distributed among a number of chips or components, and/or provided by some combination of algorithms. The methods described herein can be implemented in one or more of software algorithm(s), programs, firmware, hardware, components, circuitry, in any combination.

The components of any system that includes the DOMA and corresponding calibration methods (v4, v4.1, v5, v6) can be located together or in separate locations. Communication paths couple the components and include any medium for communicating or transferring files among the components. The communication paths include wireless connections, wired connections, and hybrid wireless/wired connections. The communication paths also include couplings or connections to networks including local area networks (LANs), metropolitan area networks (MANs), wide area networks (WANs), proprietary networks, interoffice or backend networks, and the Internet. Furthermore, the communication paths include removable fixed mediums like floppy disks, hard disk drives, and CD-ROM disks, as well as flash RAM, Universal Serial Bus (USB) connections, RS-232 connections, telephone lines, buses, and electronic mail messages.

Aspects of the DOMA and corresponding calibration methods (v4, v4.1, v5, v6) and corresponding systems and methods described herein may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing aspects of the DOMA and corresponding calibration methods (v4, v4.1, v5, v6) and corresponding systems and methods include: microcontrollers with memory (such as electronically erasable programmable read only memory (EEPROM)), embedded microprocessors, firmware, software, etc. Furthermore, aspects of the DOMA and corresponding systems and methods may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed analog and digital, etc.

It should be noted that any system, method, and/or other components disclosed herein may be described using computer aided design tools and expressed (or represented), as data and/or instructions embodied in various computer-readable media, in terms of their behavioral, register transfer, logic component, transistor, layout geometries, and/or other characteristics. Computer-readable media in which such formatted data and/or instructions may be embodied include, but are not limited to, non-volatile storage media in various forms (e.g., optical, magnetic or semiconductor storage media) and carrier waves that may be used to transfer such formatted data and/or instructions through wireless, optical, or wired signaling media or any combination thereof. Examples of transfers of such formatted data and/or instructions by carrier waves include, but are not limited to, transfers (uploads, downloads, e-mail, etc.) over the Internet and/or other computer networks via one or more data transfer protocols (e.g., HTTP, FTP, SMTP, etc.). When received within a computer system via one or more computer-readable media, such data and/or instruction-based expressions of the above described components may be processed by a processing entity (e.g., one or more processors) within the computer system in conjunction with execution of one or more other computer programs.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import, when used in this application, refer to this application as a whole and not to any particular portions of this application. When the word "or" is used in reference to a list of two or more items, that word covers all of the following interpretations of the word: any of the items in the list, all of the items in the list and any combination of the items in the list.

The above description of embodiments of the DOMA and corresponding calibration methods (v4, v4.1, v5, v6) and corresponding systems and methods is not intended to be exhaustive or to limit the systems and methods to the precise forms disclosed. While specific embodiments of, and examples for, the DOMA and corresponding calibration methods (v4, v4.1, v5, v6) and corresponding systems and methods are described herein for illustrative purposes, various equivalent modifications are possible within the scope of the systems and methods, as those skilled in the relevant art will recognize. The teachings of the DOMA and corresponding calibration methods (v4, v4.1, v5, v6) and corresponding systems and methods provided herein can be applied to other systems and methods, not only for the systems and methods described above.

The elements and acts of the various embodiments described above can be combined to provide further embodiments. These and other changes can be made to the DOMA and corresponding calibration methods (v4, v4.1, v5, v6) and corresponding systems and methods in light of the above detailed description.

In general, in the following claims, the terms used should not be construed to limit the DOMA and corresponding calibration methods (v4, v4.1, v5, v6) and corresponding systems and methods to the specific embodiments disclosed in the specification and the claims, but should be construed to include all systems that operate under the claims. Accordingly, the DOMA and corresponding calibration methods (v4, v4.1, v5, v6) and corresponding systems and methods is not limited by the disclosure, but instead the scope is to be determined entirely by the claims.

While certain aspects of the DOMA and corresponding calibration methods (v4, v4.1, v5, v6) and corresponding systems and methods are presented below in certain claim forms, the inventors contemplate the various aspects of the DOMA and corresponding calibration methods (v4, v4.1, v5, v6) and corresponding systems and methods in any number of claim forms. Accordingly, the inventors reserve the right to add additional claims after filing the application to pursue such additional claim forms for other aspects of the DOMA and corresponding calibration methods (v4, v4.1, v5, v6) and corresponding systems and methods.

What is claimed is:

1. A method executing on a processor, the method comprising:

inputting a signal into a first microphone and a second microphone;

determining a first response of the first microphone to the signal;

determining a second response of the second microphone to the signal;

generating a first filter model of the first microphone and a second filter model of the second microphone from the first response and the second response;

generating a third filter model that normalizes the first response and the second response, wherein the generating of the third filter model comprises convolving the first response and the second response and also comprises comparing a result of the convolving with a standard response filter; and forming a calibrated microphone array by applying the second filter model to the first response of the first microphone and applying the first filter model to the second response of the second microphone.

2. The method of claim 1, wherein the standard response filter comprises a highpass filter having a pole at a frequency of approximately 200 Hertz.

3. The method of claim 1, wherein the third filter model corrects an amplitude response of the result of the convolving.

4. The method of claim 3, wherein the third filter model is a linear phase finite impulse response (FIR) filter.

5. The method of claim 1, comprising applying the third filter model to a signal resulting from the applying of the second filter model to the first response of the first microphone.

6. The method of claim 5, comprising applying the third filter model to a signal resulting from the applying of the first filter model to the second response of the second microphone.

7. The method of claim 6, comprising:

inputting a second signal into the system;

determining a third response of the first microphone by applying the second filter model and the third filter model to an output of the first microphone resulting from the second signal; and determining a fourth response of the second microphone by applying the first filter model and the third filter model to an output of the second microphone resulting from the second signal.

8. The method of claim 7, comprising generating a fourth filter model from a combination of the third response and the fourth response.

9. The method of claim 8, wherein the generating of the fourth filter model comprises applying an adaptive filter to the third response and the fourth response.

10. The method of claim 8, wherein the fourth filter model is a minimum phase filter model.

11. The method of claim 8, comprising generating a fifth filter model from the fourth filter model.

12. The method of claim 11, wherein the fifth filter model is a linear phase filter model.

13. The method of claim 11, wherein forming the calibrated microphone array comprises applying the third filter model to at least one of an output of the first filter model and an output of the second filter model.

14. The method of claim 13, wherein forming the calibrated microphone array comprises applying the third filter model to at least one of an output of the first filter model and an output of the second filter model.

15. The method of claim 14, comprising applying the second filter model and the third filter model to a signal output of the first microphone.

16. The method of claim 15, comprising applying the first filter model, the third filter model and the fifth filter model to a signal output of the second microphone.

17. The method of claim 13, wherein the calibrated microphone array comprises amplitude response calibration and phase response calibration.

18. The method of claim 13, comprising:

generating a first microphone signal by applying the second filter model and the third filter model to a signal output of the first microphone;

generating a first delayed first microphone signal by applying a first delay filter to the first microphone signal; and inputting the first delayed first microphone signal to a processing component, wherein the processing component generates a virtual microphone array comprising a first virtual microphone and a second virtual microphone.

19. The method of claim 18, comprising:

generating a second microphone signal by applying the first filter model, the third filter model and the fifth filter model to a signal output of the second microphone; and inputting the second microphone signal to the processing component.

20. The method of claim 19, comprising:

generating a second delayed first microphone signal by applying a second delay filter to the first microphone signal; and inputting the second delayed first microphone signal to an acoustic voice activity detector.

21. The method of claim 20, comprising:

generating a third microphone signal by applying the first filter model, the third filter model and the fourth filter model to a signal output of the second microphone; and inputting the third microphone signal to the acoustic voice activity detector.

22. The method of claim 13, comprising:

generating a first microphone signal by applying the second filter model and the third filter model to a signal output of the first microphone; and generating a second microphone signal by applying the first filter model, the third filter model and the fifth filter model to a signal output of the second microphone.

23. The method of claim 22, comprising:

forming a first virtual microphone by generating a first combination of the first microphone signal and the second microphone signal; and forming a second virtual microphone by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

24. The method of claim 23, wherein forming the first virtual microphone includes forming the first virtual microphone to have a first linear response to speech that is devoid of a null, wherein the speech is human speech.

25. The method of claim 24, wherein forming the second virtual microphone includes forming the second virtual microphone to have a second linear response to speech that includes a single null oriented in a direction toward a source of the speech.

26. The method of claim 25, wherein the single null is a region of the second linear response having a measured response level that is lower than the measured response level of any other region of the second linear response.

27. The method of claim 25, wherein the second linear response includes a primary lobe oriented in a direction away from the source of the speech.

28. The method of claim 27, wherein the primary lobe is a region of the second linear response having a measured response level that is greater than the measured response level of any other region of the second linear response.

29. The method of claim 7, wherein the second signal is a white noise signal.

30. The method of claim 1, wherein the generating of the first filter model and the second filter model comprises:

calculating a calibration filter by applying an adaptive filter to the first response and the second response; and determining a peak magnitude and a peak location of a largest peak of the calibration filter, wherein the largest peak is a largest peak located below a frequency of approximately 500 Hertz.

31. The method of claim 30, wherein, when a largest phase variation of the calibration filter is approximately in a range between three degrees and negative 5 degrees, the generating of the first filter model and the second filter model comprises using unity filters for each of the first filter mode, the second filter model and the third filter model.

32. The method of claim 31, comprising, when a largest phase variation of the calibration filter is greater than three degrees, calculating a first frequency corresponding to the first microphone and a second frequency corresponding to the second microphone.

33. The method of claim 32, wherein the first frequency and the second frequency is a 3-decible frequency.

34. The method of claim 32, wherein the generating of the first filter model and the second filter model comprises using the first frequency and the second frequency to generate the first filter model and the second filter model.

35. A system comprising:

a microphone array comprising a first microphone and a second microphone;

a first filter coupled to an output of the second microphone, wherein the first filter models a response of the first microphone to a noise signal;

a second filter coupled to an output of the first microphone, wherein the second filter models a response of the second microphone to the noise signal;

a third filter coupled to an output of at least one of the first filter and the second filter, wherein the third filter normalizes the first response and the second response and the third filter is generated by convolving a response of the first filter with a response of the second filter and comparing a result of the convolving with a standard response filter; and a processor coupled to the first filter and the second filter.

36. The system of claim 35, wherein the third filter corrects an amplitude response of the result of the convolving.

37. The system of claim 35, wherein the third filter is a linear phase finite impulse response (FIR) filter.

38. The system of claim 35, comprising coupling the third filter to an output of the second filter.

39. The system claim of 38, comprising coupling the third filter to an output of the first filter.

40. The system of claim 38, comprising a fourth filter coupled to an output of the third filter that is coupled to the second microphone.

41. The system of claim 40, wherein the fourth filter is a minimum phase filter.

42. The system of claim 40, wherein the fourth filter is generated by:

determining a third response of the first microphone by applying a response of the second filter and a response of the third filter to an output of the first microphone resulting from a second signal;

determining a fourth response of the second microphone by applying a response of the first filter and a response of the third filter to an output of the second microphone resulting from the second signal; and generating the fourth filter from a combination of the third response and the fourth response.

43. The system of claim 42, wherein the generating of the fourth filter comprises applying an adaptive filter to the third response and the fourth response.

44. The system of claim 40, comprising a fifth filter that is a linear phase filter.

45. The system of claim 44, wherein the fifth filter is generated from the fourth filter.

46. The system of claim 44, comprising at least one of the fourth filter and the fifth filter coupled to an output of the third filter that is coupled to the first filter and the second microphone.

47. The system of claim 44, comprising:

outputting a first microphone signal from a signal path including the first microphone coupled to the second filter and the third filter;

generating a first delayed first microphone signal by applying a first delay filter to the first microphone signal; and inputting the first delayed first microphone signal to the processor, wherein the processor generates a virtual microphone array comprising a first virtual microphone and a second virtual microphone.

48. The system of claim 47, comprising:

outputting a second microphone signal from a signal path including the second microphone coupled to the first filter, the third filter and the fifth filter; and inputting the second microphone signal to the processor.

49. The system of claim 48, comprising:

generating a second delayed first microphone signal by applying a second delay filter to the first microphone signal; and inputting the second delayed first microphone signal to an acoustic voice activity detector (AVAD).

50. A system of claim 49, comprising:

outputting a third microphone signal from a signal path including the second microphone coupled to the first filter, the third filter and the fourth filter; and inputting the third microphone signal to the acoustic voice activity detector.

51. The system of claim 44, comprising:

outputting a first microphone signal from a signal path including the first microphone coupled to the second filter and the third filter; and outputting a second microphone signal from a signal path including the second microphone coupled to the first filter, the third filter and the fifth filter.

52. The system of claim 51, comprising:

a first virtual microphone, wherein the first virtual microphone is formed by generating a first combination of the first microphone signal and the second microphone signal; and a second virtual microphone, wherein the second virtual microphone is formed by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

53. The system of claim 52, wherein forming the first virtual microphone includes forming the first virtual microphone to have a first linear response to speech that is devoid of a null, wherein the speech is human speech.

54. The system of claim 53, wherein forming the second virtual microphone includes forming the second virtual microphone to have a second linear response to speech that includes a single null oriented in a direction toward a source of the speech.

55. The system of claim 54, wherein the single null is a region of the second linear response having a measured response level that is lower than the measured response level of any other region of the second linear response.

56. The system of claim 54, wherein the second linear response includes a primary lobe oriented in a direction away from the source of the speech.

57. The system of claim 56, wherein the primary lobe is a region of the second linear response having a measured response level that is greater than the measured response level of any other region of the second linear response.

58. The system of claim 35, wherein generating the first filter and the second filter comprises:

calculating a calibration filter by applying an adaptive filter to the first response and the second response; and determining a peak magnitude and a peak location of a largest peak of the calibration filter, wherein the largest peak is a largest peak located below a frequency of approximately 500 Hertz.

59. The system of claim 58, wherein, when a largest phase variation of the calibration filter is in a range between approximately positive three (3) degrees and negative five (5) degrees, the generating of the first filter and the second filter and the third filter.

60. The system of claim 59, comprising, when a largest phase variation of the calibration filter is greater than positive (3) degrees, calculating a first frequency corresponding to the first microphone and a second frequency corresponding to the second microphone.

61. The system of claim 60, wherein each of the first frequency and the second frequency is a three-decibel frequency.

62. The system of claim 60, wherein the generating of the first filter and the second filter comprises using the first frequency and the second frequency to generate the first filter and the second filter.

* * * * *